US005294524A

United States Patent [19]

Ishii et al.

[11] Patent Number: 5,294,524

[45] Date of Patent: Mar. 15, 1994

[54] SILVER HALIDE COLOR PHOTOGRAPHIC MATERIAL

[75] Inventors: Yoshio Ishii; Yasuhiro Yoshioka; Hidetoshi Kobayashi, all of Minami-ashigara, Japan

[73] Assignee: Fuji Photo Film Co., Ltd., Kanagawa, Japan

[21] Appl. No.: 849,588

[22] Filed: Mar. 11, 1992

[30] Foreign Application Priority Data

Mar. 13, 1991 [JP] Japan ..... 3-73841

[51] Int. Cl.[5] ..... G03C 1/46

[52] U.S. Cl. ..... 430/503; 430/505; 430/549; 430/553; 430/557; 430/552; 430/556

[58] Field of Search ..... 430/549, 553, 557, 503, 430/505

[56] References Cited

U.S. PATENT DOCUMENTS

| | | | |
|---|---|---|---|
| 4,248,961 | 2/1981 | Hagen et al. | 430/381 |
| 4,268,591 | 5/1981 | Tschopp . | |
| 4,289,847 | 9/1981 | Ishikawa et al. | 430/389 |
| 4,543,323 | 9/1985 | Iijima et al. | 430/503 |
| 4,883,746 | 11/1989 | Shimada et al. | 430/504 |
| 5,118,599 | 6/1992 | Lau et al. | 430/557 |

FOREIGN PATENT DOCUMENTS

| | | | |
|---|---|---|---|
| 447969 | 9/1991 | European Pat. Off. . | |
| 2262859 | 11/1987 | Japan | 430/553 |

OTHER PUBLICATIONS

Weissberger, et al. *Yellow color formers for color development*, 1962, *Chemical Abstracts* vol. 57, 2373.

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

There is disclosed a silver halide color photographic material which comprises in a blue-sensitive silver halide emulsion layer acylacetamide yellow dye-forming couplers represented by the following formula (I) and in a red-sensitive silver halide emulsion layer cyan dye-forming couplers represented by the following formula (II) or (III):

Formula (I)

wherein $R_1$ represents a monovalent group, Q represents a group of non-metallic atoms required to form together with the C a substituted or unsubstituted 3- to 5-membered cyclic hydrocarbon group or a substituted or unsubstituted 3- to 5-membered heterocyclic group having therein at least one heteroatom selected from a group consisting of N, O, S, and P, and $Y_R$ represents a residue remaining after removing the acyl group from the acylacetamide yellow dye-forming coupler, provided that $R_1$ is not a hydrogen atom and does not bond to Q to form a ring, Formula (II)

wherein $R^1$ represents $—CONR^4R^5$, $—SO_2NR^4R^5$, $—NHCOR^4$, $—NHCOOR^6$, $—NHSO_2R^6$, $—NHCONR^4R^5$, or $—NHSO_2NR^4R^5$; $R^2$ represents a group substitutable on a naphthalene ring; k is an integer of 0 to 3; $R^3$ represents a substituent, $X^1$ represents a hydrogen atom or a coupling split-off group; $R^4$ and $R^5$, which may be the same or different, each independently represent a hydrogen atom, an alkyl group, an aryl group, or a heterocyclic group; $R^6$ represents an alkyl group, an aryl group, or a heterocyclic group; when k is 2 or more, the $R^2$ groups may be the same or different and may bond together to form a ring; and the compound may form a dimer or higher polymer formed by bonding through a divalent group or higher polyvalent group at $R^1$, $R^2$, $R^3$, or $X^1$, Formula (III)

wherein $R^{21}$ represents an alkyl group, an aryl group, or a heterocyclic group, $R^{22}$ represents an aryl group, and $Z^1$ represents a hydrogen atom or a coupling split-off group.

43 Claims, No Drawings

SILVER HALIDE COLOR PHOTOGRAPHIC MATERIAL

FIELD OF THE INVENTION

The present invention relates to a silver halide color photographic material, and more particularly to a color photographic material wherein processing stain and stain increase during storage are suppressed.

BACKGROUND OF THE INVENTION

Generally, the basic steps for processing color photographic materials include a color-development step and a desilvering step. In the color-development step, silver halide that has been exposed to light is reduced with a color-developing agent, and the oxidized color-developing agent reacts with a coupler, to give a dye image. In the next desilvering step, the silver produced in the color-development step is oxidized with an oxidizing agent (commonly called a bleaching agent) and thereafter is dissolved with an oxidizing agent for silver ions, which is commonly called a fixing agent. Through this desilvering step, only a dye image is formed in the color photographic material.

There are two ways to carry out the above desilvering step: one comprises two baths, that is, a bleaching bath containing a bleaching agent and a fixing bath containing a fixing agent, and the other comprises one bath, that is, a bleach-fix bath containing a bleaching agent together with a fixing agent.

The practical development processing includes various subsidiary steps for the purpose, for example, of keeping the physical quality or making the preservability of the image better, such as a hardening bath, a stop bath, an image stabilizing bath, and a washing bath.

Recently, with the popularity of the small-sized-shop processing service system, that is, the socalled mini-lab processing service system, it is strongly desired to shorten the time needed for the above processing and to make the replenishing amount lower, so that customer requests for processing can be met quickly and maintenance work on the involved processing equipment can be reduced.

In particular, shortening of the desilvering step and the washing step, which conventionally take most of the processing time, is highly desired.

However, when the time required for the desilvering step (including a bleaching step, a fixing step, and a bleach-fix step) and the washing step is shortened or the replenishing amount is lowered, the following various problems result:

first, an increase in residual silver after processing (insufficient desilvering);

second, an increase in the minimum-density immediately after the processing (processing stain); and third, an increase in the minimum density during storage of the processed sample.

To improve silver retention among these problems, it is known to use a bleaching agent high in oxidation power, such as red prussiate, bichromates, ferric chloride, persulfates, and hydrobromides, but these have many defects in view of environmental preservation, handling safety, and corrosiveness of metals, and therefore they cannot practically be widely used in shop processing or the like.

Further, if the color development step is followed immediately by a bleaching process directly without an intermediate bath in order to shorten the processing step, this is accompanied by a defect that worsening of the increase of the minimum-density due to the above-described processing is observed. This phenomena is very conspicuous, for example, when a bleaching solution containing ferric 1,3-diaminopropanetetraacetate high in oxidation power, as described in JP-A ("JP-A" means unexamined published Japanese patent application) No. 222252/1987, is used.

In order to solve these problems, JP-A No. 37556/1989 discloses a method for improving processing stain by using a specific cyan coupler, and JP-A No. 23257/1989 discloses a method for improving processing stain by using a specific high-boiling organic solvent. Regarding suppression of cyan stain, the effect for improving processing stain by these methods is satisfactory to a certain extent, but with respect to magenta stain and yellow stain the effect is still unsatisfactory, and in particular it remains desired to lower magenta stain.

Further by these methods, the effect for improving the problem of color increase with time, which occurs during storage after the processing, is small, and the effect for improving magenta color increase is very small.

While the washing step, etc. are being made rapid and the replenishing amount is being lowered, there is a present and future demand for a photographic material that will develop less stain during storage after processing.

SUMMARY OF THE INVENTION

An object of the present invention is to provide a color photographic material wherein processing stain and stain that will occur during storage are reduced even if it is developed by a processing step that is made rapid and wherein the replenishing amount is lowered.

Another object of the present invention is to provide a color photographic material that can lower the occurrence of yellow stain and magenta stain particularly, in both the print obtained immediately after development processing and the print stored for a long period of time after development processing.

Other and further objects, features, and advantages of the invention will be appear more fully from the following description.

DETAILED DESCRIPTION OF THE INVENTION

The inventors have keenly studied to attain the above objects and have found that processing stain and stain that occurs during storage after processing are influenced not only by the coupler contained in the layer where the stain occurs, but also by couplers contained in layers other that layer; that is, in the case of processing stain, this stain is greatly dependent on the type of couplers contained in photosensitive layers and non-photosensitive layers nearer to the base than the stain-occurring layer, and, in the case of stain that occurs during storage after processing, this stain is greatly dependent on the type of couplers contained in photosensitive layers and non-photosensitive layers located far from the base, and that, by choosing a specific combination of couplers to be contained in layers, the occurrence of processing stain and storage stain can be suppressed, leading to completion of the present invention.

That is, the present invention provides a silver halide color photographic material having at least one red-sensitive silver halide emulsion layer, at least one green-sensitive silver halide emulsion layer, and at least one blue-sensitive silver halide emulsion layer on a support, which comprises, in at least one of said blue-sensitive silver halide emulsion layer, at least one coupler selected from an acylacetamide yellow dye-forming coupler represented by the following formula (I) and, in at least one of said red-sensitive silver halide emulsion layer, at least one coupler selected from the group consisting of cyan dye-forming couplers represented by the following formula (II) or (III):

Formula (I)

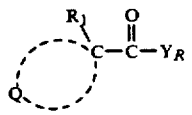

wherein $R_1$ represents a monovalent group and Q represents a group of non-metallic atoms required to form together with the C (carbon atom) a substituted or unsubstituted 3- to 5-membered cyclic hydrocarbon group or a substituted or unsubstituted 3- to 5-membered heterocyclic group having therein at least one heteroatom selected from a group consisting of N, O, S, and P, and $Y_R$ represents a residue remaining after removing the acyl group

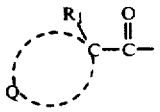

from the acylacetamide yellow dyeforming coupler represented by formula (I), provided that $R_1$ is not a hydrogen atom and does not bond to Q to form a ring, Formula (II)

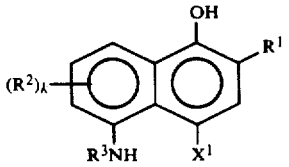

wherein $R_1$ represents $-CONR^4R^5$, $-SO_2NR^4R^5$, $-NHCOR^4$, $-NHCOOR^6$, $-NHSO_2R^6$, $-NHCONR^4R^5$, or $-NHSO_2NR^4R^5$; $R^2$ represents a group capable of substitution onto a naphthalene ring; k is an integer of 0 to 3; $R^3$ represents a substituent; $X^1$ represents a hydrogen atom or a group capable of being released upon a coupling reaction thereof with the oxidized product of an aromatic primary amine developing agent (hereinafter referred to as coupling split-off group); $R^4$ and $R^5$, which may be the same or different, each independently represent a hydrogen atom, an alkyl group, an aryl group, or a heterocyclic group; $R^6$ represents an alkyl group, an aryl group, or a heterocyclic group; when k is 2 or more, the $R^2$ groups may be the same or different and may bond together to form a ring; and the compound may form a dimer or higher polymer formed by bonding through a divalent group or higher polyvalent group at $R_1$, $R^2$, $R^3$, or $X^1$.

Formula (III)

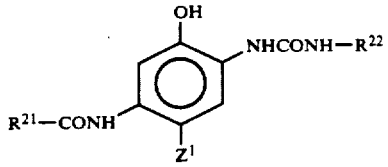

wherein $R^{21}$ represents an alkyl group, an aryl group, or a heterocyclic group, $R^{22}$ represents an aryl group, and $Z^1$ represents a hydrogen atom or a coupling split-off group.

The invention will now be described in more detail below.

The acylacetamide yellow couplers of the present invention are preferably represented by the following formula (Y):

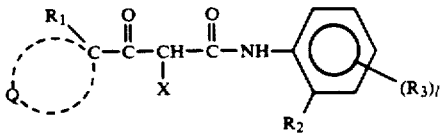

In formula (Y), $R_1$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, O, S, and P; $R_2$ represents a hydrogen atom, a halogen atom (e.g., F, Cl, Br, and I, which is applied hereinafter to the description of formula (Y)), an alkoxy group, an aryloxy group, an alkyl group, or an amino group, $R_3$ represents a group capable of substitution onto a benzene ring, X represents a coupling split-off group, l is an integer of 0 to 4, and when l is 2 or more, the $R_3$ groups may be the same or different.

In formula (I), $Y_R$ represents a residue remaining after removing the acyl group

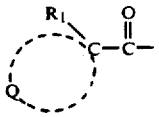

from the acylacetamide yellow dye-forming coupler represented by formula (I). In other words, $Y_R$ represents the remaining portion of formula (I) that does not correspond to the acyl group referred to above. Preferably $Y_R$ represents the following residue as shown in formula (Y)

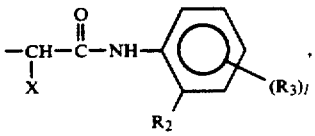

wherein the substituents are as defined in formula (Y). $Y_R$ may also be represented by the corresponding residues as shown in publications.

When any of the substituents in formula (Y) is an alkyl group or contains an alkyl group, unless otherwise specified, the alkyl group means a straight chain, branched-chain, or cyclic alkyl group, which may be substituted and/or unsaturated (e.g., methyl, isopropyl, t-butyl, cyclopentyl, t-pentyl, cyclohexyl, 2-ethylhexyl, 1,1,3,3-tetramethylbutyl, dodecyl, hexadecyl, ally, 3-cyclohexenyl, oleyl, benzyl, trifluoromethyl, hydroxymethylmethoxyethyl, ethoxycarbonylmethyl, and phenoxyethyl).

When any of the substituents in formula (Y) is an aryl group or contains an aryl group, unless otherwise specified, the aryl group means a monocyclic or condensed cyclic aryl group, which may be substituted, containing (e.g., phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamidophenyl, and 3,4-dichlorophenyl).

When any of the substituents in formula (Y) is a heterocyclic group or contains a heterocyclic group, unless otherwise specified, the heterocyclic group means a 3- to 8-membered monocyclic or condensed ring heterocyclic group that contains at least one heteroatom selected from the group consisting of O, N, S, P, Se and Te, and contains from 2 to 36 carbon atoms and may be substituted (e.g., 2-furyl, 2-pyridyl, 4-pyridyl, 1-pyrazolyl, 1-imidazolyl, 1-benzotriazolyl, 2-benzotriazolyl, succinimido, phthalimido, and 1-benzyl-2,4-imidazolidinedion-3-yl).

Substituents preferably used in formula (Y) will now be described below.

In formula (Y), preferably $R_1$ represents a halogen atom, a cyano group, a monovalent aliphatic-type group that may be substituted and has a total number of carbon atoms (hereinafter abbreviated as a total C-number) of 1 to 30 (e.g., alkyl and alkoxy) or a monovalent aryltype group that may be substituted and has a total C-number of 6 to 30 (e.g., aryl and aryloxy), whose substituent includes, for example, a halogen atom, an alkyl group (straight, branched, or cyclic), an alkoxy group, a nitro group, an amino group, a carbonamido group, a sulfonamido group, and an acyl group, and $R_1$ may be a so-called ballasting group.

In formula (Y), Q preferably represents a group of non-metallic atoms which forms together with the C, a substituted or unsubstituted 3- to 5-membered hydrocarbon ring having a total C-number of 3 to 30, or a 3- to 5-membered substituted or unsubstituted, heterocyclic ring moiety having a total C-number of 2 to 30 and in the ring at least one heteroatom selected from a group consisting of N, S, O, and P. The ring formed by Q together with the C may have an unsubstituted bond in the ring. As examples of the ring formed by Q together with the C are a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring. Examples of substituent for the rings include a halogen atom, a hydroxyl group, an alkyl group, an aryl group, an acyl group, an alkoxy group, an aryloxy group, a cyano group, an alkoxycarbonyl group, an alkylthio group, and an arylthio group.

In formula (Y), $R_2$ preferably represents a halogen atom, an alkoxy group that may be substituted and has a total C-number of 1 to 30, an aryloxy group that may be substituted and has a total C-number of 6 to 30, an alkyl group that may be substituted and has a total C-number of 1 to 30, or an amino group that may be substituted and has a total C-number of 0 to 30, and the substituent is, for example, a halogen atom, an alkyl group, an alkoxy group, and an aryloxy group.

Examples of $R_3$ in formula (Y) include a halogen atom, an alkyl group (as defined above), an aryl group (as defined above), an alkoxy group, an aryloxy group, an alkoxycarbonyl group, an aryloxycarbonyl group, a carbonamido group, a sulfonamido group, a carbamoyl group, a sulfamoyl group, an alkylsulfonyl group, a arylsulfonyl group, a ureido group, a sulfamoylamino group, an alkoxycarbonylamino group, an alkoxysulfonyl group, a nitro group, a heterocyclic group (as defined above), a cyano group, an acyl group, an acyloxy group, an alkylsulfonyloxy group, and an arylsulfonyloxy group; and examples of the split-off group include a heterocyclic group (as defined above) bonded to the coupling active site through the nitrogen atom, an aryloxy group, an arylthio group, an acyloxy group, an alkylsulfonyloxy group, an arylsulfonyloxy group, a heterocyclic oxy group wherein heterocyclic is as defined above), and a halogen atom.

In formula (Y), $R_3$ preferably represents a halogen atom, an alkyl group that may be substituted and has a total C-number of 1 to 30, more preferably 1 to 18, an aryl group that may be substituted and has a total C-number of 6 to 30, more preferably 6 to 24, an alkoxy group that may be substituted and has a total C-number of 1 to 30, more preferably 1 to 18, an aryloxy group that may be substituted and has a total C-number of 6 to 30, more preferably 6 to 24, an alkoxycarbonyl group that may be substituted and has a total C-number of 2 to 30, more preferably 2 to 19, an aryloxycarbonyl group that may be substituted and has a total C-number of 7 to 30, more preferably 7 to 24, a carbonamido group that may be substituted and has a total C-number of 1 to 30, more preferably 1 to 20, a sulfonamido group that may be substituted and has a total C-number of 1 to 30, more preferably 1 to 24, a carbamoyl group that may be substituted and has having a total C-number of 1 to 30, more preferably 1 to 20, a sulfamoyl group that may be substituted and has a total C-number of 0 to 30, more preferably 0 to 24, an alkylsulfonyl group that may be substituted and has a total C-number of 1 to 30, more preferably 1 to 20, an arylsulfonyl group that may be substituted and has a total C-number of 6 to 30, more preferably 6 to 24, an ureido group that may be substituted and has a total C-number of 1 to 30, more preferably 1 to 20, a sulfamoylamino group that may be substituted and has a total C-number of 0 to 30, more preferably 0 to 20, an alkoxycarbonylamino group that may be substituted and has a total C-number of 2 to 30, more preferably 2 to 20, a heterocyclic group (as defined above) that may be substituted and has a total C-number of 1 to 30, more preferably 1 to 20, an acyl group that may be substituted and has a total C-number of 1 to 30, more preferably 1 to 20, an alkylsulfonyloxy group that may be substituted and has a total C-number of 1 to 30, more preferably 1 to 20, or an arylsulfonyloxy group that may be substituted and has a total C-number of 6 to 30, more preferably 6 to 24; and examples of substituent for these $R_3$ moieties include, for example, a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, and an arylsulfonyloxy group.

In formula (Y), l is preferably an integer of 1 or 2, and the position of the substitution of $R_3$ is preferably the meta-position or para-position relative to

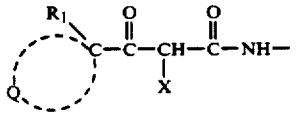

In formula (Y), X preferably represents a heterocyclic group bonded to the coupling active site through the nitrogen atom or an aryloxy group.

When X represents a heterocyclic group, X is preferably a 5- to 7-membered monocyclic group or condensed ring that may be substituted. Exemplary of such groups are succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione, imidazolidine-2-one, oxazolidine-2-one, thiazolidine-2-one, benzimidazolidine-2-one, benzoxazolidine-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone-2-pyrazone, 2-amino-1,3,4-thiazolidine, 2-imino-1,3,4-thiazolidine-4-one, and the like, any of which heterocyclic rings may be substituted. Examples of the substituent on the heterocyclic group include a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, a ureido group, an alkoxycarbonylamino group, and a sulfamoylamino group. When X represents an aryloxy group, preferably X represents an aryloxy group having a total C-number of 6 to 30, which may be substituted by a group selected from the group consisting of those substituents mentioned in the case wherein X represents a heterocyclic group. Most preferably, the substituent on the aryloxy group is a halogen atom, a cyano group, a nitro group, a carboxyl group, a trifluoromethyl group, an alkoxycarbonyl group, a carbonamido group, a sulfonamido group, a carbamoyl group, a sulfamoyl group, an alkylsulfonyl group, an arylsulfonyl group, or a cyano group.

Substituents which are particularly preferably used in formula (Y) will now be described.

$R_1$ is particularly preferably a halogen atom or an alkyl group having a total C-number of 1 to 5, most preferably a methyl group, ethyl group, and n-propyl group. Q particularly preferably represents a group of non-metallic atoms which form together with the C a 3- to 5-membered cyclic hydrocarbon group such as $[C(R)_2]_2$—, —$[C(R)_2]_3$—, and —$[C(R)_2]_4$— wherein R represents a hydrogen atom, a halogen atom, an alkyl group, R groups may be the same or different, and the $C(R)_2$ groups may be the same or different.

Most preferably Q represents —$[C(R)_2]_2$— which forms a 3-membered ring together with the C bonded thereto.

Particularly preferably $R_2$ represents a chlorine atom, a fluorine atom, a substituted or unsubstituted alkyl group having a total C-number of 1 to 6 (e.g., methyl, trifluoromethyl, ethyl, isopropyl, and t-butyl), an alkoxy group having a total C-number of 1 to 8 (e.g., methoxy, ethoxy, methoxyethoxy, and butoxy), or an aryloxy group having a total C-number of 6 to 24 (e.g., phenoxy, p-tolyloxy, and p-methoxyphenoxy); most preferably a chlorine atom, a methoxy group, or a trifluoromethyl group.

Particularly preferably $R_3$ represents a halogen atom, an alkoxy group, an alkoxycarbonyl group, an aryloxycarbonyl group, a carbonamido group, a sulfonamido group, a carbamoyl group, or a sulfamoyl group, most preferably an alkoxy group, an alkoxycarbonyl group, a carbonamido group, or a sulfonamido group.

Particularly preferably X is a group represented by the following formula (Y-1), (Y-2), or (Y-3):

Formula (Y-1)

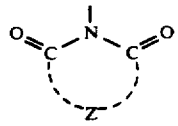

In formula (Y-1), Z represents —O—$CR_4(R_5)$—, —S—$CR_4(R_5)$—, —$NR_6$—$CR_4(R_5)$—, —$NR_6$—$NR_7$—, —$NR_6$—C(O)—, $CR_4(R_5)$—$CR_8(R_9)$— or —$CR_{10}$=$CR_{11}$; —, wherein $R_4$, $R_5$, $R_8$, and $R_9$, same or different, each represent a hydrogen atom, an alkyl group (as defined above), an aryl group (as defined above), an alkoxy group having a total C-number of 1 to 24, an aryloxy group having a total C-number of 6 to 24, an alkylthio group having a total C-number of 1 to 24, an arylthio group having a total C-number of 6 to 24, an alkylsulfonyl group having a total C-number of 1 to 24, an arylsulfonyl group having a total C-number of 6 to 24, or an amino group, any of which may be substituted (except hydrogen); $R_6$ and $R_7$ each represent a hydrogen atom, an alkyl group (as defined above), an aryl group (as defined above), an alkylsulfonyl group having a total C-number of 1 to 24, an arylsulfonyl group having a total C-number of 6 to 24, or an alkoxycarbonyl group having a total C-number of 1 to 24, $R_{10}$ and $R_{11}$ each represent a hydrogen atom, an alkyl group (as defined above), or an aryl group (as defined above), or $R_{10}$ and $R_{11}$ may bond together to form a benzene ring, and $R_4$ and $R_5$, $R_5$ and $R_6$, $R_6$ and $R_7$, or $R_4$ and $R_8$ may bond together to form a 3- to 8-membered heterocyclic or hydrocarbon ring (e.g., cyclobutane, cyclohexane, cycloheptane, cyclohexene, pyrrolidine, and piperidine), any of which groups may be bound.

Among the heterocyclic groups represented by formula (Y-1), particularly preferable ones are heterocyclic groups represented by formula (Y-1) wherein Z represents —O—$CR_4(R_5)$—, —$NR_6$—$CR_4(R_5)$—, or —$NR_6$—$NR_7$—. The total C-number of the heterocyclic group represented by formula [Y-1] is 2 to 30, preferably 4 to 20, and more preferably 5 to 16.

Formula (Y-2)

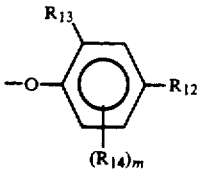

In formula (Y-2), at least one of $R_{12}$ and $R_{13}$ represents a group selected from the group consisting of a halogen atom, a cyano group, a nitro group, a trifluoromethyl group, a carboxyl group, an alkoxycarbonyl group having a total C-number of 2 to 24, a carbonamido group having a total C-number of 1 to 24, a sulfonamido group having a total C-number of 1 to 24, a carbamoyl group having a total C-number of 1 to 24, a sulfamoyl group having a total C-number of 0 to 24, an alkylsulfonyl group having a total C-number of 1 to 24, an arylsulfonyl group having a total C-number of 6 to 24, and an acyl group having a total C-number of 1 to 24 and the other is a hydrogen atom, an alkyl group (as defined above), or an alkoxy group having a total C-number of 1 to 24; $R_{14}$ have the same meaning as that of $R_{12}$ or $R_{13}$, and m is an integer of 0 to 2. The total C-number of the aryloxy group represented by formula (Y-2) is 6 to 30, preferably 6 to 24, and more preferably 6 to 15.

Formula (Y-3)

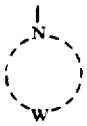

In formula (Y-3), W represents a group of a non-metallic atoms required to form together with the N a pyrrole ring, a pyrazole ring, an imidazole ring, or a triazole ring. Herein, the ring represented by formula (Y-3) may be substituted and a preferable example of the substituent is a halogen atom, a nitro group, a cyano group, an alkoxycarbonyl group, an alkyl group, an aryl group, an amino group, an alkoxy group, an aryloxy group, or a carbamoyl group. The total C-number of the heterocyclic group represented by formula (Y-3) is 2 to 30, preferably 2 to 24, and more preferably 2 to 16.

Most preferably X is a group represented by formula (Y-1).

The coupler represented by formula (Y) may form a dimer or higher polymer formed by bonding through a divalent group or higher polyvalent group at the substituent $R_1$, Q, X, or

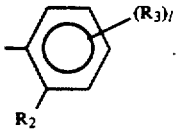

In this case, the total C-number may exceed the range of the total C-number specified in each of the above substituents.

Specific examples of each of the substituents in formula (Y) are shown below.

(1) Examples of the

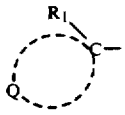

group formed by $R_1$ and Q with C are shown below.

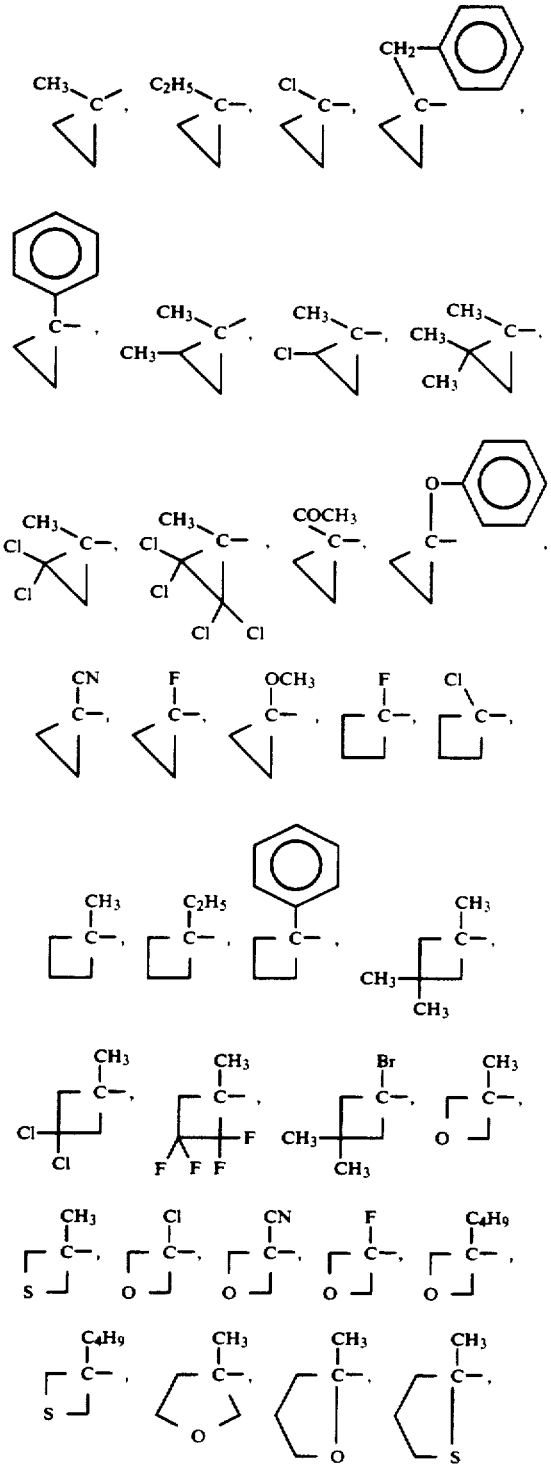

-continued

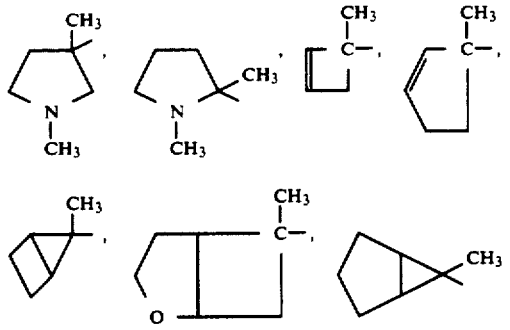

(2) Examples of $R_2$

F, Cl, Br, I, $CH_3O$—, 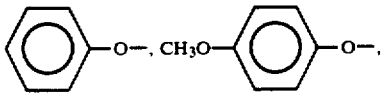

$CH_3$—, $C_2H_5$—, i-$C_3H_7$—, t-$C_4H_9$—, $CH_3OCH_2CH_2O$—, $CF_3$—, $(CH_3)_2N$—, 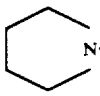 n-$C_4H_9O$—, n-$C_{14}H_{29}O$—, n-$C_{16}H_{33}O$—, 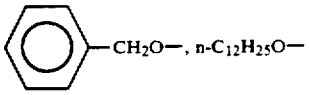

(3) Examples of $R_3$

F, Cl, Br, I, $CH_3O$—, $C_2H_5O$—, n-$C_{12}H_{25}O$—, $CH_3$, t-$C_4H_9$—,

—$COOCH_3$, $COOC_2H_5$, —$COOC_4H_9$-$^n$, —$COOC_{12}H_{25}$-$^n$,

—$OCH_2CH(C_6H_{13}$-$^n)C_8H_{17}$-$^n$ —$COOCH(CH_3)COOC_{12}H_{25}$-$^n$,

—$COOCH(C_4H_9$-$^n)COOC_{12}H_{29}$-$^n$, —COO— 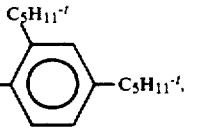

—$CONH(CH_2)_3O$— 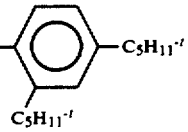

—$SO_2NH(CH_2)_4O$— 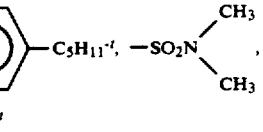

—$SO_2NHCOC_2H_5$, —$SO_2NHC_{16}H_{33}$-$^n$, —$NHCOC_{13}H_{27}$-$^n$,

—$NHCOC_{15}H_{31}$-$^n$, —$NHCOC_{17}H_{35}$-$^n$ —$NHCOCH(C_6H_{13}$-$^n)$—$C_8H_{17}$-$^n$,

-continued

—$NHCOCH(CHCH_2C_4H_9$-$^t)$—$CH_2CH_2CH(CH_3)CH_2C_4H_9$-$^t$

—$NHCOCH(CH_3)CH_2SO_2C_{16}H_{33}$-$^n$

—$NHCO(CH_2)_3O$— 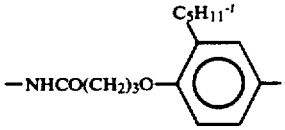

—$NHCOCHO$— 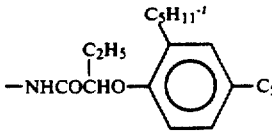 , —$NHCOCHSO_2C_{16}H_{33}$-$^n$,

—$NHSO_2C_{12}H_{25}$-$^n$, —$NHSO_2C_{16}H_{13}$-$^n$,

—$NHSO_2$— 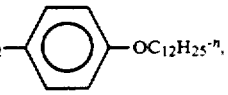

—$NHSO_2$— 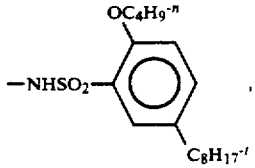 , —$SO_2NHCH_3$,

—$SO_2NH$— 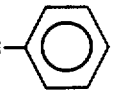 , —$OCOC_{11}H_{23}$-$^n$,

—$OSO_2C_{12}H_{25}$-$^n$, —$NHCOOC_{12}H_{25}$-$^n$, (4) Examples of X

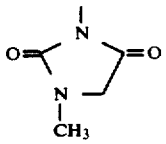

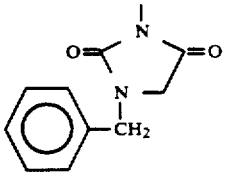

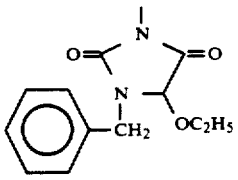

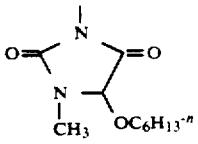

-continued
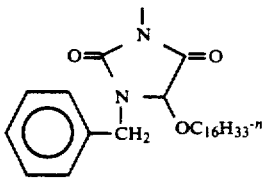
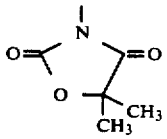
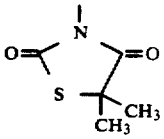
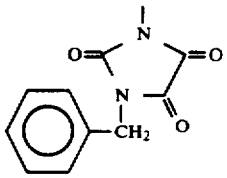
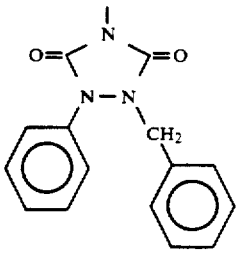
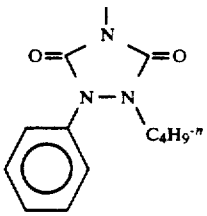
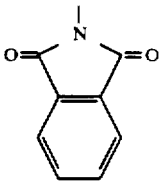
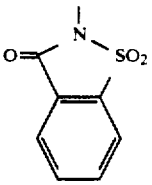
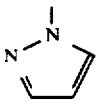
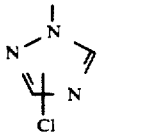
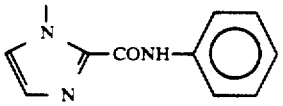
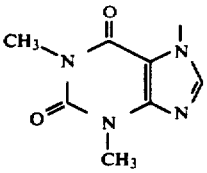
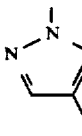
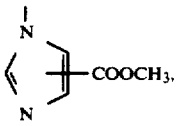
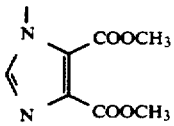
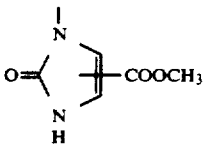
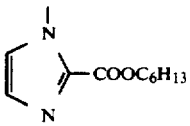
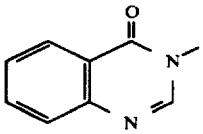
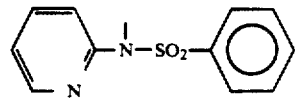
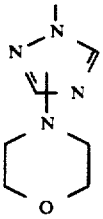
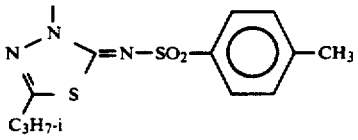
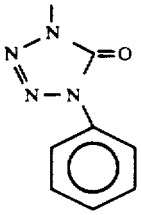
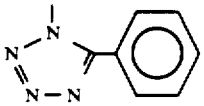
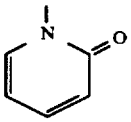
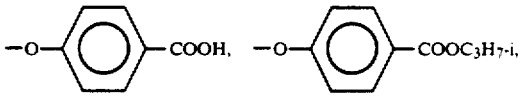
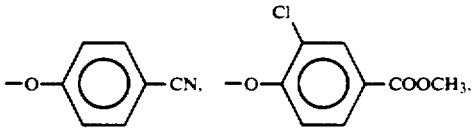
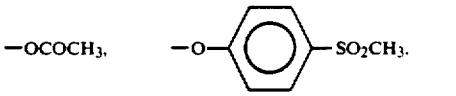
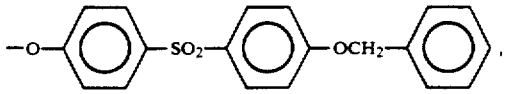
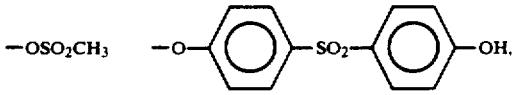
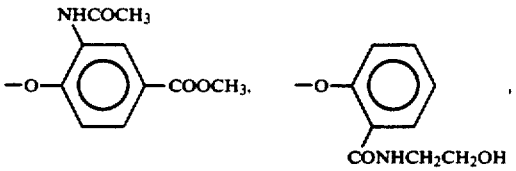
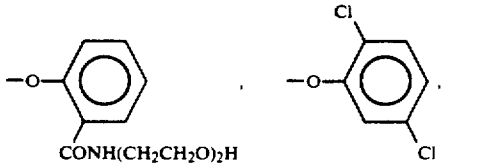

-continued
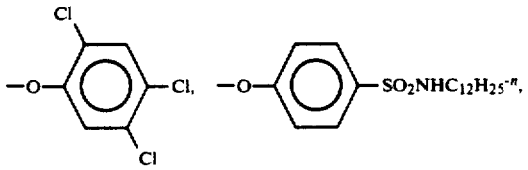
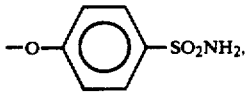
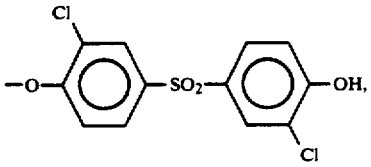
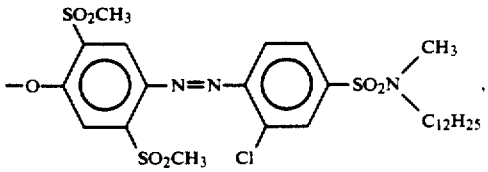
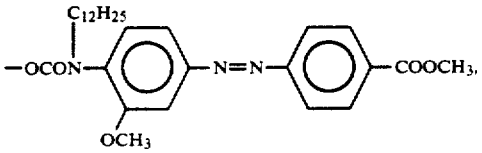
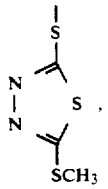
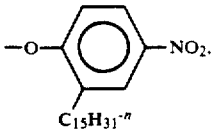
-continued
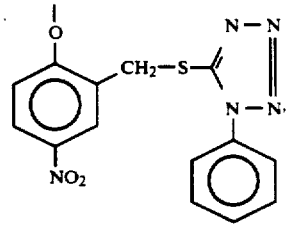
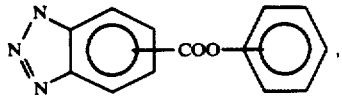
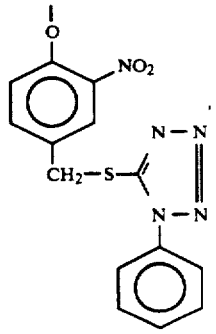
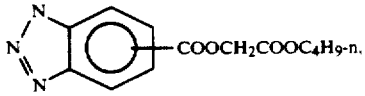
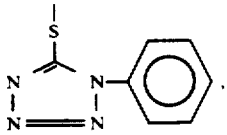
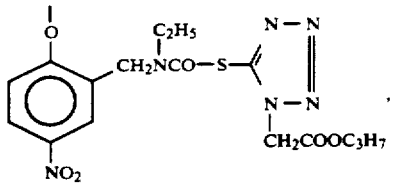
Exemplified yellow couplers represented by (Y) are shown below.
Y-1
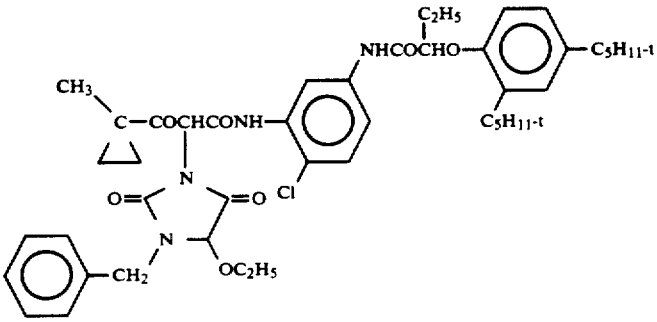

-continued
Y-2
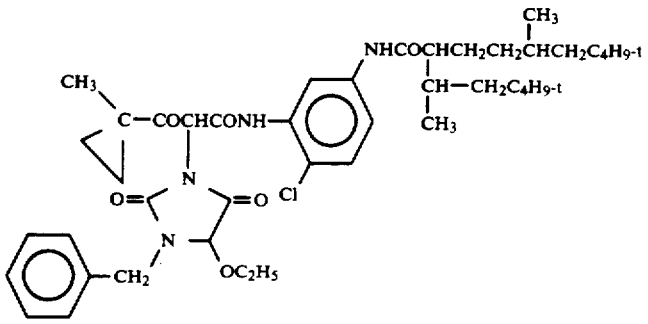
Y-3
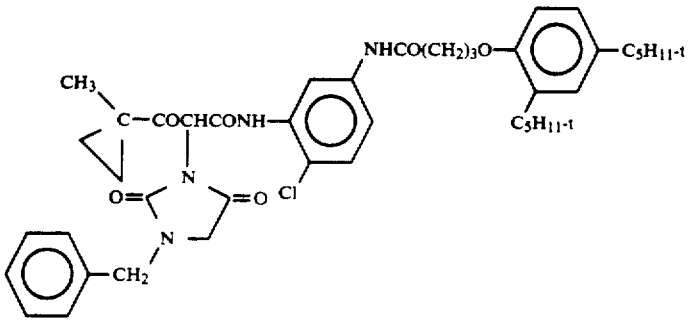
Y-4
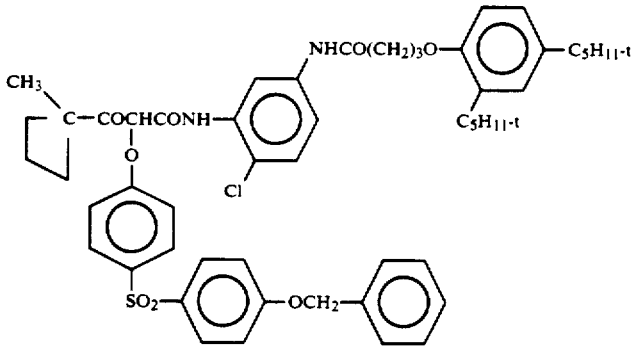
Y-5
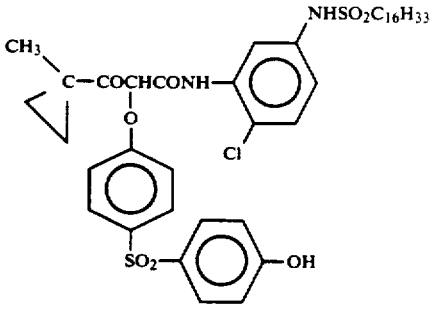
Y-6
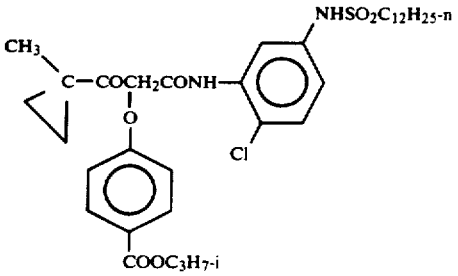

-continued
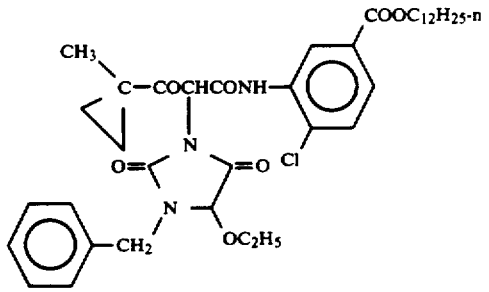
Y-7
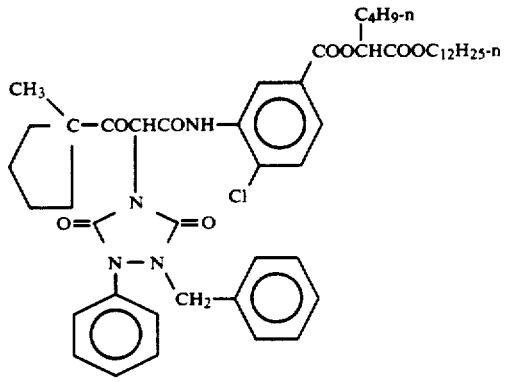
Y-8
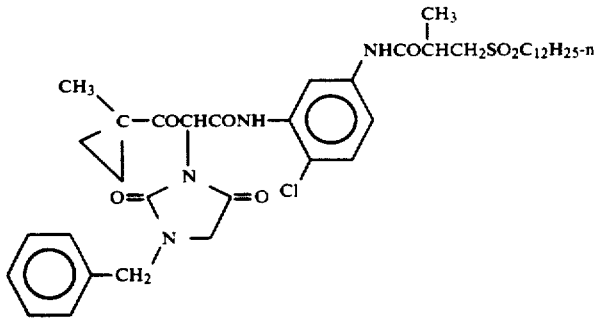
Y-9
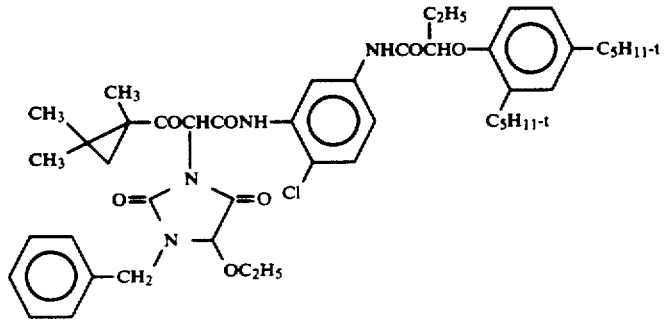
Y-10

-continued
Y-11
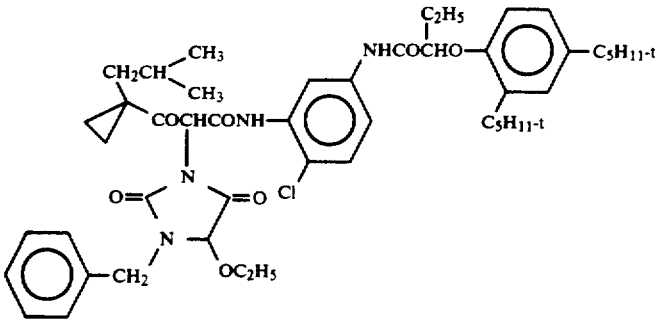
Y-12
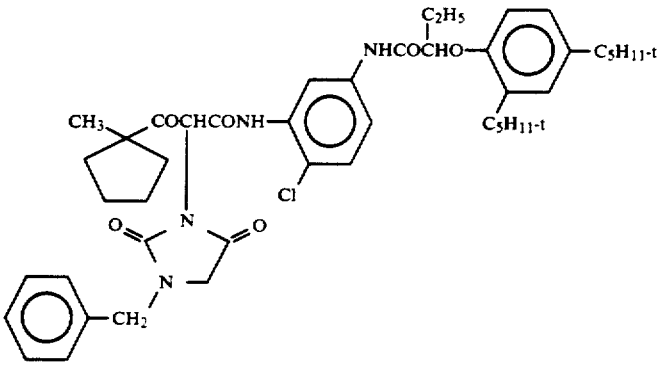
Y-13
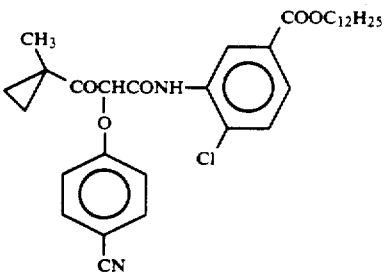
Y-14
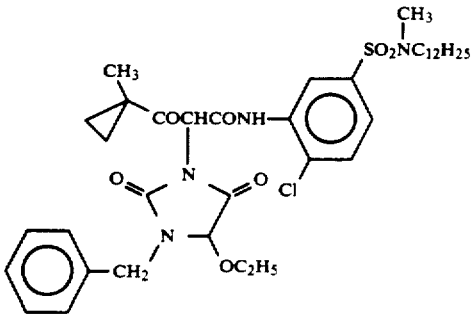

-continued
Y-15
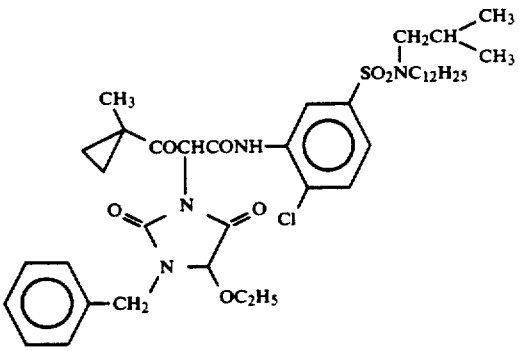
Y-16
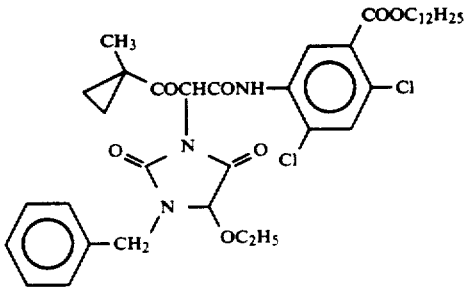
Y-17
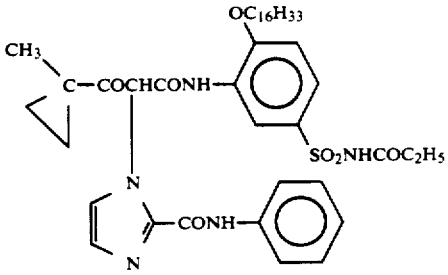
Y-18
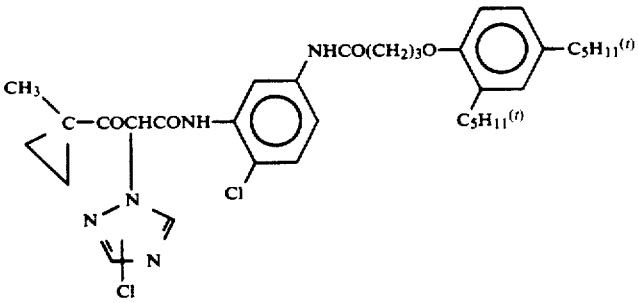
Y-19
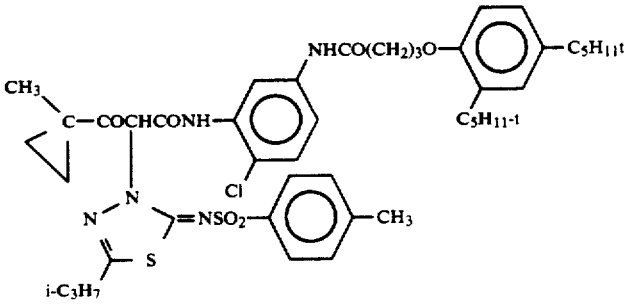

-continued
Y-20
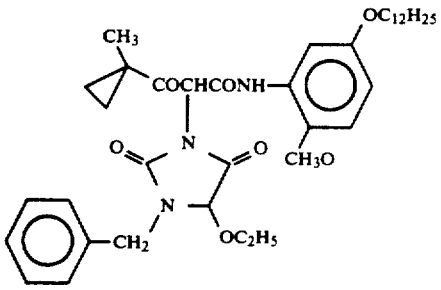
Y-21
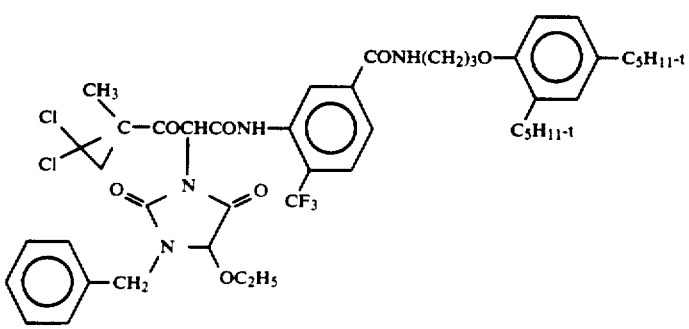
Y-22
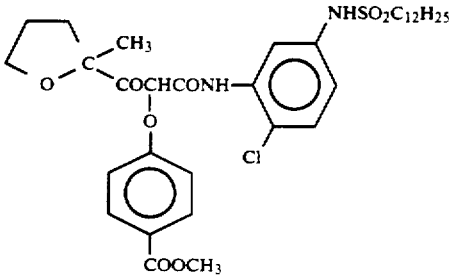
Y-23
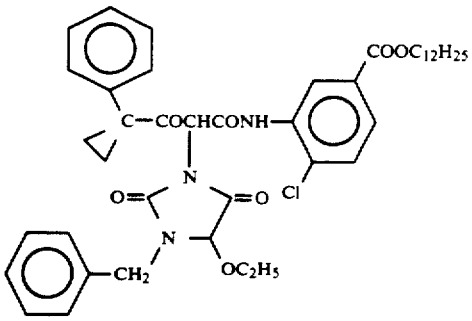
Y-24
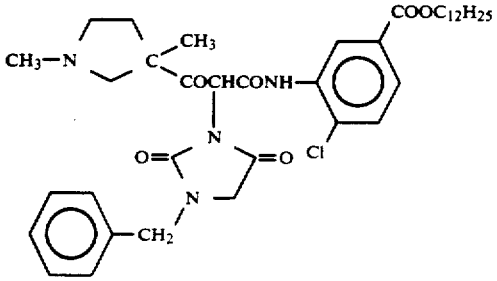

-continued
Y-25
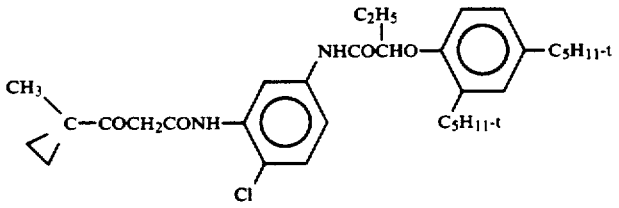
Y-26
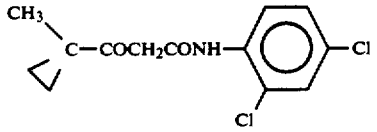
Y-27
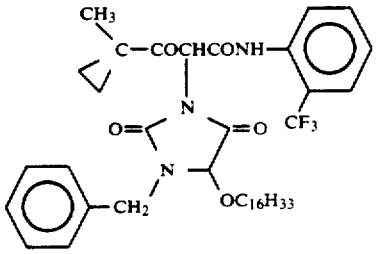
Y-28
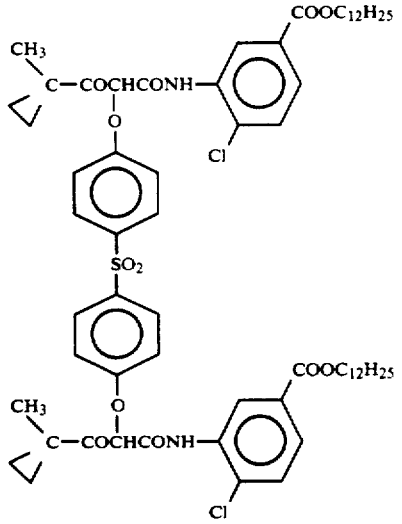
Y-29
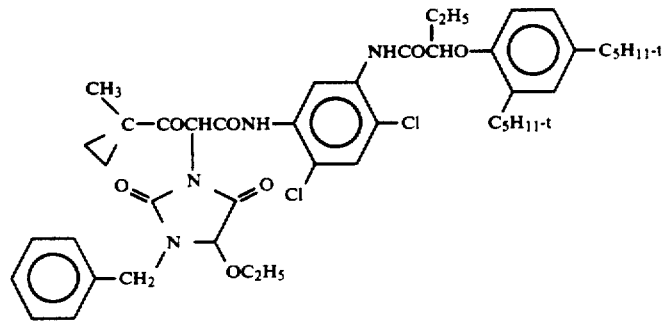

-continued
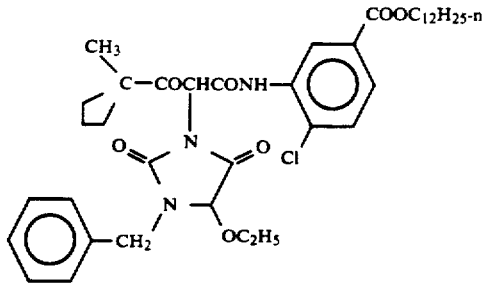
Y-30
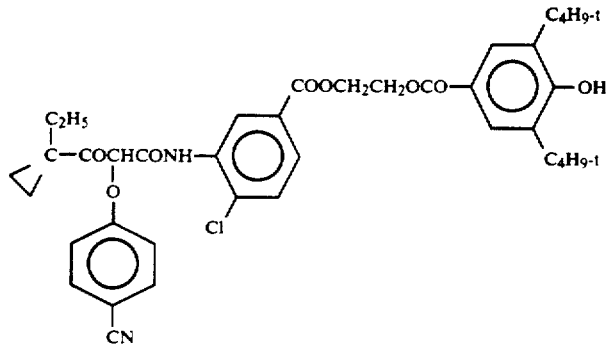
Y-31
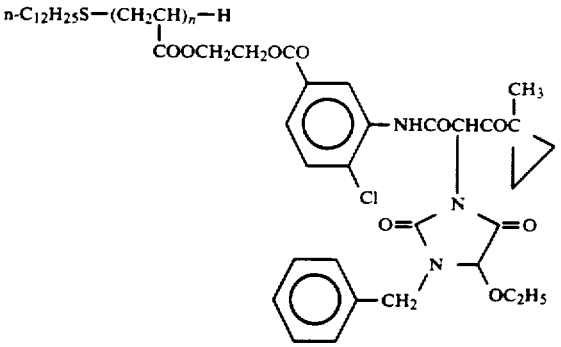
n = 3 (Average)
Y-32
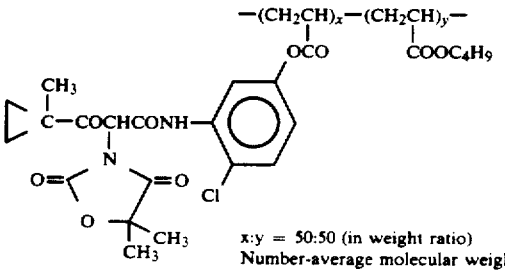
x:y = 50:50 (in weight ratio)
Number-average molecular weight: 50,000
Y-33

-continued
Y-34
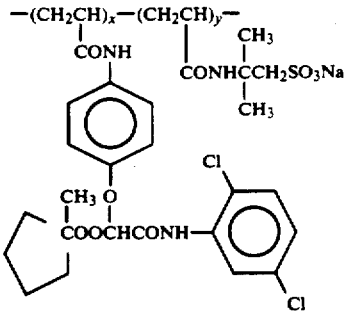
x:y = 80:20 (in weight ratio)
Number-average molecular weight: 70,000
Y-35
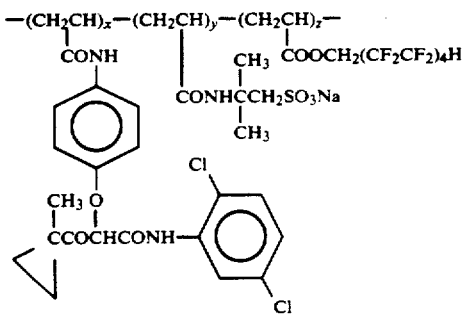
x:y:z = 50:30:20 (in weight ratio)
Number-average molecular weight: 70,000
Y-36
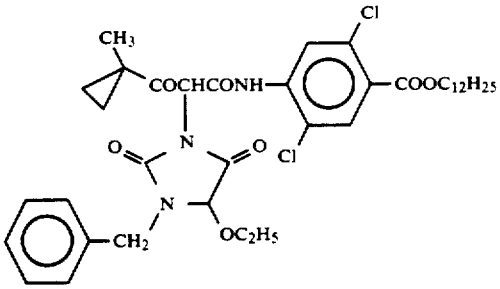
Y-37
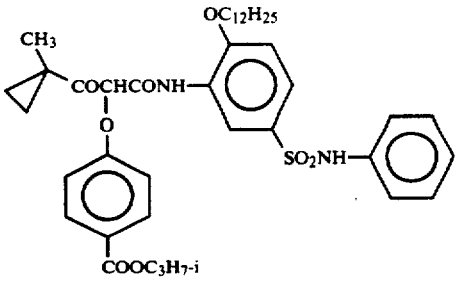
Y-38
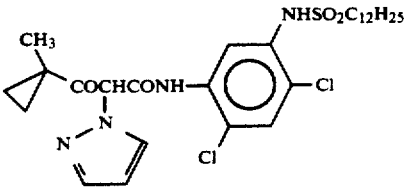

-continued

Y-39

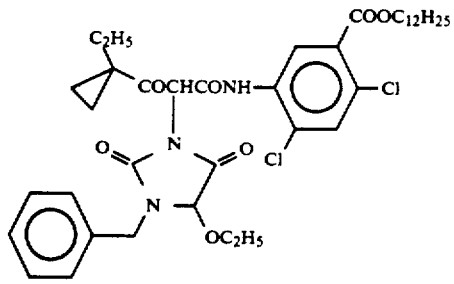

The yellow coupler represented by formula (Y) of the present invention can be synthesized by the following synthesis route:

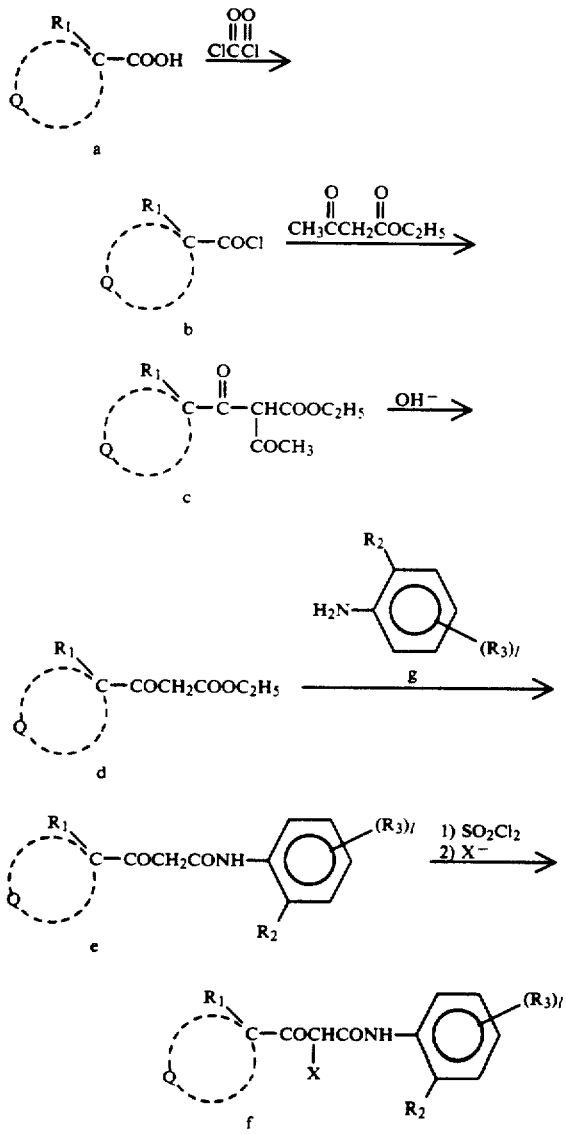

Compound a can be synthesized by a process described, for example, in J. Chem. Soc. (C), 1968, 2548; J. Am. Chem. Soc., 1934, 56, 2710; Synthesis, 1971, 258; J. Org. Chem., 1978, 43, 1729; or CA. 1960, 66, 18533y.

The synthesis of Compound b is carried out by a reaction using thionyl chloride, oxalyl chloride, etc., without a solvent or in a solvent such as methylene chloride, chloroform, carbon tetrachloride, dichloroethane, toluene, N,N-dimethylformamide, or N,N-dimethylacetamide. The reaction temperature is generally about −20° to 150° C., preferably about −10° to 80° C.

Compound c is synthesized by converting ethyl acetoacetate into an anion using magnesium methoxide or the like and adding b thereinto. The reaction is carried out without a solvent or in tetrahydrofuran, ethyl ether, or the like, and the reaction temperature is generally about −20° to 60° C., preferably about −10° to 30° C. Compound d is synthesized by a reaction using Compound c and, as a base, aqueous ammonia, an aqueous $NaHCO_3$ solution, an aqueous sodium hydroxide solution, or the like, without a solvent or in a solvent such as methanol, ethanol, and acetonitrile. The reaction temperature is about −20° to 50° C., preferably about −10° to 30° C.

Compound e is synthesized by reacting Compounds d and g without a solvent. The reaction temperature is generally about 100° to 150° C., preferably about 100° to 120° C. When X is not H, after chlorination or bromination the split-off group X is introduced to synthesize Compound f. Compound e is converted, in a solvent such as dichloroethane, carbon tetrachloride, chloroform, methylene chloride, or tetrahydrofuran, to the chlorinesubstituted product by using sulfuryl chloride, N-chlorosuccinimide, or the like, or to the brominesubstituted product by using bromine, N-bromosuccinimide, or the like. At that time the reaction temperature is about −20° to 70° C., preferably about −10° to 50° C.

Then the chlorine-substituted product or the bromine-substituted product and the proton adduct H-X of the split-off group are reacted in a solvent, such as methylene chloride, chloroform, tetrahydrofuran, acetone, acetonitrile, dioxane, N-methylpyrrolidone, N,N'-dimethyl-imidazolidine-2-one, N,N-dimethylformamide, or N,N-dimethylacetamide at a reaction temperature of about −20° to 150° C., preferably about −10° to 100° C., so that Coupler f of the present invention can be obtained. At that time a base can be used, such as triethylamine, N-ethylmorpholine, tetramethylguanidine, potassium carbonate, sodium hydroxide, or sodium bicarbonate.

Synthesis Examples of couplers of the present invention are shown below.

SYNTHESIS EXAMPLE 1

Synthesis of Exemplified Compound Y-25

38.1 g of oxalyl chloride was added dropwise over 30 min to a mixture 25 g of 1-methylcyclopropanecarboxylic acid, which was synthesized by the method described by Gotkis, D., et.al., J. Am. Chem. Soc., 1934, 56, 2710, 100 ml of methylene chloride, and 1 ml of N,N-dimethylformamide. After the addition the reaction was carried out for 2 hours at room temperature, and then the methylene chloride and excess oxalyl chloride were removed under reduced pressure by an aspirator, thereby producing an oil of 1-methylcyclopropanecarbonyl chloride.

100 ml of methanol was added dropwise over 30 min at room temperature to a mixture of 6 g of magnesium and 2 ml of carbon tetrachloride, after which the mixture was heated for 2 hours under reflux, and then 32.6 g of ethyl 3-oxobutanate was added dropwise over 30 min under heating and reflux. After the addition the mixture was heated under reflux for 2 hours, and then the methanol was distilled off completely under reduced pressure by an aspirator. 100 ml of tetrahydrofuran wa added to and dispersed in the resultant solution, and the previously prepared 1-methylcyclopropanecarbonyl chloride was added dropwise to the dispersion at room temperature. After reacting for 30 min, the reaction liquid was subjected to extraction with 300 ml of ethyl acetate and diluted sulfuric acid, the organic layer was washed with water and dried over anhydrous sodium sulfate, and then the solvent was distilled off, to produce 55.3 g of an oil of ethyl 2-(1-methylcyclopropanecarbonyl)-3-oxobutanate.

A solution of 55 g of the ethyl 2-(1-methylcyclopropanecarbonyl)-3-oxobutanate and 160 ml of ethanol was stirred at room temperature, and 60 ml of a 30% aqueous ammonia was added thereto over 10 min. Thereafter the resulting mixture was stirred for 1 hour and then was subjected to extraction with 300 ml of ethyl acetate and diluted hydrochloric acid, followed by neutralizing and washing with water; then the organic layer was dried over anhydrous sodium sulfate and the solvent was distilled off, to produce 43 g of an oil of ethyl (1-methylcyclopropanecarbonyl)acetate.

34 g of the ethyl (1-methylcyclopropanecarbonyl-)acetate and 44.5 g of N-(3-amino-4-chlorophenyl)-2-(2,4-di-t-pentylphenoxy)butaneamide were heated at an internal temperature of 100° to 120° C. under reflux and reduced pressure by an aspirator. After reacting for 4 hours, the reaction solution was purified by column chromatography with a mixed solvent of n-hexane and ethyl acetate, to produce a viscous oil of 49 g of the Exemplified Compound Y-25. The structure of the compound was identified by MS spectrum, NMR spectrum, and elemental analysis.

SYNTHESIS EXAMPLE 2

Synthesis of Exemplified Compound Y-1

22.8 g of the Exemplified Compound Y-25 was dissolved in 300 ml of methylene chloride, and 5.4 g of sulfuryl chloride was added dropwise over 10 min to the resulting solution under cooling with ice. After reacting for 30 min, the reaction liquid was washed well with water and was dried over anhydrous sodium sulfate, followed by concentration, to obtain the chloride of the Exemplified Compound Y-25. A solution of the thus synthesized chloride of the Exemplified Compound Y-25 in 50 ml of N,N-dimethylformaldehyde was added dropwise over 30 min at room temperature to a solution of 18.7 g of 1-benzyl-5-ethoxyhydantoin, 11.2 ml of triethylamine, and 50 ml of N,N-dimethylformamide.

Thereafter the reaction was allowed to continue for four hours at 40° C., and then the reaction liquid was subjected to extraction with 300 ml of ethyl acetate, thereafter washed with water and then washed with 300 ml of a 2% aqueous triethylamine solution. This was followed by neutralization with diluted hydrochloric acid. After the organic layer was dried over anhydrous sodium sulfate, the solvent was distilled off, and the thus obtained oil was crystallized from a mixed solvent of n-hexane and ethyl acetate. After the thus obtained crystals were filtered off, followed by washing with a mixed solvent of n-hexane and ethyl acetate, they were dried, to obtain 22.8 g of crystals of the Exemplified Compound Y-1. The structure of the compound was identified by MS spectrum, NMR spectrum, and elemental analysis. The melting point was 132° to 133° C.

Now the compound represented by formula (II) will be described in detail.

$R^1$ represents $-CONR^4R^5$, $-SO_2NR^4R^5$, $-NHCOR^4$, $NHCOOR^6$, $-NHSO_2R^6$, $-NHCONR^4R^5$, or $-NHSO_2NR^4R^5$ wherein $R^4$, $R^5$, and $R^6$ each represent independently an alkyl group having a total C-number of 1 to 30, an aryl group having a total C-number of 6 to 30, or a heterocyclic ring having a total C-number of 2 to 30, and $R^4$ and $R^5$ each may be a hydrogen atom.

$R^2$ represents a group (including an atom, the same being applied hereinafter) substitutable on a naphthalene ring and typical examples of $R^2$ include a halogen atom, (F, Cl, Br, and I), a hydroxyl group, a carbonyl group, an amino group, a sulfo group, a cyano group, an alkyl group, an aryl group, a heterocyclic group, a carbonamido group, a sulfonamido group, a carbamoyl group, a sulfamoyl group, a ureido group, an acyl group, an acyloxy group, an alkoxy group, an aryloxy group, an alkylthio group, an arylthio group, an alkylsulfonyl group, an arylsulfonyl group, a sulfamoylamino group, an alkoxycarbonylamino group, a nitro group, and an imido group. If k=2, examples are a dioxymethylene group and a trimethylene group. The total C-number of $(R^2)k$ is 0 to 30.

$R^3$ stands for a substituent, preferably represented by the following formula (II-1):

Formula (II-1)

$R^7(Y)_n-$ wherein Y represents >NH, >CO, or $>SO_2$, n is an integer of 0 or 1, $R^7$ represents a hydrogen atom, an alkyl group having a total C-number of 1 to 30, an aryl group having a total C-number of 6 to 30, a heterocyclic group having a total C-number of 2 to 30, $-COR^8$,

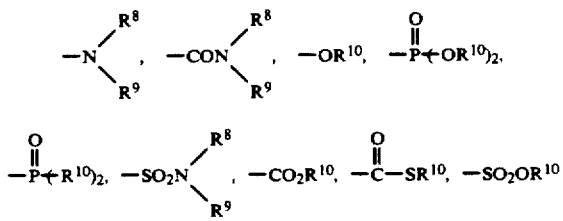

or $-SO_2R^{10}$, wherein $R^8$, $R^9$, $R^{10}$ have the same meanings as those of $R^4$, $R^5$, and $R^6$ defined above respectively.

In $R^1$ or $R^7$, $R^4$ and $R^5$ of $-NR^4R^5$ and $R^8$ and $R^9$ of $-NR^8R^9$ may bond together to form a nitrogen-containing heterocyclic ring (e.g., a pyrrolidine ring, a piperidine ring, and a morpholine ring).

$X^1$ represents a hydrogen atom or a split-off group and, as typical examples of the split-off group, a halogen atom, $-OR^{11}$, $-SR^{11}$, $-OC(=O)R^{11}$, $-NHCOR^{11}$, $-NHC(=O)SR^{11}$, $-OC(=O)OR^{11}$, $-OC(=O)NHR^{11}$, a thiocyanato group, and a heterocyclic group having a total C-number of 1 to 30 and bonded to the coupling active site through the nitrogen atom (e.g., a succinimido group, a phthalimido group, a pyrazolyl group, a hydantoinyl group, and a 2-benzotriazolyl group) can be mentioned. Herein, $R^{11}$ has the same meaning as that of $R^6$ mentioned above.

In the above, the alkyl group may be linear, branched, or cyclic, may be unsaturated, and may be substituted (for example, by a halogen atom, a hydroxyl group, an aryl group, a heterocyclic group, an alkoxy group, an aryloxy group, an alkylsulfonyl group, an arylsulfonyl group, an alkoxycarbonyl group, an acyloxy group, and an acyl group) and typical examples are methyl, ethyl, isopropyl, isobutyl, t-butyl, 2-ethylhexyl, cyclohexyl, n-dodecyl, n-hexadecyl, 2-methoxyethyl, benzyl, trifluoromethyl, 3-dodecyloxypropyl, or 3-(2,4-di-t-pentylphenoxy)propyl.

The aryl group may be a condensed ring (e.g., a naphthyl group) and may be substituted (for example, by a halogen atom, an alkyl group, an aryl group, an alkoxy group, an aryloxy group, a cyano group, an acyl group, an alkoxycarbonyl group, a carbonamido group, a sulfonamido group, a carbamoyl group, a sulfamoyl group, an alkylsulfonyl group, or an arylsulfonyl group) and typical examples are phenyl, tolyl, pentafluorophenyl, 2-chlorophenyl, 4-hydroxyphenyl, 4-cyanophenyl, 2-tetradecyloxyphenyl, 2-chloro-5-dodecyloxyphenyl, and 4-t-butylphenyl.

The heterocyclic group is a 3- to 8-membered monocyclic or condensed cyclic heterocyclic group having at least one heterocyclic atom of O, N, S, P, Se, and Te and may be substituted (for example, by a halogen atom, a carboxyl group, a hydroxyl group, a nitro group, an alkyl group, an aryl group, an alkoxy group, an aryloxy group, an alkoxycarbonyl group, an aryloxycarbonyl group, an amino group, a carbamoyl group, a sulfamoyl group, an alkylsulfonyl group, or an arylsulfonyl group), and typical examples are 2-pyridyl, 4-pyridyl, 2-furyl, 4-thienyl, benzotriazole-1-yl, 5-phenyltetrazole-1-yl, 5-methylthio-1,3,4-thiadiazole-2-yl, and 5-methyl-1,3,4-oxadiazole-2-yl.

Preferable examples of the substituents in formula (II) of the present invention will now be described.

$R^1$ is preferably $-CONR^4R^5$ or $-SO_2NR^4R^5$ and specific examples are carbamoyl, N-n-butylcarbamoyl, N-n-dodecylcarbamoyl, N-(3-n-dodecyloxypropyl)carbamoyl, N-cyclohexylcarbamoyl, N-[3-(2,4-di-t-pentylphenoxy)propyl]carbamoyl, N-hexadecylcarbamoyl, N-[4-(2,4-di-t-pentylphenoxy)butyl]carbamoyl, N-(3-dodecyloxy-2-methylpropylcarbamoyl, N-[3-(4-t-octylphenoxy)propyl]carbamoyl, N-hexadecyl-N-methylcarbamoyl, N-(3-dodecyloxypropyl)sulfamoyl, and N-[4-(2,4-di-t-pentylphenoxy)butyl]sulfamoyl. Particularly preferably $R^1$ is $-CONR^4R^5$.

$R^2$ is most preferably an unsubstituted one, that is, $k=0$ is most preferable and $k=1$ is preferable. Preferably $R^2$ is a halogen atom, an alkyl group (e.g., methyl, isopropyl, t-butyl, and cyclopentyl), a carbonamido group (e.g., acetamido, pivalinamido, trifluoroacetamido, and benzamido), a sulfonamido group (e.g., methanesulfon- amido and toluenesulfonamido) or a cyano group.

$R^3$ preferably is one wherein in formula (II-1) $n=0$, more preferably when $R^7$ is $-COR^8$ [e.g., formyl, acetyl, trifluoroacetyl, 2-ethylhexanoyl, pivaloyl, benzoyl, pentafluorobenzoyl, and 4-(2,4-di-t-pentylphenoxy)butanoyl], $-COOR^{10}$ [e.g., methoxycarbonyl, ethoxycarbonyl, isobutoxy- carbonyl, 2-ethylhexyloxycarbonyl, n-dodecyloxycarbonyl, and 2-methoxyethoxycarbonyl], or $-SO_2R^{10}$ [e.g., methylsulfonyl, n-butylsulfonyl, n-hexadecylsulfonyl, phenylsulfonyl, p-tolylsulfonyl, p-chlorophenylsulfonyl, and trifluoromethylsulfonyl], and particularly preferably when $R^7$ is $-COOR^{10}$.

Preferably $X^1$ is a hydrogen atom, a halogen atom, $-OR^{11}$[e.g., an alkoxy group such as ethoxy, 2-hydroxyethoxy, 2-methoxyethoxy, 2-(2-hydroxyethoxy)ethoxy, 2-methylsulfonylethoxy, ethoxycarbonylmethoxy, carboxymethoxy, 3-carboxypropoxy, N-(2-methoxyethyl)carbamoylmethoxy, 1-caroxytridecyloxy, 2-methanesulfonamidoethoxy, 2-(carboxymethylthio)ethoxy, and 2-(1-carboxytridecylthio)ethoxy, and an aryloxy group such as 4-cyanophenoxy, 4-carboxyphenoxy, 4-methoxyphenoxy, 4-t-octylphenoxy, 4-nitrophenoxy, 4-(3-carboxypropaneamido)phenoxy, and 4-acetamidophenoxy], or $-SR^{11}$[e.g., an alkylthio group such as carboxymethylthio, 2-carboxymethylthio, 2-methoxyethylthio, ethoxycarbonylmethylthio, 2,3-dihydroxypropylthio, and 2-(N,N-dimethylamino)ethylthio and an arylthio group such as 4-carboxyphenylthio, 4-methoxyphenylthio, and 4-(3-carboxypropaneamido)phenylthio, particularly preferably a hydrogen atom, a chlorine atom, an alkoxy group, or an alkylthio group.

The coupler represented by formula (II) may form a dimer or higher polymer by bonding at the substituent $R^1$, $R^2$, $R^3$, or $X^1$ through a divalent group or higher polyvalent group. In that case, the total C-number may fall outside the total C-number defined for each substituent.

When the coupler represented by formula (II) forms a polymer, typical examples of the polymer are homopolymers and copolymers of addition polymerizable ethylenically unsaturated compounds that have a cyan dye forming coupler residue (cyan-forming monomers), which are preferably represented by formula (II-2):

Formula (II-2)

$$-(G_i)_{gi}-(H_j)_{hj}-$$

wherein $G_i$ represents a repeating unit which is derived from a color forming monomer and is a group represented by formula (II-3), $H_j$ is a repeating unit which is derived from a non-color forming monomer and is represented by formula (II-3), i is a positive integer, j is 0 or a positive integer, and gi and hi each represent percent by weight of $G_i$ and $H_i$ respectively, and when i or j is 2 or over, it means that two or more $G_i$s or $H_j$s are present.

Formula (II-3)

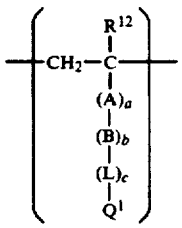

In formula (II-3), $R^{12}$ represents a hydrogen atom, an alkyl group having 1 to 4 carbon atoms, or a chlorine atom, A represents —CONH—, —COO—, or a substituted unsubstistituted phenylene group, B represents a divalent group having a carbon atom at each end such as an unsubstituted alkylene group, phenylene group, and oxydialkylene group, L represents —CONH—, —NHCONH—, —NHCOO—, —NHCO—, —OCONH—, —NH—, —COO—, —OCO—, —CO—, —O—, $—SO_2—$, $NHSO_2—$, or $—SO_2NH—$, a, b, and c each are an integer of 0 or 1, and Q represents a cyan coupler residue formed by removing a hydrogen atom from $R^1$, $R^2$, $R^3$, or $X^1$ of the compound represented by formula (II).

The non-color forming ethylenically-unsaturated monomer that gives the repeating unit $H_j$ and does not couple with the oxidation product of an aromatic primary amine developing agent includes, for example, acrylic acid, α-chloroacrylic acid, an α-alkylacrylic acid, an amide or an ester derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxyethyl methacrylate), a vinyl ester (e.g., vinyl acetate, vinyl propionate, and vinyl laurate), acrylonitrile, methacrylonitrile, an aromatic vinyl compound (e.g., styrene and its derivatives such as vinyltoluene, divinylbenzene, vinylacetophenone, and sulfostyrene), itaconic acid, citraconic acid, crotonic acid, vinylidene chloride, a vinyl alkyl ether (e.g., vinyl ethyl ether), a maleate, N-vinyl-2-pyrrolidone, N-vinylpyridine, and 2- and 4-vinylpyridine.

Particularly, an acrylate, a methacrylate, and a maleate are preferred. These non-color forming ethylenically unsaturated monomers used herein may be used as a mixture of two or more. For example, a combination of methyl acrylate with butyl acrylate, a combination of butyl acrylate with styrene, a combination of butyl methacrylate with methacrylic acid, and a combination of methyl acrylate with diacetoneacrylamide can be used.

As is well known in the field of polymer couplers, the ethylenically unsaturated monomer to be copolymerized with the vinyl monomer corresponding to formula (II-3) given above can be selected so that, for example, the form of the copolymer to be formed, such as the solid state, the liquid state, or the micell state, or the physical properties and/or the chemical properties thereof, such as the solubility (solubility in water or an organic solvent), the compatibility with the binder of the photographic colloid composition, for example with the gelatin, its flexibility, its heat stability, the coupling reactivity with the oxidized product of a developing agent, and the ballasting properties in the photographic colloid, may be influenced favorably. The copolymer may be a random copolymer or a copolymer having a special sequence (e.g., a block copolymer or an alternating copolymer).

Although the number-average molecular weight of the cyan polymer coupler used in the present invention is generally on the order of from thousands to millions, a polymer coupler having a number-average molecular weight of 5000 or less in the form of an oligomer can also be employed.

The cyan polymer coupler used in the present invention may be a lipophilic polymer soluble in an organic solvent (e.g., ethyl acetate, butyl acetate, ethanol, methylene chloride, cyclohexanone, dibutyl phthalate, and tricresyl phosphate), a hydrophilic polymer miscible with a hydrophilic colloid such as an aqueous gelatin solution, or a polymer of such structure and properties that it can form micelles in a hydrophilic colloid.

If a lipophilic polymer coupler soluble in an organic solvent is to be obtained, generally it is preferable to select as a copolymer component a lipophilic non-color-forming ethylenically-unsaturated monomer (e.g., an acrylate, a methacrylate, a maleate, and vinylbenzene).

The lipophilic polymer coupler obtained by polymerization of a vinyl monomer that will give the coupler unit represented by formula (II-3) given above may be dissolved in an organic solvent, and the solution may be emulsified and dispersed into an aqueous gelatin solution to form a latex, or the lipophilic polymer coupler may be prepared directly by emulsion polymerization.

To emulsify and disperse the lipophilic polymer coupler into an aqueous gelatin solution to form a latex, the method described in U.S. Pat. No. 3,451,820 can be used, and with respect to the emulsion polymerization, the methods described in U.S. Pat. Nos. 4,080,211 and 3,370,952 can be used.

To obtain a hydrophilic polymer coupler soluble in neutral or alkaline water, a hydrophilic non-color forming ethylenically-unsaturated monomer such as N-(1,1-dimethyl-2- sulfonatoethyl) acrylamide, 3-sulfonatopropyl acrylate, sodium styrenesulfonate, potassium styrenesulfinate, acrylamide, methacrylamide, acrylic acid, methacrylic acid, N-vinylpyrrolidone, and N-vinylpyridine, is preferably used as a copolymer component.

The hydrophilic polymer coupler can be added, in the form of an aqueous solution, to a coating liquid; or the hydrophilic polymer coupler can be dissolved in a mixed solvent of water and an organic solvent miscible with water, such as a lower alcohol, tetrahydrofuran, acetone, ethyl acetate, cyclohexanone, ethyl lactate, dimethylformamide, and dimethylacetamide, or in an alkali aqueous solution or an alkali-water-containing organic solvent; and then the solution can be added to a coating liquid. A small amount of a surface-active agent may also be added.

Specific examples of the substituents in formula (II) and the cyan coupler represented by formula (II) are shown below.

Examples of $R^1$:

$—CONH(CH_2)_3O—A$ $—CONH(CH_2)_4O—A$ $—CONH(CH_2)_3OC_{12}H_{25}\text{-}n$ $—CONH(CH_2)_3OC_{10}H_{21}\text{-}n$ $—CONH(CH_2)_3OCH_2\overset{C_2H_5}{\overset{|}{C}}HC_4H_9\text{-}n$ $—CONHC_{16}H_{33}\text{-}n$ -continued
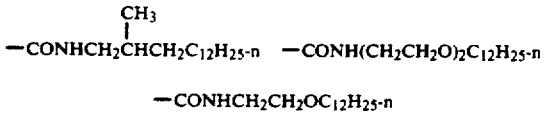
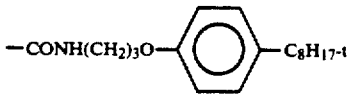
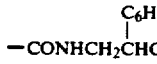
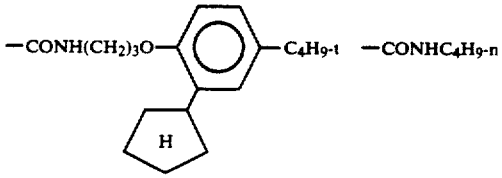
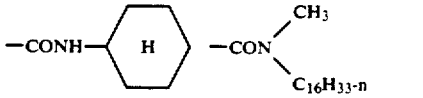
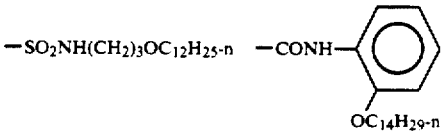
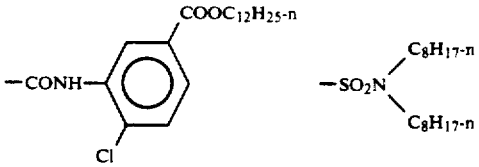
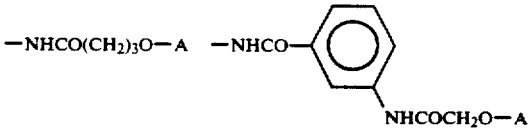
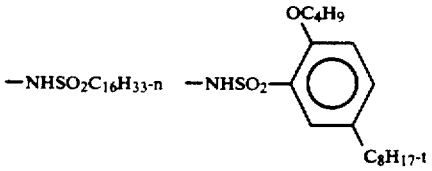
Examples of $R^2$:
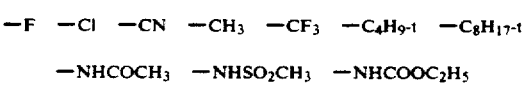
-continued
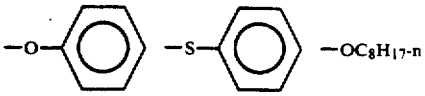
Examples of $R^3NH$—:
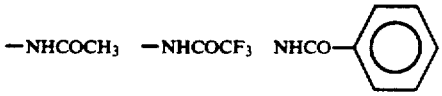
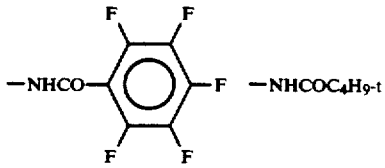
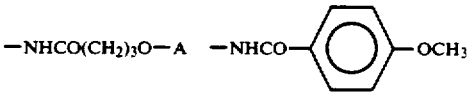
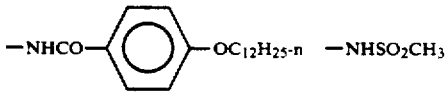
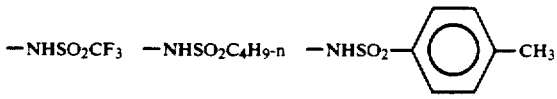
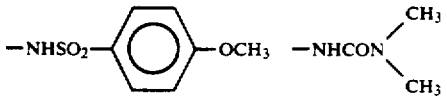
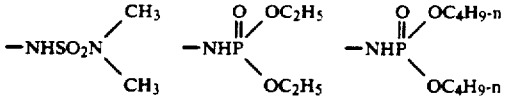
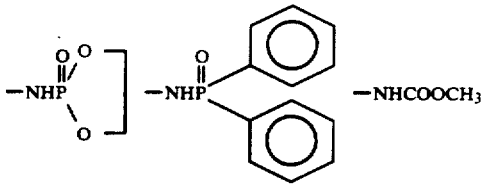
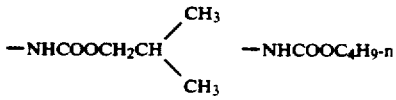
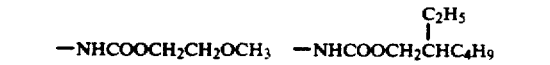
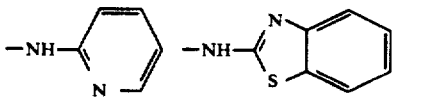

Examples of $X^1$:

$-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ $-OCH_2CONHCH_2CH_2OCH_3$ $-OCH_2CH_2SCH_2COOH$ $-OCH_2CH_2S\overset{C_{12}H_{25}\text{-}n}{\overset{|}{C}}HCOOH$ $-OCH_2CH_2OCH_3$ $-OCH_2CH_2NHSO_2CH_3$

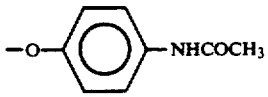

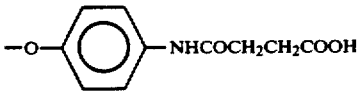

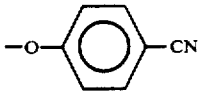

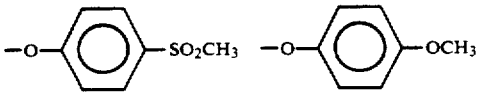

-continued

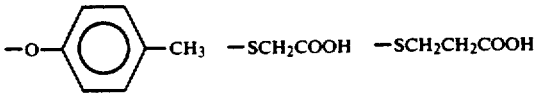

$-S\overset{CH_3}{\overset{|}{C}}HCOOH$ $-SCH_2COOC_2H_5$ $-SCH_2CH_2OH$

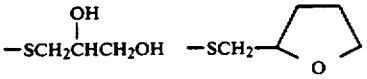

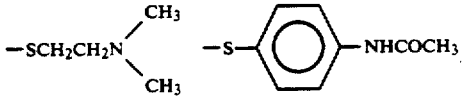

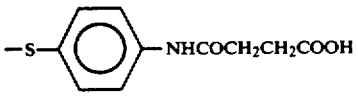

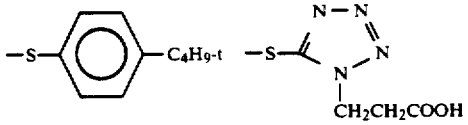

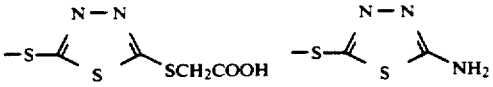

Specific examples of cyan coupler represented by formula (II):

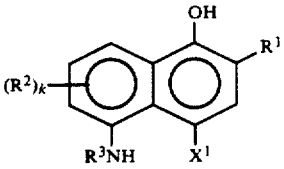

Coupler of k = 0

| No. | $R^1$ | $R^3$ | $X^1$ |
|---|---|---|---|
| IIC-1 | $-CONH(CH_2)_3O-A$ | $CH_3CO-$ | H |
| IIC-2 | $-CONH(CH_2)_3O-A$ | $CF_3CO-$ | H |
| IIC-3 | $-CONH(CH_2)_3O-A$ | $CH_3SO_2-$ | H |
| IIC-4 | $-CONH(CH_2)_3O-A$ | $C_2H_5OCO-$ | H |
| IIC-5 | $-CONH(CH_2)_4O-A$ | $t\text{-}C_4H_9CO-$ | H |
| IIC-6 | $-CONH(CH_2)_3O-C_{12}H_{25}\text{-}n$ | $C_2H_5OCO-$ | H |
| IIC-7 | $-CONH(CH_2)_3O-C_{12}H_{25}\text{-}n$ | $i\text{-}C_4H_9OCO-$ | H |
| IIC-8 | $-CONH(CH_2)_3OC_{10}H_{21}\text{-}n$ | $i\text{-}C_4H_9OCO-$ | H |
| IIC-9 | $-CONH(CH_2)_3OC_{10}H_{21}\text{-}n$ | $n\text{-}C_4H_9\overset{C_2H_5}{\overset{\vert}{C}}HCH_2OCO-$ | H |
| IIC-10 | $-CONH(CH_2)_3O-A$ | $i\text{-}C_4H_9OCO-$ | H |
| IIC-11 | 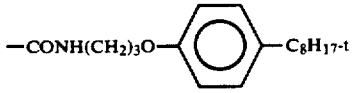 | $i\text{-}C_4H_9OCO-$ | H |
| IIC-12 | $-CONH\overset{CH_3}{\overset{\vert}{C}}H_2CHCH_2OC_{12}H_{25}\text{-}n$ | $i\text{-}C_4H_9OCO-$ | H |

-continued

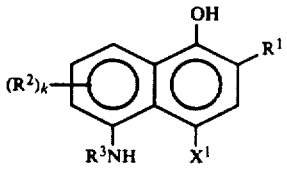

Coupler of k = 0

| No. | $R^1$ | $R^3$ | $X^1$ |
|---|---|---|---|
| IIC-13 | $-CONH(CH_2)_3OCH_2CH(C_2H_5)C_4H_9$ | $n\text{-}C_8H_{17}OCO-$ | H |
| IIC-14 | 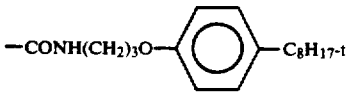 | $n\text{-}C_4H_9SO_2-$ | H |
| IIC-15 | $-CONH(CH_2)_3OC_{12}H_{25}\text{-}n$ | $(C_2H_5O)_2P(=O)-$ | H |
| IIC-16 | $-CONH(CH_2)_3O-A$ | 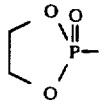 | H |
| IIC-17 | $-CONHCH_2CH_2OC_{12}H_{25}\text{-}n$ | $i\text{-}C_4H_9OCO-$ | H |
| IIC-18 | $-CON(CH_3)C_{16}H_{33}\text{-}n$ | $C_2H_5OCO-$ | H |
| IIC-19 | $-CONHCH_2CH_2OCOC_{11}H_{23}\text{-}n$ | $i\text{-}C_4H_9OCO-$ | H |
| IIC-20 | $-CONHC_{12}H_{25}\text{-}n$ | $n\text{-}C_4H_9CH(CH_3)CH_2OCO-$ | H |
| IIC-21 | $-SO_2NH(CH_2)_3OC_{12}H_{25}\text{-}n$ | $i\text{-}C_4H_9OCO-$ | H |
| IIC-22 | $-SO_2N(CH_3)C_{18}H_{37}\text{-}n$ | $C_2H_5OCO-$ | H |
| IIC-23 | $-CONHCH_2CH(C_6H_{13}\text{-}n)C_8H_{17}\text{-}n$ | $i\text{-}C_4H_9OCO-$ | H |
| IIC-24 | $-CONH(CH_3)_3OC_{12}H_{25}\text{-}n$ | 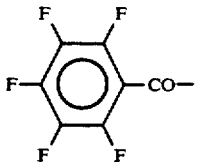 | H |
| IIC-25 | 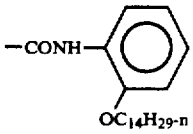 | $CH_3SO_2-$ | H |
| IIC-26 | 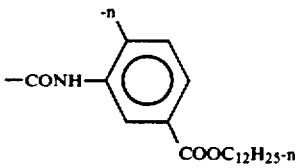 | 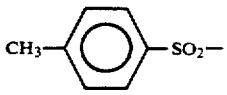 | H |

-continued

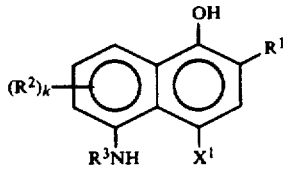

Coupler of k = 0

| No. | $R^1$ | $R^3$ | $X^1$ |
|---|---|---|---|
| IIC-27 | $-CONH(CH_2)_3OC_{12}H_{25}$-n | i-$C_4H_9OCO-$ | Cl |
| IIC-28 | $-CONH(CH_2)_3OC_{12}H_{25}$-n | n-$C_4H_9OCO-$ | Cl |
| IIC-29 | $-CONH(CH_2)_3OC_{14}H_{29}$-n | t-$C_4H_9CO-$ | Cl |
| IIC-30 | $-CONH(CH_2)_3OC_{12}H_{25}$-n | i-$C_4H_9OCO-$ | $-OCH_2CH_2OH$ |
| IIC-32 | $-CONH(CH_2)_3OC_{12}H_{25}$-n | i-$C_4H_9OCO-$ | $-O(CH_2CH_2O)_2H$ |
| IIC-33 | $-CONH(CH_2)_3OC_{12}H_{25}$-n | i-$C_4H_9OCO-$ | $-OCH_2CH_2OCH_3$ |
| IIC-34 | $-CONH(CH_2)_3OC_{12}H_{25}$-n | i-$C_4H_9OCO-$ | $-OCH_2CH_2SCH_2COOH$ |
| IIC-35 | $-CONHC_4H_9$-n | i-$C_4H_9OCO-$ | $-OCH_2CH_2S(COOH)CH_{12}H_{25}$-n |
| IIC-36 | $-CONHCH_2(CH_3)CHCH_2OC_{12}H_{25}$-n | i-$C_4H_9OCO-$ | $-O(CH_2)_3COOH$ |
| IIC-37 | $-CONH(CH_2)_4O-A$ | i-$C_4H_9OCO-$ | 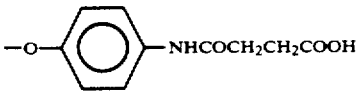 |
| IIC-38 | $-CONH(CH_2)_3O-A$ | i-$C_4H_9OCO-$ | 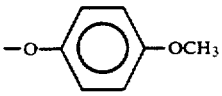 |
| IIC-39 | 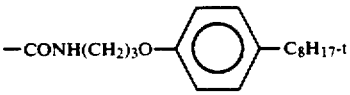 | i-$C_4H_9OCO-$ | $-SCH_2COOH$ |
| IIC-40 | $-CONH(CH_2)_3OC_{12}H_{25}$-n | i-$C_4H_9OCO-$ | $-SCH_2CH_2COOH$ |
| IIC-41 | $-CONH(CH_2)_3OC_{12}H_{25}$-n | i-$C_4H_9OCO-$ | $-SCH_2CH_2OH$ |
| IIC-42 | $-CONH(CH_2)_4O-A$ | $CH_3SO_2-$ | 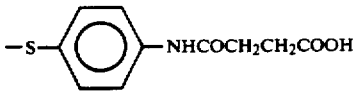 |
| IIC-43 | $-SO_2NH(CH_2)_3O-A$ | n-$C_4H_9SO_2-$ | $-OCH_2CH_2OH$ |
| IIC-44 | $-CONHCH_2(CH_3)CHCH_2OC_{12}H_{25}$-n | i-$C_4H_9OCO-$ | $-OCH_2CH_2OH$ |
| IIC-45 | $-CONH(CH_2CH_2O)C_{12}H_{25}$-n | $(C_2H_5O)_2P(=O)-$ | $-OCH_2CH_2OCH_3$ |
| IIC-46 | $-CONH(CH_2)_4O-A$ | t-$C_4H_9CO-$ | $-OCH_2COOC_2H_5$ |
| IIC-47 | 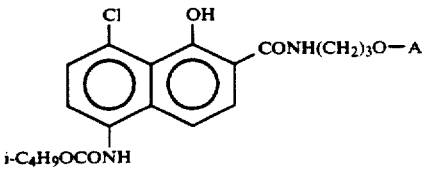 | | |

-continued
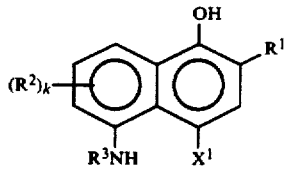
Coupler of k = 0
| No. | R1 | R3 | X1 |
|---|---|---|---|
| IIC-48 | | 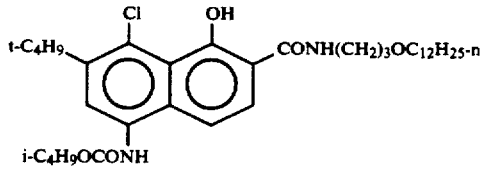 | |
| IIC-49 | | 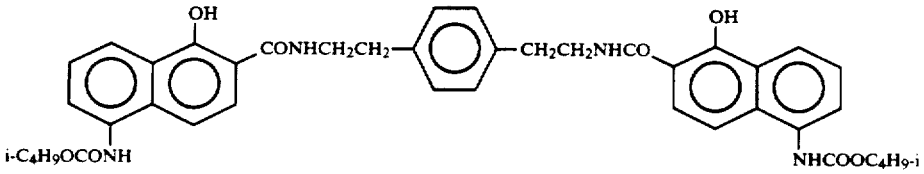 | |
| IIC-50 | | 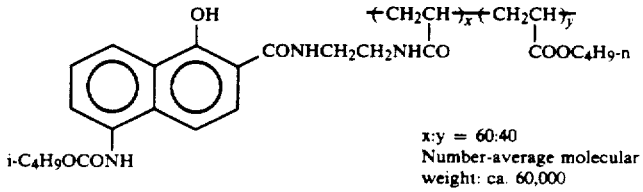 x:y = 60:40 Number-average molecular weight: ca. 60,000 | |
| IIC-51 | | 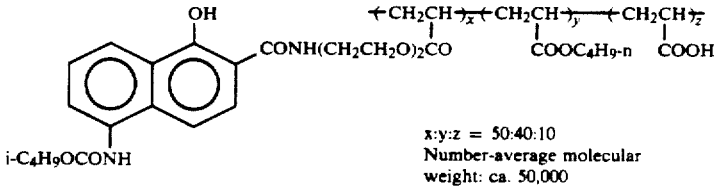 x:y:z = 50:40:10 Number-average molecular weight: ca. 50,000 | |
| IIC-52 | | 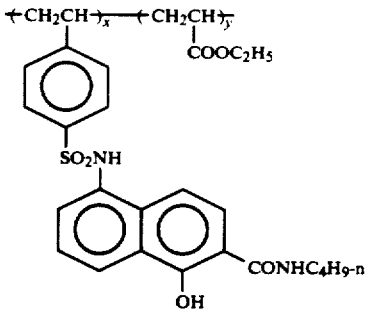 x:y = 70:30 Number-average molecular weight: ca. 55,000 | |
| IIC-53 | | 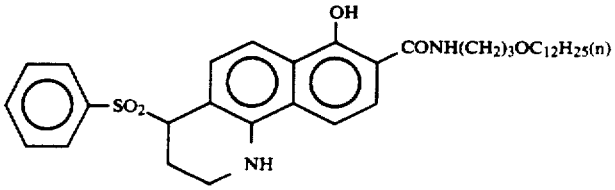 | |

-continued

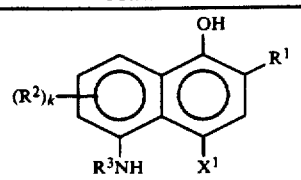

Coupler of k = 0

| No. | R1 | R3 | X1 |
|---|---|---|---|
| IIC-54 | 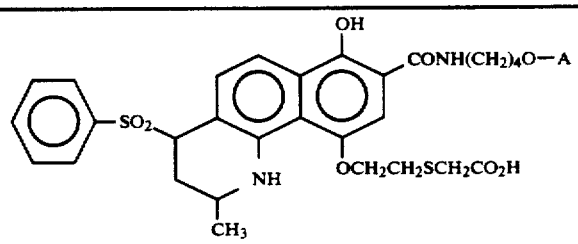 | | |
| IIC-55 | 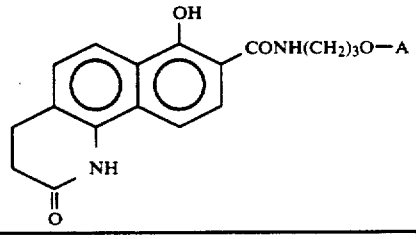 | | |

In the above specific examples of IIC-1 to IIC-55 that are cyan couplers represented by formula (II) A represents

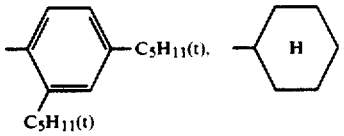

represents a cyclohexyl group,

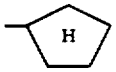

represents a cyclopentyl group, and —$C_8H_{17}$—t represents —$C(CH_3)_2CH_2C(CH_3)_3$.

Specific examples of the cyan coupler represented by formula (II) other than those described above and/or synthesis methods of these compounds are described, for example, in U.S. Pat. No. 4,690,889, JP-A Nos. 237448/1985, 153640/1986, 145557/1986, 208042/1988, and 31159/1989, and West German Patent No. 3823049 A.

For the cyan coupler represented by formula (II), preferably a small amount of a high-boiling organic solvent for dispersion is used, because it can further improve the sharpness and desilvering property, as described in JP-A No. 269958/1987.

Specifically, 0.3 parts by weight or less, preferably 0.1 parts by weight or less, of a high-boiling organic solvent is used to 1 part by weight of the cyan coupler represented by formula (II).

The total amount of the cyan couplers represented by formula (II) to be added is 30 mol % or more, preferably 50 mol % or more, more preferably 70 mol % or more, and further more preferably 90 mol % or more, of all of the cyan couplers.

Preferably two or more of the cyan couplers represented by formula (II) are used in combination, and if the same color sensitivity is present in two or more layers different in sensitivity, preferably a two-equivalent cyan coupler is used in the highest-sensitive layer and a four-equivalent cyan coupler is used in the lowest-sensitive layer. In other layers having the same color sensitivity, preferably one or both of a two-equivalent cyan coupler and a four-equivalent cyan coupler are used.

The phenol cyan coupler represented by formula (III) will now be described in detail below.

In formula (III), $R^{21}$ represents a straight chain, branched-chain, or cyclic alkyl group that may be substituted and has a total C-number of 1 to 36 (preferably 4 to 30), a group that may be substituted and has a total C-number of 6 to 36 (preferably 12 to 30), or a heterocyclic group that has a total C-number of 2 to 36 (preferably 12 to 30). Herein, the heterocyclic group is a 5- to 7-membered heterocyclic group that may be a condenced ring and has in the ring at least one hetero atom selected from the group consisting of N, O, S, P, Se, and Te, such as 2-furyl, 2-thienyl, 2-pyridyl, 4-pyridyl, 4-pyrimidyl, 2-imidazolyl, and 4-quinolyl. As examples of the substituent on $R^{21}$ are a halogen atom, a cyano group, a nitro group, a carboxyl group, a sulfo group, an alkyl group, an aryl group, a heterocyclic group, an alkoxy group, an aryloxy group, an alkylthio group, an arylthio group, an alkylsulfonyl group, an arylsulfonyl group, an alkoxycarbonyl group, an acyl group, a carbonamido group, a sulfonamido group, a carbamoyl group, a sulfamoyl group, an imido group, a ureido group, an alkoxycarbonylamino group, and a sulfamoylamino group (hereinafter, these being referred to as substituent group A), and as preferable examples of the substituent are an aryl group, a heterocyclic group, an aryloxy group, an alkylsulfonyl group, an arylsulfonyl group, or an imido group.

In formula (III), $R^{22}$ represents an aryl group that has a total C-number of 6 to 36 (preferably 6 to 15) and may be substituted by a substituent selected from the above-mentioned substituent group A and may be a condensed ring. Herein, preferable substituents are a halogen (F, Cl, Br, and I), a cyano group, a nitro group, an acyl group (e.g., acetyl and benzoyl), an alkyl group (e.g., methyl, t-butyl, trifluoromethyl, and trichloromethyl), an alkoxy group (e.g., methoxy, ethoxy, butoxy, and trifluoromethoxy), an alkylsulfonyl group (e.g., methylsulfonyl, propylsulfonyl, butylsulfonyl, and benzylsulfonyl), an arylsulfonyl group (e.g., phenylsulfonyl, p-tolylsulfonyl, and p-chlorophenylsulfonyl), an alkoxycarbonyl group (e.g., methoxycarbonyl and butoxycarbonyl), a sulfonamido group (e.g., methanesulfonamido, trifluoromethanesulfonamido, and toluenesulfonamido), a carbamoyl group (e.g., N-N-dimethylcarbamoyl and N-phenylcarbamoyl), or a sulfamoyl group (e.g., N,N-diethylsulfamoyl and N-phenylsulfamoyl). $R^{22}$ is preferably a phenyl group having at least one substituent selected from the group consisting of a halogen atom, a cyano group, a sulfonamido group, an alkylsulfonyl group, an arylsulfonyl group, and a trifluoromethyl group, and more preferably $R^{22}$ is 4-cyanophenyl, a 4-cyano-3-halogenophenyl, a 3-cyano-4-halogenophenyl, a 4-alkylsulfonylphenyl, a 4-alkylsulfonyl-3-halogenophenyl, a 4-alkylsulfonyl-3-alkoxyphenyl, a 3-alkoxy-4-alkylsulfonylphenyl, a 3,4-dihalogenophenyl, a 4-halogenophenyl, a 3,4,5-trihalogenophenyl, 3,4-dicyanophenyl, a 3-cyano-4,5-dihalogenophenyl, 4-trifluoromethylphenyl, or 3-sulfonamidophenyl, particularly preferably 4-cyanophenyl, a 3-cyano-4-halogenophenyl, a 4-cyano-3-halogenophenyl, 3,4-dicyanophenyl, and a 4-alkylsulfonylphenyl.

In formula (III), $Z^1$ represents a hydrogen atom or a coupling split-off group capable of being released upon coupling reaction with the oxidized product of an aromatic primary amine developing agent. As examples of the coupling split-off group are a halogen atom, a sulfo group, an alkoxy group that has a total C-number of 1 to 36 (preferably 1 to 24), an aryloxy group that has a total C-number of 6 to 36 (preferably 6 to 24), an acyloxy group that has a total C-number of 2 to 36 (preferably 2 to 24), an alkylsulfonyl group that has a total C-number of 1 to 36 (preferably 1 to 24), an arylsulfonyl group that has a total C-number of 6 to 36 (preferably 6 to 24), an alkylthio group that has a total C-number of 1 to 36 (preferably 2 to 24), an arylthio group that has a total C-number of 6 to 36 (preferably 6 to 24), an imido group that has a total C-number of 4 to 36 (preferably 4 to 24), a carbamoyloxy group that has a total C-number of 1 to 36 (preferably 1 to 24), or a heterocyclic group that has a total C-number of 1 to 36 (preferably 2 to 24) and is bonded to the coupling active site through the nitrogen atom (e.g., pyrazolyl, imidazolyl, 1,2,4-triazole-1-yl, and tetrazolyl). Herein, the alkoxy group and other groups mentioned after it may be substituted by a substituent selected from the above-mentioned substituent group A. Preferably, $Z^1$ represents a hydrogen atom, a halogen atom, an alkoxy group, an aryloxy group, an alkylthio group, an arylthio group, or a heterocylic thio group, particularly preferably a hydrogen atom, a chlorine atom, an alkoxy group, or an aryloxy group.

Examples of $R^{21}$, $R^{22}$ and $Z^1$ in formula (III) are shown below.

Examples of $R^{21}$

A
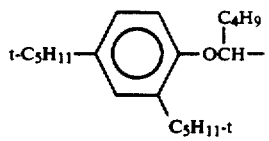

B
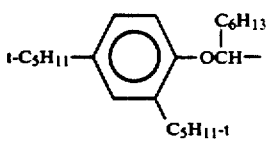

C
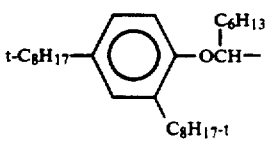

D
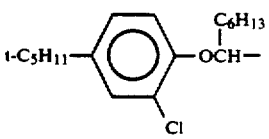

E
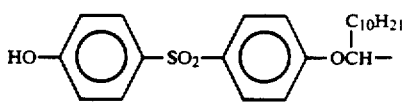

F
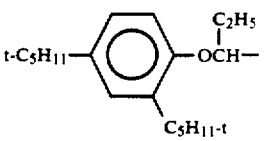

G
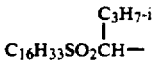

H
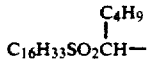

I
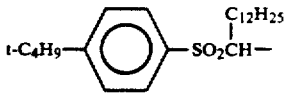

J
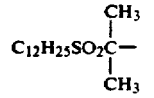

K
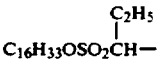

L
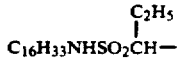

M
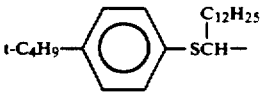

-continued
N
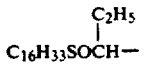
O
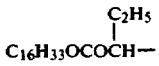
P
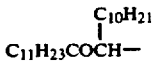
Q
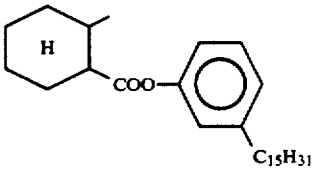
R
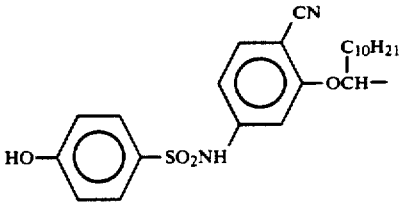
S
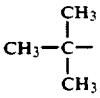
T
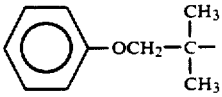
U
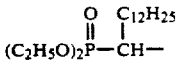
V
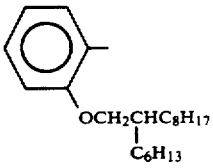
W
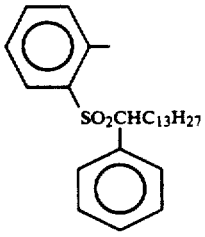
X
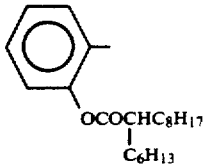
-continued
Y
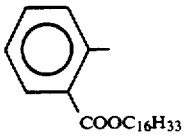
Z
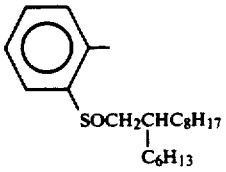
a
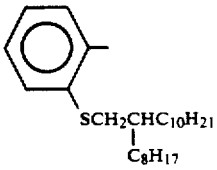
b
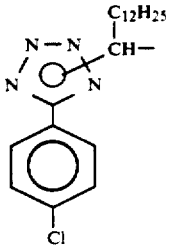
c
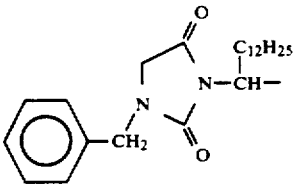
d
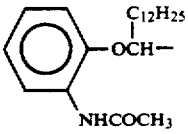
e
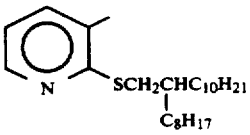
f
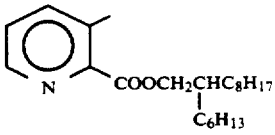

-continued
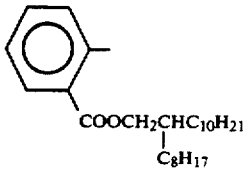
Examples of $R^{22}$
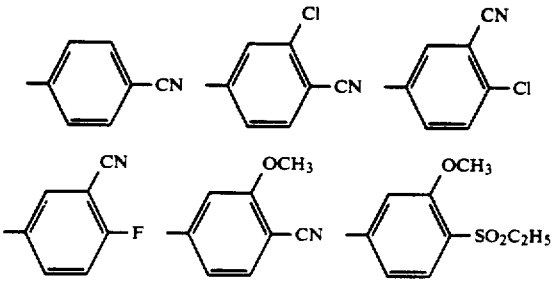
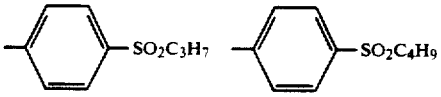
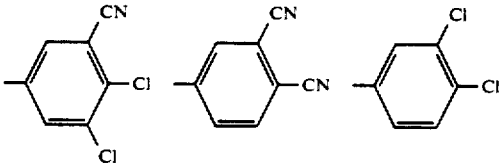
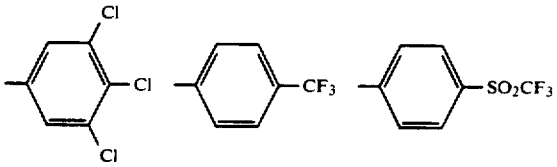
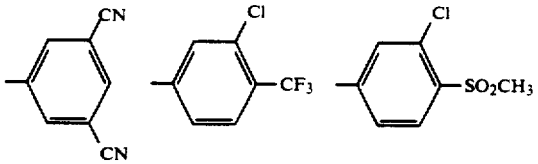
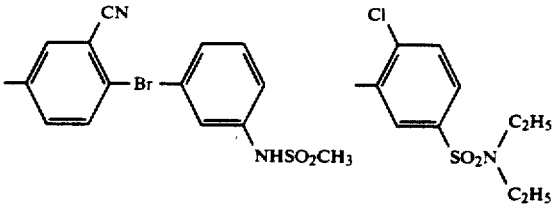
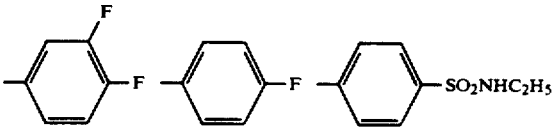
Examples of $Z^1$
H
g
F
Cl
$-OCOCH_3$
$-OSO_2CH_3$
$-OCOOC_2H_5$
$-OCONHC_2H_5$
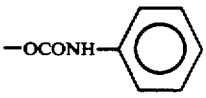
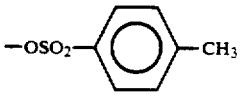
$-OCH_3$
$-OCH_2CH_2OCH_3$
$-OCH_2CH_2Cl$
$-OCH_2COOCH_3$
$-OCH_2COOH$
$-OCH(CH_3)COOH$
$-OCH_2CH_2SO_2CH_3$
$-OCH_2CONHCH_2CH_2OCH_3$
$-O-\overset{O}{\overset{\|}{P}}(OC_2H_5)_2$
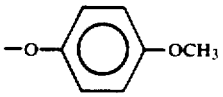
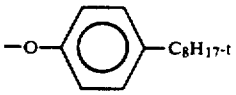
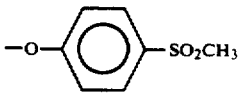
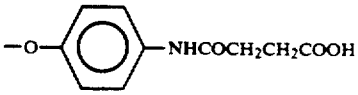
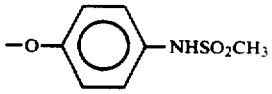

-continued

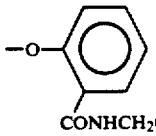

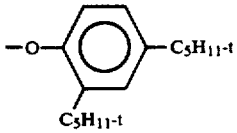

$-OCH_2COOCH_2CH_2OCH_3$ $-OCH_2COOCH(CH_3)C_2H_5$ $-SCH_2COOH$ $-SCH_2CH_2COOH$ $-SCH_2CH(OH)CH_2OH$

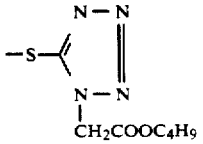

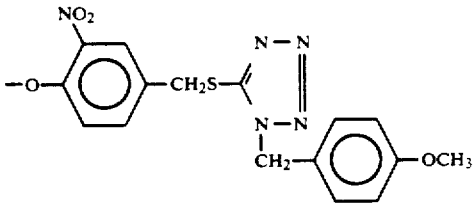

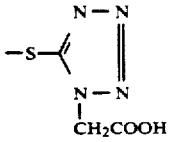

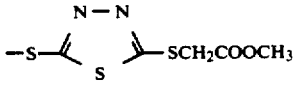

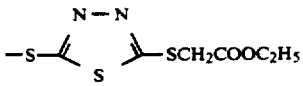

Specific examples of the cyan coupler represented by formula (III) are shown below, wherein A to Z and a to f are serial numbers of specific examples of $R^{21}$ shown above.

| No. | $R^{21}$ | $R^{22}$ | $Z^1$ |
|---|---|---|---|
| IIIC-1 | A | 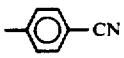 | H |
| IIIC-2 | B | 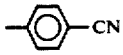 | H |
| IIIC-3 | F | 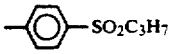 | H |
| IIIC-4 | F | 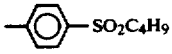 | H |
| IIIC-5 | C | 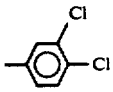 | H |
| IIIC-6 | A | 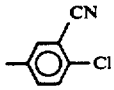 | H |
| IIIC-7 | A | 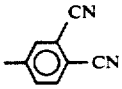 | H |
| IIIC-8 | A | 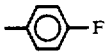 | H |
| IIIC-9 | A | 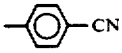 | 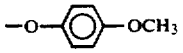 |
| IIIC-10 | B | 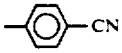 | 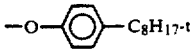 |
| IIIC-11 | A | 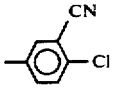 | $-OCH_2COOCH_3$ |
| IIIC-12 | A | 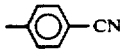 | Cl |
| IIIC-13 | A | 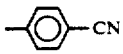 | $-SCH_2COOH$ |
| IIIC-14 | G | 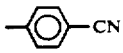 | H |
| IIIC-15 | H | 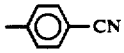 | Cl |
| IIIC-16 | K | 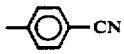 | 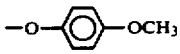 |
| IIIC-17 | L | 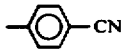 | 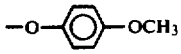 |
| IIIC-18 | O | 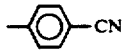 | 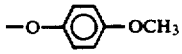 |
| IIIC-19 | P | 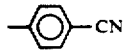 | 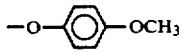 |
| IIIC-20 | S | 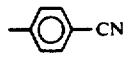 | 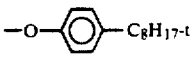 |

-continued

| No. | $R^{21}$ | $R^{22}$ | $Z^1$ |
|---|---|---|---|
| IIIC-21 | E | 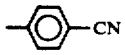 | 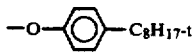 |
| IIIC-22 | V | 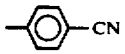 | H |
| IIIC-23 | W | 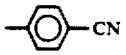 | H |
| IIIC-24 | X | 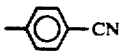 | H |
| IIIC-25 | e | 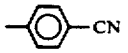 | H |
| IIIC-26 | Y | 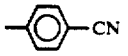 | 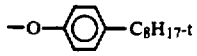 |
| IIIC-27 | g | 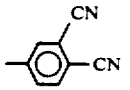 | Cl |
| IIIC-28 | b | 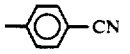 | 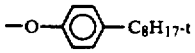 |
| IIIC-29 | G | 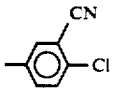 | H |
| IIIC-30 | J | 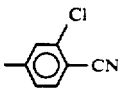 | H |
| IIIC-31 | V | 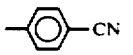 | Cl |
| IIIC-32 | X | 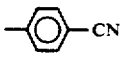 | Cl |
| IIIC-33 | b | 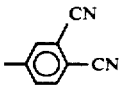 | 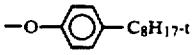 |
| IIIC-34 | g | 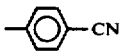 | Cl |
| IIIC-35 | c | 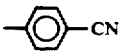 | H |
| IIIC-36 | f | 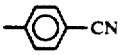 | Cl |
| IIIC-37 | e | 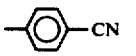 | Cl |
| IIIC-38 | d | 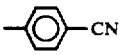 | Cl |
| IIIC-39 | T | 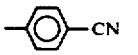 | 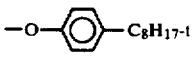 |

-continued

| No. | $R^{21}$ | $R^{22}$ | $Z^1$ |
|---|---|---|---|
| IIIC-40 | U | 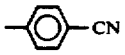 | Cl |
| IIIC-41 | W | 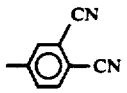 | H |
| IIIC-42 | e | 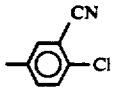 | H |

The cyan couplers represented by formula (III) can be synthesized by the synthesis methods described, for example, in JP-A Nos. 65134/1981, 2757/1986, 159848/1988, 161450/1988, 161451/1988, and 1254956/1989, and U.S. Pat. No. 4,923,791.

Generally the yellow coupler of the present invention can be used in an amount in the range of $1\times10^{-3}$ mol to 1 mol, preferably $1\times10^{-2}$ to $8\times10^{-1}$ mol, per mol of the silver halide in the layer in which the yellow coupler is used. The yellow coupler of the present invention can be used in combination with a yellow coupler of a different type.

The layer in which the yellow coupler of the present invention is added may be an arbitrary silver halide emulsion layer or a non-photosensitive layer, and the yellow coupler of the present invention can be added to, in addition to a blue-sensitive silver halide emulsion layer, suitably a non-photosensitive layer adjacent to it. Where the yellow coupler of the present invention is used in a blue-sensitive silver halide emulsion layer, the amount of silver is preferably 0.1 to 10 g/m$^2$. If the yellow coupler of the present invention is used in a nonphotosensitive layer, the amount of the yellow coupler of the present invention to be used is preferably 0.1 to 1 mmol/m$^2$.

Generally, the cyan coupler of the present invention is used in an amount in the range of $1\times10^{-3}$ to 1 mol, preferably $1\times10^{-3}$ to $8\times10^{-1}$ mol, per mol of the silver halide where the coupler is used.

Normally the amount of the magenta coupler to be used is 0.003 o 1.0 mol per mol of the photosensitive silver halide.

It is adequate if the photographic material of the present invention has on a base at least one blue-sensitive silver halide emulsion layer, at least one green-sensitive silver halide emulsion layer, and at least one red-sensitive silver halide emulsion layer, and there is no particular restriction on the number of silver halide emulsion layers and non-photosensitive layers and on the order of the layers. A typical example is a silver halide photographic material having, on a support, at least one photosensitive layer that comprises several silver halide emulsion layers that have substantially the same color sensitivity but different in sensitivity, which photosensitive layer is a unit photosensitive layer having color sensitivity to any one of blue light, green light, and red light, and, in the case of a multilayer silver halide color photographic material, generally the arrangement of unit photosensitive layers is such that a red-sensitive layer, a green-sensitive layer, and a blue-sensitive layer are provided on a support in the stated order, with the red-sensitive layer adjacent to the support. However, depending on the purpose, the order of the arrangement may be reversed or the arrangement may be such that layers having the same color sensitivity have a layer with different color sensitivity between them. A non-photosensitive layer, such as various intermediate layers, may be placed between the above-mentioned silver halide photosensitive layers, and such a layer also be placed on the uppermost layer or the lowermost layer. In the case wherein the red-sensitive layer, the green-sensitive layer, and the blue-sensitive layer are arranged in the stated order on a support with the green-sensitive layer nearer to the support, or the case wherein the order is reversed, the effect of the present invention is high.

The intermediate layer may contain such couplers and DIR compounds as described in JP-A Nos. 43748/1986, 113438/1984, 113440/1984, 20037/1986, and 20038/1986, and it may also contain a usually-used color mixing-inhibitor.

For multiple silver halide emulsion layers that constitute each unit photosensitive layer, preferably a two-layer constitution can be used, which comprises a high-sensitive emulsion layer and a low-sensitive emulsion layer, as described in West German Patent No. 1,121,470 and British Patent No. 923,045. Generally, the arrangement is preferably such that the sensitivities are decreased successively toward the support, and a non-photosensitive layer may be placed between halogen emulsions layers. Further, as described in JP-A Nos. 112751/1982, 200350/1987, 206541/1987, and 206543/1987, a low-sensitive emulsion layer may be placed away from the base and a high-sensitive emulsion layer may be placed nearer to the support.

A specific example is an arrangement of a low-sensitive blue-sensitive layer (BL)/a high-sensitive blue-sensitive layer (BH)/a high-sensitive green-sensitive layer (GH)/a low-sensitive green-sensitive layer (GL)/a high-sensitive red-sensitive layer (RH)/a low-sensitive red-sensitive layer (RL), which are named from the side away from the support, or an arrangement of BH/BL/GL/GH/RH/RL, or an arrangement of BH/BL/GH/GL/RL/RH.

Also, as described in JP-B ("JP-B" means examined Japanese patent publication) No. 34932/1980, the order may be a blue-sensitive layer/GH/RH/GL/RL, which are named from the side away from the support. Also, as described in JP-A Nos. 25738/1981 and 63936/1987, the order may be a blue-sensitive layer/GL/RL/GH/RH, which are named from the side away from the support.

Further, as described in JP-B No. 15495/1974, an arrangement can be mentioned wherein an upper layer is a silver halide emulsion layer highest in sensitivity, an intermediate layer is a silver halide emulsion layer whose sensitivity is lower than that of the upper layer, and a lower layer is a silver halide emulsion layer whose sensitivity is lower than that of the intermediate layer, so that the sensitivities may be decreased successively toward the support. If the arrangement is made up of three layers different in sensitivity in this way, as described in JP-A No. 202464/1984, in the same color sensitive layer, the order may be an intermediate-sensitive emulsion layer, a high-sensitive emulsion layer, and a low-sensitive emulsion layer, which are stated from the side away from the support.

Further, the order may be, for example, a high-sensitive emulsion layer, a low-sensitive emulsion layer, and an intermediate-emulsion layer, or a low-sensitive emulsion layer, an intermediate-sensitive emulsion layer, and a high-sensitive emulsion layer. If there are four or more layers, the arrangement can be varied as described above.

In order to improve color reproduction, it is preferable that donor layers (CL), described in U.S. Pat. Nos. 4,663,271, 4,705,744, and 4,707,436, and JP-A Nos. 160448/1987 and 89850/1988, whose spectral sensitivity distribution is different from that of a main sensitive layer, such as BL, GL, and, RL and which have a double-layer effect are arranged adjacent or near to the main sensitive layer.

As stated above, various layer constitutions and arrangements can be chosen in accordance with the purpose of each photographic material.

A preferable silver halide to be contained in the photographic emulsion layer of the photographic material utilized in the present invention is silver bromoiodide, silver chloroiodide, or silver bromochloroiodide, containing about 30 mol % or less of silver iodide. A particularly preferable silver halide is silver bromoiodide or silver bromochloroiodide, containing about 2 to about 10 mol % of silver iodide.

The silver halide grains in the photographic emulsion may have a regular crystal form, such as a cubic shape, an octahedral shape, and a tetradecahedral shape, or a regular crystal shape, such as spherical shape or a tabular shape, or they may have a crystal defect, such as twin planes, or they may have a composite crystal form.

The silver halide grains may be fine grains having a diameter of about 0.2 μm or less, or large-size grains with the diameter of the projected area being down to about 10 μm, and as the silver halide emulsion, a polydisperse emulsion or a monodisperse emulsion can be used.

The silver halide photographic emulsions that can be used in the present invention may be prepared suitably by known means, for example, by the methods described in *I. Emulsion Preparation and Types*, in *Research Disclosure* (RD) No. 17643 (December 1978), pp. 22–23, and ibid. No. 716 (November 1979), p. 648, and ibid. No. 307105 (November, 1989), pp. 863–865; the methods described in P. Glafkides, *Chimie et Phisique Photographique*, Paul Montel (1967), in G. F. Duffin, *Photographic Emulsion Chemistry*, Focal Press (1966), and in V. L. Zelikman et al., *Making and Coating of Photographic Emulsion*, Focal Press (1964).

A monodisperse emulsion, such as described in U.S. Pat. Nos. 3,574,628 and 3,655,394, and in British Patent No. 1,413,748, is also preferable.

Tabular grains having an aspect ratio of 5 or greater can be used in the emulsion of the present invention. Tabular grains can be easily prepared by the methods described in, for example, Gutoof, *Photographic Science and Engineering*, Vol. 14, pp. 248–257 (1970), U.S Pat. Nos. 4,434,226, 4,414,310, 4,433,048, and 4,439,520, and British Patent No. 2,112,157.

The crystal structure of silver halide grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Although the above-described emulsions may be either a surface latent image-type that forms latent image mainly on the surface, an internal latent image-type that forms latent image at the inner part of grain, or a type that forms latent image both on the surface and at the inner part of grain, it is necessary to be a negative-type emulsion. Of internal latent image-type emulsions, an internal latent image-type emulsion of core/shell-type grain, as described in JP-A No. 264720/1988, may be used. The preparation method of such internal latent image-type emulsion of core/shell-type grain is described in JP-A No. 133542/1984. The thickness of shell in such emulsion may be different according to a development process or the like, but a range of 3 to 40 nm is preferable, and a range of 5 to 20 nm is particularly preferable.

The silver halide emulsion that has been physically ripened, chemically ripened, and spectrally sensitized is generally used. Additives to be used in these steps are described in *Research Disclosure* Nos. 17643, 18716 and 307105, and involved sections are listed in the Table shown below.

In the photographic material of the present invention, two or more kinds of emulsions in which at least one of characteristics, such as grain size of photosensitive silver halide emulsion, distribution of grain size, composition of silver halide, shape of grain, and sensitivity is different each other can be used in a layer in a form of mixture.

Silver halide grains the surface of which has been fogged as described in, for example, U.S. Pat. No. 4,082,553, and silver halide grains or colloidal silver grains the inner part of which has been fogged as described in, for example, U.S. Pat. No. 4,626,498 and JP-A No. 214852/1984 may be preferably used in a photosensitive silver halide emulsion layer and/or a substantially non-photosensitive hydrophilic colloid layer. "Silver halide emulsion the surface or inner part of which has been fogged" means a silver halide emulsion capable of being uniformly (non-image-wisely) developed without regard to unexposed part or exposed part to light of the photographic material. The method for preparing a silver halide emulsion the surface or inner part of which has been fogged are described, for example, in U.S. Pat. No. 4,626,498 and JP-A No. 214852/1984.

The silver halide composition forming inner nucleus of core/shell-type silver halide grain the inner part of which has been fogged may be the same or different. As a silver halide grain the surface or inner part of which has been fogged, any of silver chloride, silver chlorobromide, silver chloroiodobromide can be used. Although the grain size of such silver halide grains which has been fogged is not particularly restricted, the average grain size is preferably 0.01 to 75 μm, particularly preferably 0.05 to 0.6 μm. Further, the shape of grains is not particularly restricted, a regular grain or an irregular grain can be used, and although it may be a polydisperse emulsion, a monodisperse emulsion (that contains at least 95% of silver halide grains in weight or in number of grains having grain diameter within 40% of average grain diameter) is preferable.

In the present invention, it is preferable to use a non-photosensitive fine grain silver halide. "Nonphotosensitive fine grain silver halide" means a silver halide grain that does not expose at an imagewise exposure to light to obtain a color image and is not developed substantially at a development processing, and preferably it is not fogged previously.

Fine grain silver halide has a silver bromide content of 0 to 100 mol %, and may contain silver chloride and/or silver iodide, if needed. Preferable ones contain silver iodide of 0.5 to 10 mol %.

The average grain diameter (average diameter of circle corresponding to projected area) of fine grain silver halide is preferably 0.01 to 0.5 μm, more preferably 0.02 to 0.2 μm.

The fine grain silver halide can be prepared in the same manner as an ordinary photosensitive silver halide. In this case, it is not necessary to optically sensitize the surface of the silver halide grain and also spectrally sensitizing is not needed. However, to add previously such a compound as triazoles, azaindenes, benzothiazoliums, and mercapto compounds or a known stabilizing agent, such as zinc compounds, is preferable. Colloidal silver is preferably contained in a layer containing this fine grain silver halide.

The coating amount in terms of silver of photographic material of the present invention is preferably 6.0 g/m$^2$ or below, most preferably 4.5 g/m$^2$ or below.

Known photographic additives that can be used in the present invention are also described in the above-mentioned three Research Disclosures, and involved sections are listed in the same Table below.

| Additive | RD 17643 (December 1978) | RD 18716 (November 1979) | RD 307105 (November 1989) |
|---|---|---|---|
| 1 Chemical sensitizer | p. 23 | p. 648 (right column) | p. 866 |
| 2 Sensitivity-enhancing agent | — | p. 648 (right column) | — |
| 3 Spectral sensitizers and Supertabilizers | pp. 23-24 | pp. 648- (right column) 649 (right column) | pp. 866-868 |
| 4 Brightening agents | p. 24 | p. 647 (right column) | p. 868 |
| 5 Antifogging agents and Stabilizers | pp. 24-25 | p. 649 (right column) | pp. 868-870 |
| 6 Light absorbers, Filter dyes, and UV Absorbers | pp. 25-26 | pp. 649- (right column) 650 (left column) | p. 873 |
| 7 Stain-preventing agent | p. 25 (right column) | p. 650 (left to right column) | p. 872 |
| 8 Image dye stabilizers | p. 25 | p. 650 (left column) | p. 872 |
| 9 Hardeners | p. 26 | p. 651 (left column) | pp. 874-875 |
| 10 Binders | p. 26 | p. 651 (left column) | pp. 873-874 |
| 11 Plasticizers and Lubricants Lubricants | p. 27 | p. 650 (right column) | p. 876 |
| 12 Coating aids and Surface-active agents | pp. 26-27 | p. 650 (right column) | pp. 875-876 |
| 13 Antistatic agents | p. 27 | p. 650 (right column) | pp. 876-877 |
| 14 Matting agent | — | — | pp. 878-879 |

Further, in order to prevent the lowering of photographic performances due to formaldehyde gas, a compound described in, for example, U.S. Pat. Nos. 4,411,987 and 4,435,503 that is able to react with formaldehyde to immobilize it is preferably added to the photographic material.

In the photographic material of the present invention, a mercapto compound described in, for example, U.S. Pat. Nos 4,740,454 and 4,788,132, and JP-A Nos. 18539/1987 and 283551/1989 is preferably contained therein.

In the photographic material of the present invention, a compound that releases a fogging agent, a development accelerator, a solvent for silver halide, or the precursor thereof, independent of the amount of silver formed by a development processing, described in, for example, JP-A No. 106052/1989 is preferably contained therein.

In the photographic material of the present invention, a dye dispersed by a method described in, for example, International Publication No. W088/04794 and Japanese Published Searched Patent Publication No. 502912/1989, or a dye described in, for example, European Patent No. 317,308A, U.S. Pat. No. 4,420,555, and JP-A No. 259358/1989 is preferably contained therein.

In the present invention, various color couplers can be used, and concrete examples of them are described in patents cited in the above-mentioned *Research Disclosure* No. 17643, VII-C to G, and ibid. No. 307105, VII-C to G.

As yellow couplers to be used in combination with the yellow coupler of the present invention, those described in, for example, U.S. Pat. Nos. 3,933,501, 4,022,620, 4,326,024, 4,401,752, and 4,248,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

As magenta couplers, 5-pyrazolone-type magenta couplers and pyrazoloazole-series magenta couplers can be mentioned, and couplers described in, for example, U.S. Pat. Nos. 4,310,619 and 4,351,897, European Patent No. 73,636, U.S. Pat. Nos. 3,061,432 and 3,725,067, JP-A Nos. 35730/1985, 118034/1980, and 185951/1985, U.S. Pat. No. 4,556,630, and International Publication No. W088/04795 are preferable, in particular.

As cyan couplers to be used in combination with the cyan coupler of the present invention, phenol-type couplers and naphthol-type couplers can be mentioned, and described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 42658/1986 are preferable. Further, pyrazoloazole series couplers as described, for example, in JP-A Nos. 553/1989, 554/1989, 555/1989, and 556/1989, and imidazole series couplers as described, for example, in U.S. Pat. No. 4,818,672 can be used.

Typical examples of polymerized dye-forming coupler are described in, for example, U.S. Pat. Nos. 3,451,820, 4,080,211, 4,367,282, 4,409,320, and 4,576,910, British Patent No. 2,102,137, and European Patent No. 341,188A.

As a coupler which forms a dye having moderate diffusibility, those described in U.S. Pat. No. 4,366,237, British Patent No. 2,125,570, European Patent No. 96,570, and West German Patent Application (OLS) No. 3,234,533 are preferable.

As a colored coupler to rectify the unnecessary absorption of color-forming dyes, those couplers described in, paragraph VII-G of *Research Disclosure* No. 17643, paragraph VII-G of ibid. No. 307105, U.S. Pat. No. 4,163,670, JP-B No. 39413/1982, U.S. Pat. Nos. 4,004,929 and 4,138,258, and British Patent No. 1,146,368 are preferable. Further, it is preferable to use couplers to rectify the unnecessary absorption of color-forming dyes by a fluorescent dye released upon the coupling reaction as described in U.S. Pat. No. 4,774,181 and couplers having a dye precursor, as a group capable of being released, that can react with the developing agent to form a dye as described in U.S. Pat. No. 4,777,120.

A coupler that releases a photographically useful residue accompanied with the coupling reaction can be used favorably in this invention. As a DIR coupler that release a development retarder, those described in patents cited in paragraph VII-F of the above-mentioned *Research Disclosure* No. 17643 and in paragraph VII-F of ibid. No. 307105, JP-A Nos. 151944/1982, 154234/1982, 184248/1985, 37346/1988, and 37350/1986, and U.S. Pat. Nos. 4,248,962 and 4,782,012 are preferable.

A coupler that releases a bleaching accelerator, described, for example, in Research Disclosure Nos. 11449 and 24241, and JP-A No. 201247/1986, is effective for shortening the time of processing that has bleaching activity, and the effect is great in the case wherein the coupler is added in a photographic material using the above-mentioned tabular silver halide grains.

As a coupler that releases, imagewisely, a nucleating agent or a development accelerator upon developing, those described in British Patent Nos. 2,097,140 and 2,131,188, and JP-A Nos. 157638/1984 and 170840/1984 are preferable. Further, compounds which release a fogging agent, a developing accelerator, or a solvent for silver halide by a oxidation-reduction reaction with the oxidized product of developing agent as described in JP-A Nos. 107029/1985, 252340/1985, 44940/1989, and 45687/1989 are also preferable.

Other couplers that can be incorporated in the photographic material of the present invention include competitive couplers described in U.S. Pat. No. 4,130,427, multi-equivalent couplers described in U.S. Pat. Nos 4,283,472, 4,338,393, and 4,310,618, couplers which release a DIR redox compound, couplers which release a DIR coupler, and redox compounds which release a DIR coupler or a DIR redox as described in JP-A Nos. 185950/1985 and 24252/1987, couplers which release a dye to regain a color after releasing as described in European Patent Nos. 173,302A and 313,308A, couplers which release a bleaching-accelerator as described in *Research Disclosure* Nos. 11449 and 24241, and JP-A No. 201247/1986, couplers which release a ligand as described in U.S. as described in JP-A No. 75747/1988, and couplers which release a fluorescent dye as described in U.S. Pat. No. 4,774,181.

Couplers utilized in the present invention can be incorporated into a photographic material by various known methods.

Examples of high-boiling solvent for use in oil-in-water dispersion process are described in, for example, U.S. Pat. No. 2,322,027. As specific examples of high-boiling organic solvent having a boiling point of 175° C. or over at atmospheric pressure for use in oil-in-water dispersion process can be mentioned phthalates (e.g., dibutyl phthalate, dicyclohexyl phthalate, di-2-ethylhexyl phthalate, decyl phthalate, bis(2,4-di-t-amylphenyl phthalate, bis(2,4-di-t-amylphenyl)isophthalate, and bis(1,1-diethylpropyl)phthalate), esters of phosphoric acid or phosphonic acid (e.g., triphenyl phosphate, tricrezyl phosphate, 2-ethylhexyldiphenyl phosphate, tricyclohexyl phophate, tri-2-ethylhexyl phosphate, tridodecyl phosphate, tributoxyethyl phosphate, trichloropropyl phosphate, and di-2-ethylhexylphenyl phosphate), benzoic esters (e.g., 2-ethylhexyl benzoate, dodecyl benzoate, and 2-ethylhexyl-p-hydroxy benzoate), amides (e.g., N,N-diethyldodecanamide, n,n-diethyllaurylamide, and N-tetradecylpyrrolidone), alcohols or phenols (e.g., isostearyl alcohol and 2,4-di-tert-amyl phenol), aliphatic carbonic acid esters (bis)2-ethylhexyl) sebacate, dioctyl azelate, glycerol tributylate, isostearyl lactate, and trioctyl citrate), aniline derivertives (N,N-dibutyl-2-butoxy-5-tert-octylaniline), and hydrocarbons (paraffin, dodecyl benzene, and diisopropyl naphthalene). Further, as a co-solvent an organic solvent having a boiling point of about 30° C. or over, preferably a boiling point in the range from 50° C. to about 160° C. can be used, and as typical example can be mentioned ethyl acetate, butyl acetate, ethyl propionate, methylethyl ketone, cyclohexanone, 2-rthoxyethyl acetate, and dimethyl formamide.

Specific examples of process and effects of latex dispersion method, and latices for impregnation are described in, for example, U.S. Pat. No. 4,199,363 and West German Patent Application (OLS) Nos 2,541,274 and 2,541,230.

In the photographic material of this invention, various antiseptics and antifungal agents, such as phenetyl alcohol, and 1,2-benzisothiazoline-3-one, n-butyl-p-hydroxybenzoate, phenol, 4-chloro-3,5-dimethylphenol, 2-phenoxyethanol, and 2-(4-thiazolyl)-bezimidazole as described in JP-A Nos. 257747/1988, 272248/1987, and 80941/1989 are preferably added.

The present invention can be adopted to various color photographic materials. Representative examples include a color negative film for general use or for cine, a color reversal film for slide or for television, a color paper, a color positive film, and a color reversal paper.

Suitable supports to be used in this invention are described in, for example, in the above-mentioned *Research Disclosure* No. 17643, page 28 and No. 18716, from page 647, right column to page 648, left column.

In the photographic material of the present invention, preferably the total layer thickness of all the hydrophilic colloid layers on the side having emulsion layers is 28 μm or below, more preferably 23 μm or below, further more preferably 20 μm or below, and particularly preferably 16 μm or below. Preferably the film swelling speed $T_{\frac{1}{2}}$ is 30 sec or below, more preferably 20 sec or below. The term "layer thickness" means layer thickness measured after moisture conditioning at 25° C. and a relative humidity of 55% for two days, and the film swelling speed $T_{\frac{1}{2}}$ can be measured in a manner known in the art. For example, the film swelling speed $T_{\frac{1}{2}}$ can be measured by using a swellometer (swell-measuring meter) of the type described by A. Green et al. in *Photographic Science and Engineering*, Vol. 19, No. 2, pp. 124–129, and $T_{\frac{1}{2}}$ is defined as the time required to reach a film thickness of ½ of the saturated film thickness that is 90% of the maximum swelled film thickness that will be reached when the film is treated with a color developer at 30° C. for 3 min 15 sec.

The film swelling speed $T_{\frac{1}{2}}$ can be adjusted by adding a hardening agent to the gelatin that is a binder or by changing the time conditions after the coating. Preferably the ratio of swelling is 150 to 400%. The ratio of swelling is calculated from the maximum swelled film thickness obtained under the above conditions according to the formula: (Maximum swelled film thickness —film thickness)/Film thickness.

It is preferable that the photographic material of the present invention is provided a hydrophilic layer (designated as a back layer) having a total dried layer thickness of 2 μm to 20 μm at the opposite side of having emulsion layers. In such layer, it is preferable to be contained the above-mentioned light-absorbent, filter-dye, UV-absorbent, static preventer, film-hardener, binder, plasticizer, lubricant, coating auxiliary, and surface-active agent. The ratio of swelling of back layer is preferably 150 to 500%.

The photographic material in accordance with the present invention can be subjected to the development processing by an ordinary method as described in the above-mentioned RD No. 17463, pp. 28–29, ibid. No. 18716, p. 651, from left column to right column, and ibid. No. 307105, pp. 880–881.

Preferably, the color developer used for the development processing of the photographic material of the present invention is an aqueous alkaline solution whose major component is an aromatic primary amine color-developing agent. As the color-developing agent, aminophenol compounds are useful, though p-phenylene diamine compounds are preferably used, and typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, and 3-methyl-4-amino-N-ethyl-N-β-methoxy line, and their sulfates, hydrochlorides, and p-toluenesulfonates. A combination of two or more of these compounds may be used in accordance with the purpose.

The color developer generally contains, for example, buffers, such as carbonates or phosphates of alkali metals, and development inhibitors or antifoggants, such as bromide salts, iodide salts, benzimidazoles, benzothiazoles, or mercapto compounds. The color developer may, if necessary, contain various preservatives, such as hydroxylamine, diethylhydroxylamine, sulfites, hydrazines for example N,N-biscarboxymethylhydrazine, phenylsemicarbazides, triethanolamine, and catecholsulfonic acids, organic solvents such as ethylene glycol and diethylene glycol, development accelerators such as benzyl alcohol, polyethylene glycol, quaternary ammonium salts, and amines, dye forming couplers, competing couplers, auxiliary developers such as 1-phenyl-3-pyrazolidone, tackifiers, and various chelate agents as represented by aminopolycarboxylic acids, aminopolyphosphonic acids, alkylphosphonic acids, and phosphonocarboxylic acids, typical example thereof being ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and their salts.

If reversal processing is carried out, it is common that after black and white development and reversal processing are carried out, the color development is carried out. As the black and white developers, known black and white developing agents, such as dihydroxybenzenes, for example hydroquinone, 3-pyrazolidones, for example 1-phenyl-3-pyrazolidone, and aminophenols, for example N-methyl-p-aminophenol, can be used alone or in combination. Generally the pH of this color developer and black-and-white developing solution is 9 to 12. The replenishing amount of these developing solutions is generally 3 liter or below per square meter of the color photographic material to be processed, though the replenishing amount changes depending on the type of color photographic material, and if the concentration of bromide ions in the replenishing solution is lowered previously, the replenishing amount can be lowered to 500 ml or below per square meter of the color photographic material. If it is intended to lower the replenishing amount, it is preferable to prevent the evaporation of the solution and oxidation of the solution with air by reducing the area of the solution in processing tank that is in contact with the air.

The contact area of the photographic processing solution with the air in the processing tank is represented by the opened surface ratio which is defined as follows:

$$\text{Opened surface ratio } (\text{cm}^{-1}) = \frac{\text{Contact surface area } (\text{cm}^2) \text{ of the processing solution with the air}}{\text{Whole volume } (\text{cm}^3) \text{ of the processing solution}}$$

wherein "contact surface area of the processing solution with the air" means a surface area of the processing solution that is not covered by anything such as floating lids or rolls.

The opened surface ratio is preferably 0.1 $\text{cm}^{-1}$ or less, more preferably 0.001 to 0.05 $\text{cm}^{-1}$. Methods for reducing the opened surface ratio that can be mentioned include a utilization of movable lids as described in JP-A No. 82033/1989 and a slit-developing process as described in JP-A No. 216050/1988, besides a method of providing a shutting materials such as floating lids. It is preferable to adopt the means for reducing the opened surface ratio not only in a color developing and black-and-white developing process but also in all succeeding processes, such as bleaching, bleach-fixing, fixing, washing, and stabilizing process. It is also possible to reduce the replenishing amount by using means of suppressing the accumulation of bromide ions in the developer.

Although the processing time of color developing is settled, in general, between 2 and 5 minutes, the time can be shortened by, for example, processing at high temperature and at high pH, and using a color developer having high concentration of color developing agent.

The photographic emulsion layer are generally subjected to a bleaching process after color development.

The beaching process can be carried out together with the fixing process (bleach-fixing process), or it can be carried out separately from the fixing process. Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. As the bleaching agent, use can be made of, for example, compounds of polyvalent metals, such as iron (III). As typical bleaching agent, use can be made of organic complex salts of iron (III), such as complex salts of aminopolycarboxylic acids, for example ethylenediaminetetraacetic acid, diethylenetriaminetetraacetic acid, cyclohexanediaminetetraacetic acid, methyliminodiacetic acid, 1,3-diaminopropanetetraacetic acid, and glycoletherdiaminetetraacetic acid, citric acie, tartaric acid, and malic acid. Of these, aminopolycarboxylic acid iron (III) complex salts, including ethylenediaminetetraacetic acid iron (III) complex salts are preferable in view of rapid-processing and the prevention of pollution problem. Further, aminopolycarboxylic acid iron (III) complex salts are particularly useful in a bleaching solution as well as a bleach-fixing solution. The pH of the bleaching solution or the bleach-fixing solution using these aminopolycarboxylic acid iron (III) complex salts is generally 4.0 to 8.0, by if it is required to quicken the process, the process can be effected at a low pH. The bleaching process shown in CN-16 is usually 6 min and 30 sec. A rapid processing in this invention means a processing which is carried out in a shorter time than the above. That is, it is, for example, preferably 20 sec to 5 min, more preferably 40 sec to 4 min.

In the bleaching solution, the bleach-fixing solution, and the bath preceding them a bleach-accelerating agent may be used if necessary. Examples of useful bleach-accelerating agents are compounds having a mercapto group or a disulfide linkage, described in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 4232/1978, 124424/1978, 141623/1978, and 28426/1978, and *Research Disclosure* No. 17129 (July, 1978); thiazolidine derivatives, described in JP-A No. 140129/1975; thiourea derivatives, described in JP-B No. 8506/1970, JP-A Nos. 20832/1977 and 32735/1978, and U.A. Patent No. 3,706,561; iodide salts, described in West German Patent No. 1,127,715 and JP-A No. 16235/1983; polyoxyethylene compounds in West German Patent Nos. 966,410 and 2,748,430; polyamine compounds, described in JP-B No. 8836/1970; other compounds, described in JP-A Nos. 40943/1974, 59644/1974, 94927/1978, 35727/1979, 26506/1980, and 163940/1983; and bromide ions. Of these, compounds having a mercapto group or a disulfide group are preferable in view of higher acceleration effect, and in particular, compounds described in U.A. Patent No. 3,893,858, West German Patent No. 1,290,812, and JP-A No. 95630/1978 are preferable. Further, compound described in U.S. Pat. No. 4,552,834 are preferable. These bleach-accelerating agents may be added into a photographic material. When the color photographic materials for photographing are to be bleach-fixed, these bleach-accelerating agents are particularly effective.

In addition to the above compounds, an organic acid is preferably contained in the bleach solution or bleach-fix solution in order to prevent bleach stain. A particularly preferable organic acid is a compound having an acid dissociation constant (pKa) of 2 to 5, and specifically, for example, acetic acid and propionic acid are preferable.

As a fixing agent to be used in the fixing solution and the bleach-fix solution, thiosulfates, thiocyanates, thioether compounds, thioureas, and large amounts of iodides can be mentioned, although thiocyanates are used generally, and particularly ammonium thiosulfate is used most widely. A combination, for example, of a thiosulfate with a thiocyanate, a thioether compound, or thiourea is also used preferably. As preservatives for the fixing solution or the bleach-fix solution, sulfites, bisulfites, carbonyl bisulfite adducts, and sulfinic acid compounds described in European Patent No. 294,769A are preferable. Further, in order to stabilize the fixing solution or the bleach-fix solution, the addition of various aminopolycarboxylic acids or organic phosphonic acids to the solution is preferable.

In the present invention, to the fixing solution or the bleach-fix solution, a compound having a pKa of 6.0 to 9.0, preferably an imidazole, such as imidazole, 1-methylimidazole, 1-ethylimidazole, and 2-methylimidazole, is added in an amount of 0.1 to 10 mol/l in order to adjust the pH.

The total period of the desilvering step is preferably made shorter within the range wherein silver retention will not occur. A preferable period is 1 to 3 min, more preferably 1 to 2 min. The processing temperature is 25° to 50° C., preferably 35° to 45° C. In a preferable temperature range, the desilvering speed is improved and the occurrence of stain after the processing can effectively be prevented.

In the desilvering step, preferably the stirring is intensified as far as possible. Specific methods for intensifying the stirring are a method described in JP-A No. 183460/1987, wherein a jet stream of a processing solution is applied to the emulsion surface of the photographic material; a method described in JP-A No. 183461/1987, wherein the stirring effect is increased by using a rotating means; a method wherein a photographic material is moved with a wiper blade placed in a solution in contact with the emulsion surface, to cause a turbulent flow to occur over the emulsion surface to improve the stirring effect, and a method wherein the amount of the circulating flow of the whole processing solution is increased. Such stirring improvement means are effective for any of the bleaching solution, the bleach-fix solution, and the fixing solution. The improvement of stirring seems to quicken the supply of the bleaching agent and the fixing agent to the emulsion coating, thereby bringing about an increase of the desilvering speed. The above stirring improvement means is more effective when a bleach accelerator is used and the means can increase the acceleration effect remarkably or can cancel the fixing inhibiting effect of the bleach accelerator.

Preferably, the automatic processor used for the present photographic material is provided with a photographic material conveying means described in JP-A Nos. 191257/1985, 191258/1985, and 191259/1985. As described in 191257/1985 mentioned above, such a conveying means can reduce extraordinarily the carry-in of the processing solution from one bath to the next bath, and therefore it is highly effective in preventing the performance of the processing solution from deteriorating. Such an effect is particularly effective in shortening the processing time in each step and in reducing the replenishing amount of the processing solution.

It is common for the silver halide color photographic material of the present invention to undergo, after a desilvering process such as fixing or bleach-fix, a washing step and/or a stabilizing step. The amount of washing water may be set within a wide range depending on the characteristics (e.g., due to the materials used, such as couplers), the application of the photographic material, the washing temperature, the number of washing tanks (the number if steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955).

According to the multi-stage-counter-current system described in the literature mentioned above, although the amount of washing water can be considerably reduced, bacteria propagate with an increase of retention time of the washing water in the tanks, leading to a problem with the resulting suspend matter adhering to the photographic material. In processing the present color photographic material, as a measure to solve this problem the method of reducing calcium and magnesium described in JP-A No. 288838/1987 can be used quite effectively. Also chlorine-type bactericides such as sodium chlorinated isocyanurate, cyabendazoles, isothiazolone compounds described in JP-A No. 8542/1982, benzotriazoles, and other bactericides described by Hiroshi Horiguchi in *Bokin Bobai-zai no Kacaku*, (1986) published by Sankyo-Shuppan, *Biseibutsu no mekkin, Sakkin, Bobaiciiutsu* (1982) edited by Eiseigijutsu-kai, published by Kogyo-Gijutsu-kai, and in *Bokin Bobaizai Jiten* (1986) edited by Nihon Bokin Bobai-gakkai), can be used.

The pH of the washing water used in processing the present photographic material is 4 to 9, preferably 5 to 8. The washing water temperature and the washing time to be set may vary depending, for example, on the characteristics and the application of the photographic material, and they are generally selected in the range of 15° to 45° C. for sec to 10 min, and preferably in the range of 25° to 40° C. for 30 sec to 5 min. Further, the photographic material of the present invention can be processed directly with a stabilizing solution instead of the above washing. In such a stabilizing process, any of known processes, for example, a multi-step counter-current stabilizing process or its low-replenishing-amount process, described in JP-A Nos. 8543/1982, 14834/1983, and 220345/1985 can be used.

In some cases, the above washing process is further followed by stabilizing process, and as an example thereof can be mentioned a stabilizing bath that is used as a final bath for color photographic materials for photography, which contains a dye-stabilizing agent and a surface-active agent. As an example of dye-stabilizing agent can be mentioned aldehyde (e.g., formalin and gulaldehyde), N-methylol compound, hexamethylenetetramine and aldehyde-sulfite adduct. In this stabilizing bath, each kind of the chelating agents and bactericides may be added.

The over-flowed solution due to the replenishing of washing solution and/or stabilizing solution may be reused in other steps, such as a desilvering step.

When each of the above-mentioned processing solutions is concentrated due to the evaporation of water in the processing using an automatic processor, preferably water to correct the concentration is added into each solution.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

Further, the silver halide photographic material of the present invention can be adopted to photographic materials for heat development described in, for example, U.S. Pat. No. 4,500,626, JP-A Nos. 133449/1985, 218443/1984, and 23805/1986, and European Patent No. 210,660A2.

According to the present invention, the processing stain and the stain with the lapse of time of silver halide color photographic material can be restrained even if it is developed by a rapid and low replenishing processing. In particular, the occurrence of yellow stain and cyan stain in both a print immediately after processing and a print after storaged for a long time can be restrained.

Next, the present invention will be described in detail in accordance with examples, but the invention is not limited to them.

EXAMPLE 1

A multilayer color photographic material sample 101 was prepared by multi-coating each layer having a composition as shown below on a prime-coated triacetate cellulose film base.

Composition of photosensitive layer

Figure corresponding to each component is indicated in a coating amount of g/m$^2$, but the coating amount of silver halide emulsion is indicated in terms of silver. For sensitizing dye, the coating amount is indicated in mol per mol of silver halide in the same layer.

| | |
|---|---|
| (Sample 101) | |
| First layer (Halation preventing layer) | |
| Black colloidal silver | 0.18 |
| Gelatin | 1.40 |
| Second layer (Intermediate layer) | |
| 2,5-Di-t-pentadecylhyiroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (First red-sensitive emulsion layer) | |
| Emulsion A silver | 0.25 |
| Emulsion B silver | 0.25 |
| Sensitizing dye I | $6.9 \times 10^{-5}$ |
| Sensitizing dye II | $1.8 \times 10^{-5}$ |

-continued

| | |
|---|---|
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (Second red-sensitive emulsion layer) | |
| Emulsion G silver | 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| EX-3 | 0.050 |
| EX-10 | 0.015 |
| EX-14 | 0.20 |
| EX-15 | 0.050 |
| U-1 | 0.070 |
| U-2 | 0.050 |
| U-3 | 0.070 |
| Gelatin | 1.30 |
| Fifth layer (Third red-sensitive emulsion layer) | |
| Emulsion D silver | 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (Intermediate layer) | |
| EX-5 | 0.040 |
| HBS-1 | 0.020 |
| Gelatin | 0.80 |
| Seventh layer (First green-sensitive emulsion layer) | |
| Emulsion A silver | 0.15 |
| Emulsion B silver | 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth layer (Second green-sensitive emulsion layer) | |
| Emulsion C silver | 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth layer (Third green-sensitive emulsion layer) | |
| Emulsion E silver | 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Tenth layer (Yellow filter layer) | |
| Yellow colloidal silver | 0.050 |

-continued

| | |
|---|---|
| EX-5 | 0.080 |
| HBS-1 | 0.030 |
| Gelatin | 0.95 |
| Eleventh layer (First blue-sensitive emulsion layer) | |
| Emulsion A silver | 0.080 |
| Emulsion B silver | 0.070 |
| Emulsion F silver | 0.070 |
| Sensitizing dye VII | $3.5 \times 10^{-4}$ |
| EX-8 | 0.042 |
| YC-1 | 0.74 |
| HBS-1 | 0.28 |
| Gelatin | 1.10 |
| Twelfth layer (Second blue-sensitive emulsion layer) | |
| Emulsion G silver | 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |
| Gelatin | 0.78 |
| Thirteenth layer (Third blue-sensitive emulsion layer) | |
| Emulsion H silver | 0.77 |
| Sensitizing dye VII | $2.2 \times 10^{-4}$ |
| EX-9 | 0.20 |
| HBS-1 | 0.070 |
| Gelatin | 0.69 |

-continued

| | |
|---|---|
| Fourteenth layer (First protective layer) | |
| Emulsion I silver | 0.20 |
| U-4 | 0.11 |
| U-5 | 0.17 |
| HBS-1 | $5.0 \times 10^{-2}$ |
| Gelatin | 1.00 |
| Fifteenth layer (Second protective layer) | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| S-1 | 0.20 |
| Gelatin | 1.20 |

Further, in order to improve preservability, processability, pressure-resistant, antifungal and antibacterial property, antistatic property, and coating property, W-1, W-2, W-3, B-4, B-5, F-1, F-2, F-3, F-4, F-5, F-6, F-7, F-8, F-9, F-10, F-11, F-12, F-13, and salts of iron, lead, gold, platinum, iridium and rhodium were included in all layers.

Silver iodobromide Emulsions A to I are as shown below.

| | Average AgI content (%) | Grain Size: Average Diameter (μm) | Grain Size: Deviation coefficient (%) | Ratio of Diameter/Thickness | Ratio of silver amount (AgI content %) | |
|---|---|---|---|---|---|---|
| Emulsion A | 4.0 | 0.45 | 27 | 1 | Core/Shell = 1/3 (13/1) | Double Structure Grains |
| Emulsion B | 8.9 | 0.70 | 14 | 1 | Core/Shell = 3/7 (25/2) | Double Structure Grains |
| Emulsion C | 10 | 0.75 | 30 | 2 | Core/Shell = 1/2 (24/3) | Double Structure Grains |
| Emulsion D | 16 | 1.05 | 35 | 2 | Core/Shell = 4/6 (40/0) | Double Structure Grains |
| Emulsion E | 10 | 1.05 | 35 | 3 | Core/Shell = 1/2 (24/3) | Double Structure Grains |
| Emulsion F | 4.0 | 0.25 | 28 | 1 | Core/Shell = 1/3 (13/1) | Double Structure Grains |
| Emulsion G | 14.0 | 0.75 | 25 | 2 | Core/Shell = 1/2 (42/0) | Double Structure Grains |
| Emulsion H | 14.5 | 1.30 | 25 | 3 | Core/Shell = 37/63 (34/3) | Double Structure Grains |
| Emulsion I | 1 | 0.07 | 15 | 1 | Uniform Grains | |

Structures of compounds used in Sample 101 are shown below.

EX-1

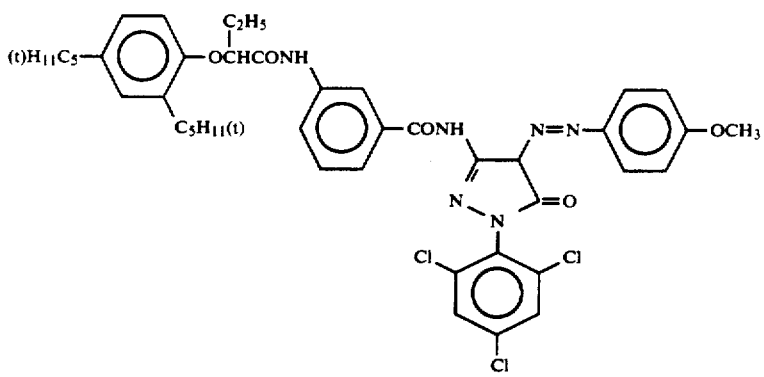

EX-2

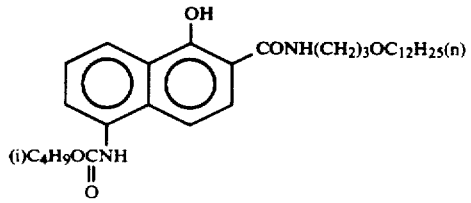

-continued
EX-3
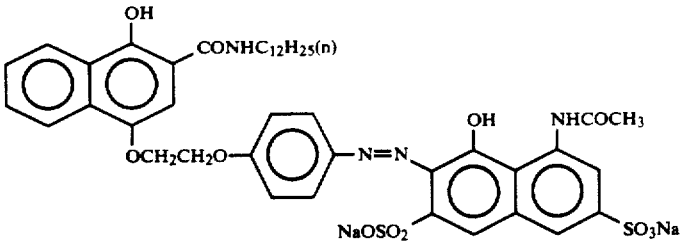
EX-4
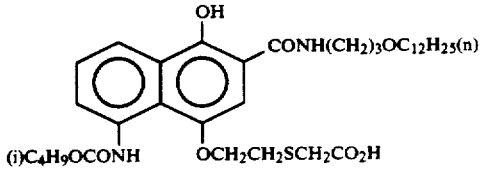
EX-5
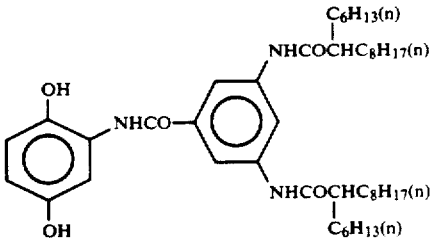
EX-6
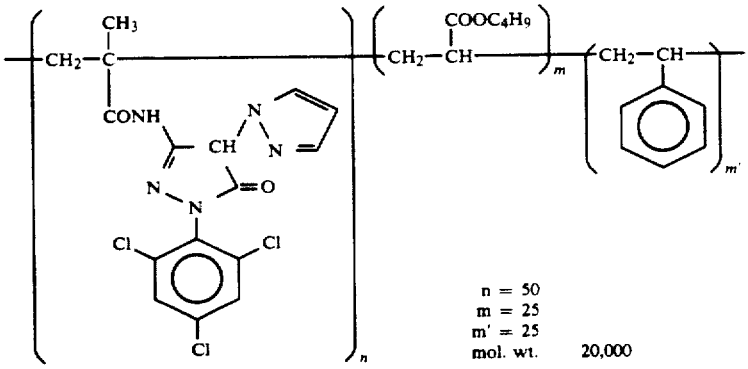
EX-7
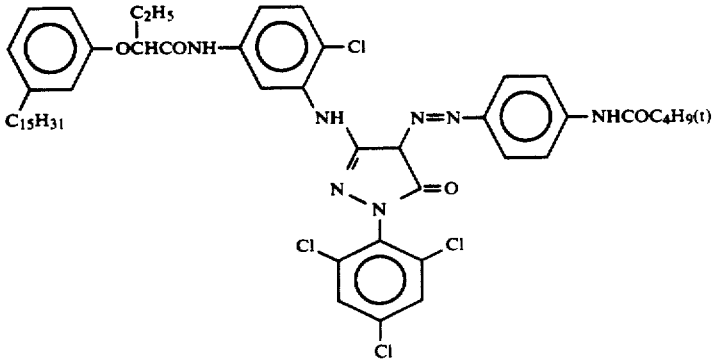

-continued
EX-8
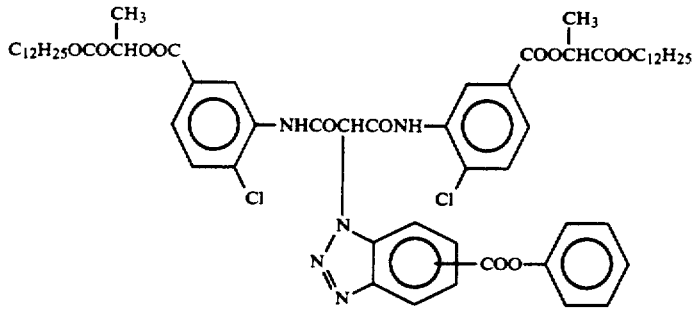
EX-9
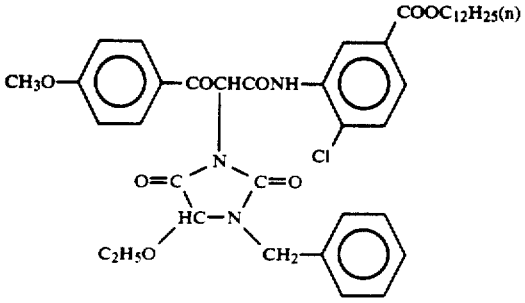
EX-10
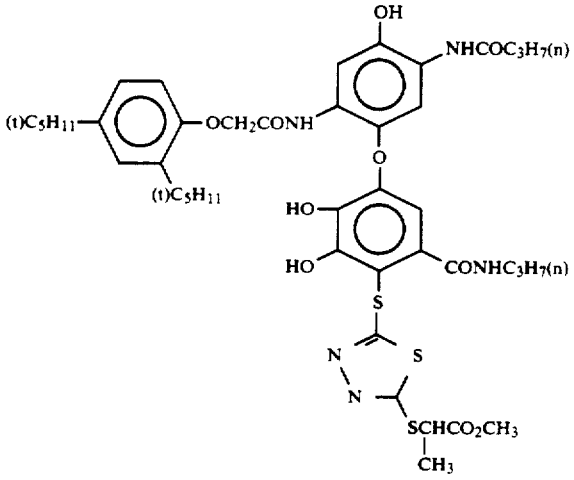
EX-11
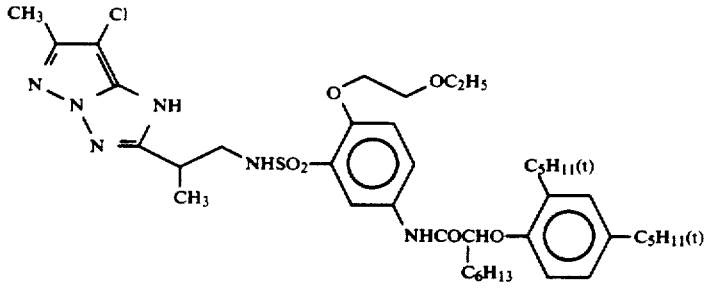
EX-12
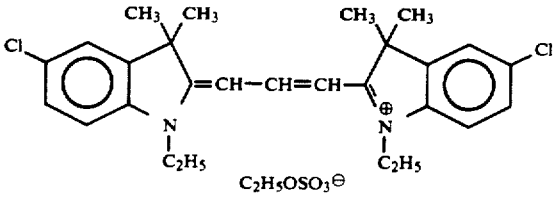

-continued
EX-13
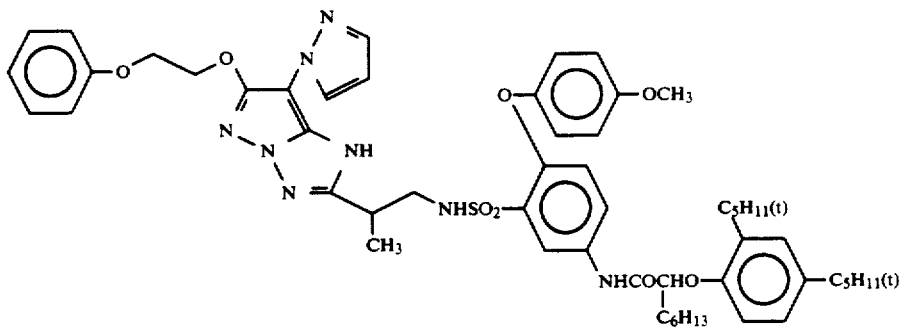
EX-14
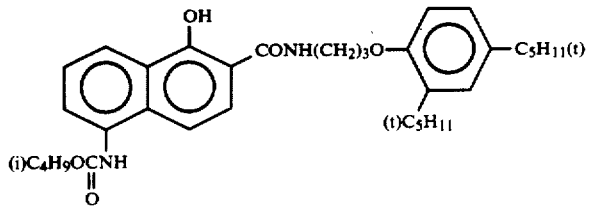
EX-15
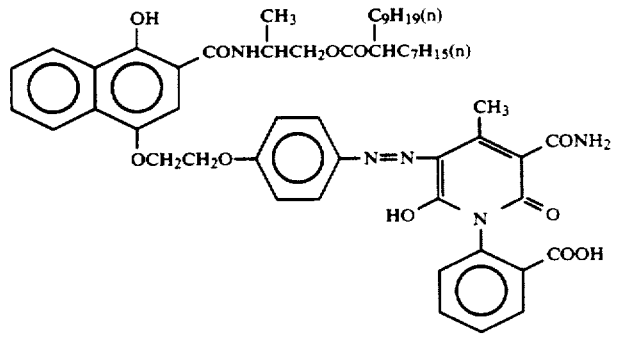
U-1
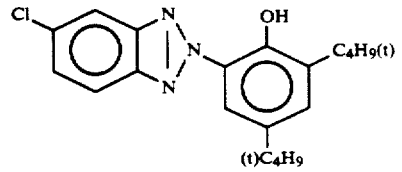
U-2
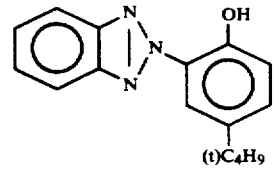
U-3
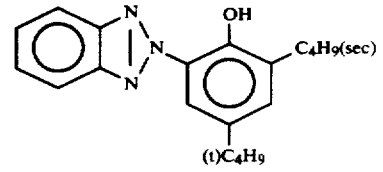

-continued
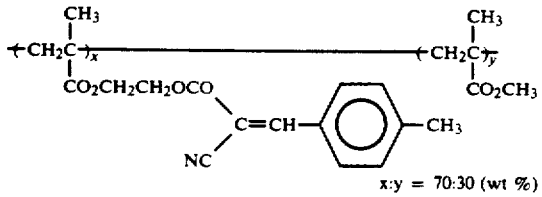
U-4
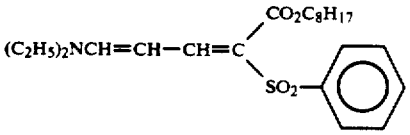
U-5
Tricresyl phosphate — HBS-1
Di-n-butyl phthalate — HBS-2
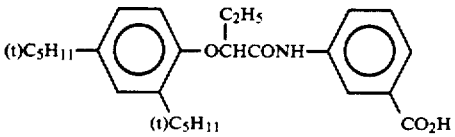
HBS-3
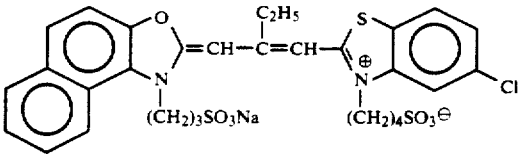
Sensitizing dye I
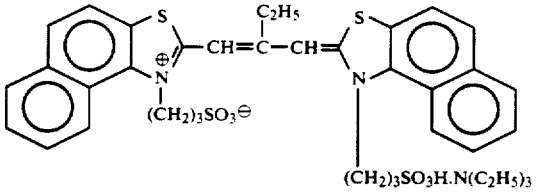
Sensitizing dye II
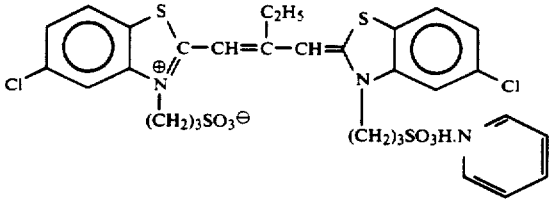
Sensitizing dye III
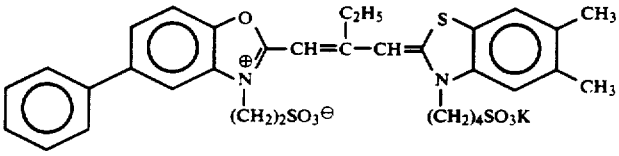
Sensitizing dye IV
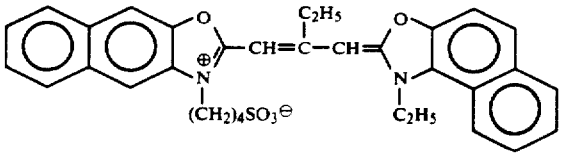
Sensitizing dye V -continued
Sensitizing dye VI
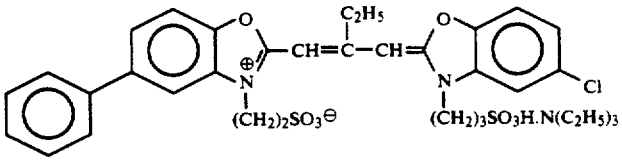
Sensitizing dye VII
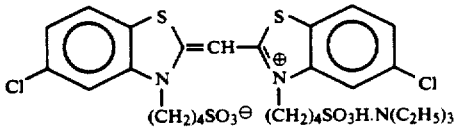
S-1
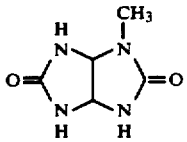
H-1
$CH_2{=}CH{-}SO_2{-}CH_2{-}CONH{-}CH_2$
$CH_2{=}CH{-}SO_2{-}CH_2{-}CONH{-}CH_2$
B-1
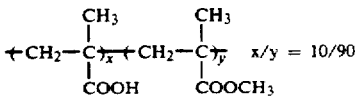
x/y = 10/90
B-2
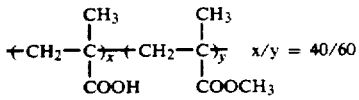
x/y = 40/60
B-3
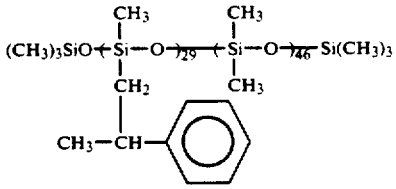
B-4
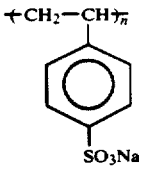
B-5
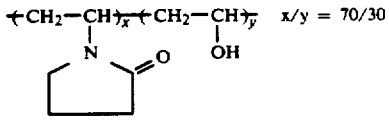
x/y = 70/30
W-1
$C_8F_{17}SO_2NHCH_2CH_2CH_2OCH_2CH_2\overset{\oplus}{N}(CH_3)_3$
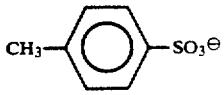
W-2
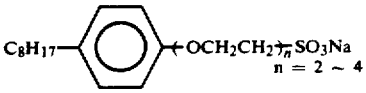
n = 2 ~ 4

-continued
W-3
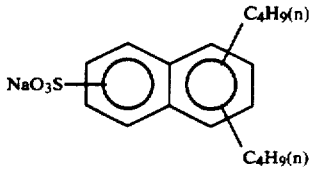
F-1
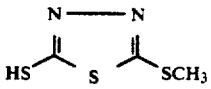
F-2
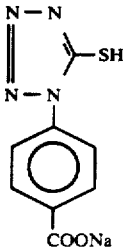
F-3
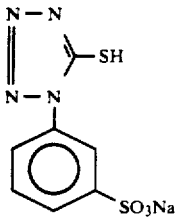
F-4
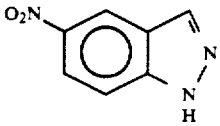
F-5
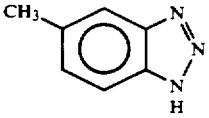
F-6
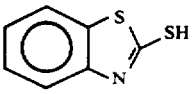
F-7
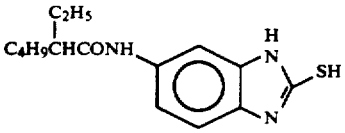
F-8
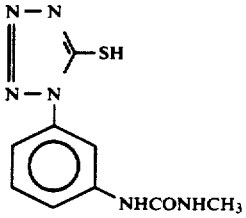
F-9
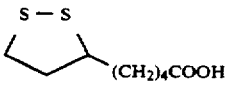

-continued

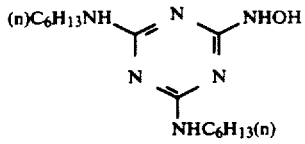

F-10

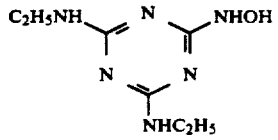

F-11

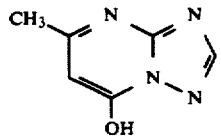

F-12

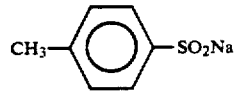

F-13

Preparation of Samples 102 to 111

Samples 102 to 111 were prepared in the same manner as Example 101, except that cyan couplers Ex-2, Ex-4, and Ex-14, high-boiling organic solvents HBS-1 and HBS-2 in the third layer, the fourth layer, and the fifth layer, and the yellow coupler Ex-9 and the high-boiling organic solvent HBS-1 in the eleventh layer, the twelfth layer, and the thirteenth layer were changed as shown in Table 1, respectively, and each amount of gelatin in the eleventh layer, the twelfth layer, and the thirteenth layer was controlled so that the ratio of total amount of couplers and high-boiling organic solvents to the amount of gelatin would be equal to that in Sample 101.

CY-1, CY-2, and Oil-1 in Table 1 are shown in the note of the Table.

Evaluation of processing stain and stain with the lapse of time

Before the development processing for evaluation, each of Samples 101 to 111 was cut into 35 mm width strip. Then each Sample was exposed to light image-wise and was subjected to a continuous processing (running test) by an automatic processor in accordance with the processing process shown below, until the accumulated replenishing amount of the bleaching solution reached two times the tank volume. Each of samples 101 to 10 111 was processed by amount by same amount.

Then Samples 101 to 111 were exposed to light through a wedge and were subjected to development processing using processing solutions after the finishing of running test, followed by determination of color density of processed Samples. Processing stain was evaluated by the density of minimum density part of magenta color, Dmin (magenta). After the evaluation of processing stain, Samples were allowed to stand at 60° C. and 70% RH for 5 days to evaluate the stain with the lapse of time. An increment of magenta density (density at minimum density part after the elapse of time minus density at minimum density part immediately after processing) was used as the scale of stain with the lapse of time. Yellow stains were evaluated in the same manner. Results are shown in Table 1.

| Processing steps | Processing process A Time | Temperature | Replenishing Amount | Tank Volume |
|---|---|---|---|---|
| Color developing | 3 min 15 sec | 37.8° C. | 25 ml | 10 liter |
| Bleaching | 45 sec | 38.0° C. | 5 ml | 5 liter |
| Fixing (1) | 45 sec | 38.0° C. | — | 5 liter |
| Fixing (2) | 45 sec | 38.0° C. | 30 ml | 5 liter |
| Stabilizing (1) | 15 sec | 38.0° C. | — | 5 liter |
| Stabilizing (2) | 15 sec | 38.0° C. | — | 5 liter |
| Stabilizing (3) | 15 sec | 38.0° C. | 35 ml | 5 liter |
| Drying | 1 min | 55° C. | | |

Note:
Replenishing amount: ml per 1 meter length × 35 mm width
Fixing steps: Countercurrent mode from (2) to (1)
Stabilizing steps: Counter current mode from (3) to (1)

The amount of developer carried over to the bleaching step and the amount of fixing solution carried over to the stabilizing step were 2.5 ml and 2.0 ml, per 1 meter length ×35 mm width of photographic material, respectively.

The compositions of the respective processing solution were as follows:

| | Mother Solution (g) | Replenisher (g) |
|---|---|---|
| (Color developer) | | |
| Diethylenetriaminepetaacetic acid | 5.0 | 6.0 |
| Sodium sulfite | 4.0 | 5.0 |
| Potassium carbonate | 30.0 | 37.0 |
| Potassium bromide | 1.3 | 0.5 |
| Potassium iodide | 1.2 mg | — |
| Hydroxylamine sulfate | 2.0 | 3.6 |
| 4-[N-Ethyl-N-β-hydroxyethylamino]-2-methylaniline sulfate | 4.7 | 6.2 |
| Water to make | 1.0 liter | 1.0 liter |
| pH | 10.00 | 10.15 |
| (Bleaching solution) | | |

-continued

| | | |
|---|---|---|
| Iron (III) ammonium 1,3-diamino-propanetetraacetate monohydrate | 144.0 | 206.0 |
| 1,3-Diaminopropanetetraacetic acid | 2.8 | 4.0 |
| Ammonium bromide | 84.0 | 120.0 |
| Ammonium nitrate | 17.5 | 25.0 |
| Aqueous ammonia (27%) | 10.0 | 1.8 |
| Acetic acid (98%) | 46.0 | 65.7 |
| Water to make | 1.0 liter | 1.0 liter |
| pH | 4.8 | 3.4 |

(Fixing solution)

| (Both mother solution and replenishing solution) (g) | |
|---|---|
| Disodium ethylenediaminetetraacetate | 1.7 |
| Sodium sulfite | 14.0 |
| Sodium bisulfite | 10.0 |
| Ammonium thiosulfate (70% w/v) | 210.0 ml |
| Ammonium thiocyanate | 163.0 |
| Thiourea | 1.8 |
| Water to make | 1.0 liter |
| pH | 6.5 |

(Stabilizing solution)

| (Both mother solution and replenishing solution) (g) | |
|---|---|
| Surfactant SUR-1 | 0.5 |
| Surfactant SUR-2 | 0.4 |

-continued

| | |
|---|---|
| Triethanolamine | 2.0 |
| 1,2-Benzisothiazoline-3-one-methanol | 0.3 |
| Formalin (37%) | 1.5 |
| Water to make | 1.0 liter |
| pH | 6.5 |

The structural formula of surfactants SUR-1 and SUR-2 are as follows:

Surfactant SUR-1

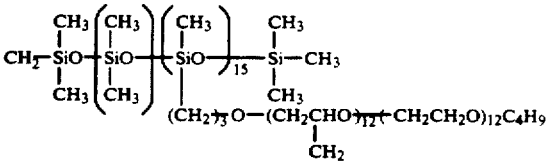

Surfactant SUR-1

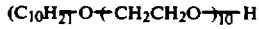

TABLE 1

| Sample No. | Third layer | | | Fourth layer | | | Fifth layer | | Eleventh layer | |
|---|---|---|---|---|---|---|---|---|---|---|
| 101 | Ex-2 | Ex-14 | HBS-1 | Ex-2 | Ex-14 | Ex-2 | Ex-4 | HBS-1 HBS-2 | Ex-9 | HBS-1 |
| 102 | Ex-2 | Ex-14 | HBS-1 | Ex-2 | Ex-14 | Ex-2 | Ex-4 | HBS-1 HBS-2 | Y-16 (0.9) | HBS-1 (0.4) |
| 103 | Ex-2 | Ex-14 | HBS-1 | Ex-2 | Ex-14 | Ex-2 | Ex-4 | HBS-1 HBS-2 | Y-16 (0.9) | HBS-1 (0.4) |
| 104 | Ex-2 | Ex-14 | HBS-1 | Ex-2 | Ex-14 | Ex-2 | Ex-4 | HBS-1 HBS-2 | Y-16 (0.9) | — |
| 105 | Ex-2 | Ex-14 | HBS-1 | Ex-2 | Ex-14 | Ex-2 | Ex-4 | HBS-1 HBS-2 | Y-15 (0.9) | HBS-1 (0.5) |
| 106 | Ex-2 | Ex-14 | HBS-1 | Ex-2 | Ex-14 | Ex-2 | Ex-4 | HBS-1 HBS-2 | Y-39 | HBS-1 (0.5) |
| 107 | IIC-5 | IIC-5 | HBS-1 | IIIC-4 | Ex-14 | IIIC-4 | IIC-35 | HBS-1 HBS-2 | Y-39 | HBS-1 (0.5) |
| 108 | IIIC-14 (0.8) | IIIC-1 | Oil-1 | IIIC-14 (0.8) | IIIC-1 | IIIC-14 (0.8) | Ex-4 | HBS-2 | Y-16 (0.9) | HBS-1 (0.4) |
| 109 | IIIC-14 (0.8) | IIIC-1 | Oil-1 | IIIC-14 (0.8) | IIIC-1 | IIIC-14 (0.8) | IIIC-9 | HBS-1 HBS-2 | Y-16 (0.9) | HBS-1 (0.4) |
| 110 | CY-1 | CY-1 | HBS-1 | CY-1 | CY-1 | CY-1 | CY-2 | HBS-1 HBS-2 | Y-16 (0.9) | HBS-1 (0.4) |
| 111 | CY-1 | CY-1 | HBS-1 | CY-1 | CY-1 | CY-1 | CY-2 | HBS-1 HBS-2 | Ex-9 | HBS-1 |

| Sample No. | Twelfth layer | | Thirteenth layer | | Dmin (magenta) Immediately after processing | Dmin (magenta) After elapse of time | Dmin (yellow) Immediately after processing | Dmin (yellow) After elapse of time | Remarks |
|---|---|---|---|---|---|---|---|---|---|
| 101 | Ex-9 | HBS-1 | Ex-9 | HBS-1 | 0.59 | +0.10 | 0.90 | +0.09 | Comparative example |
| 102 | Ex-9 | HBS-1 | Ex-9 | HBS-1 | 0.56 | +0.05 | 0.86 | +0.05 | This invention |
| 103 | Y-16 (0.9) | HBS-1 (0.4) | Y-16 (0.9) | HBS-1 (0.4) | 0.56 | +0.04 | 0.84 | +0.03 | This invention |
| 104 | Y-16 (0.95) | — | Y-16 (0.95) | — | 0.55 | +0.02 | 0.82 | +0.02 | This invention |
| 105 | Y-16 (0.9) | HBS-1 (0.5) | Y-15 (0.9) | HBS-1 (0.5) | 0.56 | +0.04 | 0.83 | +0.03 | This invention |
| 106 | Y-39 | HBS-1 (0.5) | Y-39 | HBS-1 (0.5) | 0.56 | +0.03 | 0.83 | +0.03 | This invention |
| 107 | Y-39 | HBS-1 (0.5) | Y-39 | HBS-1 (0.5) | 0.55 | +0.04 | 0.82 | +0.03 | This invention |
| 108 | Y-16 (0.9) | HBS-1 (0.4) | Y-16 (0.9) | HBS-1 (0.4) | 0.56 | +0.03 | 0.83 | +0.03 | This invention |
| 109 | Y-16 (0.9) | HBS-1 (0.4) | Y-16 (0.9) | HBS-1 (0.4) | 0.56 | +0.04 | 0.83 | +0.03 | This invention |
| 110 | Y-16 (0.9) | HBS-1 (0.4) | Y-16 (0.9) | HBS-1 (0.4) | 0.62 | +0.07 | 0.92 | +0.08 | Comparative example |
| 111 | Ex-9 | HBS-1 | Ex-9 | HBS-1 | 0.64 | +0.12 | 0.94 | +0.11 | Comparative |

TABLE 1-continued example

Note:
(1) In the Table, as far as there is no particular description under the designated compound, the amount added of coupler was an equimolar amount to that of Sample 101, and the amount added of high-boiling organic solvent was the same weight as that of Sample 101. The figure in parenthesis under the designated compound represents a ratio of added amount to the equimolar amount (coupler) or a ratio of added amount to the same weight (high-boiling organic solvent).
(2) Methods for evaluating the processing stain and the stain with lapse of time are shown in the description.

CY-1

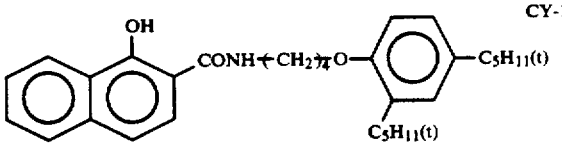

Mixture (1:1 in molar ratio) of CY-2

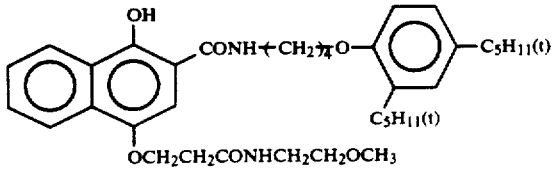

and

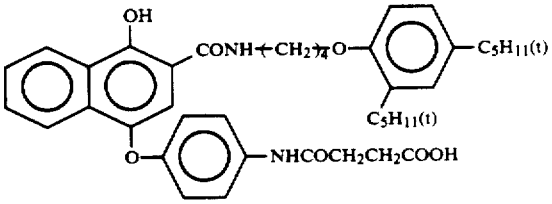

Mixture (9:1 in weight ratio) of Oil-1

Di-n-butyl phthalate and $n\text{-}C_{11}H_{23}CON(C_2H_5)_2$

As is apparent from the results in Table 1, in Sample 101 in which only the cyan coupler of the present invention is used, although the processing stain is decreased to some degree, the stain with the lapse of time is scarcely improved, compared with Sample 111 in which both cyan coupler and yellow coupler of the present invention are not used. Further, in Sample 101 in which only the yellow coupler of the present invention is used the improvement of the processing stain is little though the stain with the lapse of time is improved in some degree.

On the contrary, when both the yellow coupler and the cyan coupler of the present invention are used, both processing stain and stain with the lapse of time are remarkably improved. In particular, effects that the magenta stain is improved by the combination of yellow coupler and cyan coupler, and that the yellow stain is improved by the change of only cyan coupler are unexpected from the conventional knowledge. In addition, the colored dye of the yellow coupler of the present invention gave particularly preferable absorption spectrum.

The function and effect of the present invention is assumed as follows:

In the combination with a conventional yellow coupler or a conventional cyan coupler, so-called stain occurs because the incorporation of color-developing agent into the emulsion of these coupler during the development processing and the remaining color-developing agent in a swollen film layer is oxidized by an oxidant during a desilvering process to form a dye together with the unreacted yellow coupler or cyan coupler, and stains occur by air oxidation with the lapse of time.

When both the yellow coupler and the cyan coupler of the present invention are used, the incorporation of color-developing agent during the development processing is decreased which leads not only the decrease of stain immediately after development processing but also the maintaining stain at a low level for the lapse of long time.

EXAMPLE 2

Similar effect to that of Example 1 in the present invention was confirmed by the same experiment as in Example 1, except that the processing was carried out according to the following Processing process B:

| | Processing process B | | | |
|---|---|---|---|---|
| Processing steps | Time | Temperature | Replenishing Amount | Tank Volume |
| Color developing | 3 min 5 sec | 38.0° C. | 600 ml | 5 liter |
| Bleaching | 50 sec | 38.0° C. | 140 ml | 3 liter |
| Bleach-fixing | 50 sec | 38.0° C. | — | 3 liter |
| Fixing | 50 sec | 38.0° C. | 420 ml | 3 liter |
| Water-washing | 30 sec | 38.0° C. | 980 ml | 2 liter |
| Stabilizing (1) | 20 sec | 38.0° C. | — | 2 liter |
| Stabilizing (2) | 20 sec | 38.0° C. | 560 ml | 2 liter |
| Drying | 1 min | 60° C. | | |

Note: Replenishing amount: ml per 1 $m^2$ of photographic material

Stabilizing steps were carried out in a countercurrent mode from the tank (2) to the tank (1), and all of the over-flowed solutions of washing water was introduced to the fixing bath. The replenishing to the bleach-fixing bath was conducted by connecting the upper part of bleaching tank in the automatic processor to the bottom part of bleach-fixing tank with a pipe and by connecting the upper part of fixing tank to the bottom part of bleach-fixing tank with another pipe, so as to flow all of the over-flowed solutions evolved by supplying replenishers to the bleaching bath and the fixing bath into the bleach-fixing bath. The amount of developer carried over to the bleaching step, the amount of bleaching solution carried over to the bleach-fixing step, the amount of bleach-fixing solution carried over to the fixing step, and the amount of fixing solution carried over to the water washing step are 65 ml, 50 ml, 50 ml, and 50 ml, respectively, per square meter of photographic material. Times of cross-over are each 5 sec, which is involved in the time of the preceding step.

The compositions of the respective processing solution were as follows:

| | Mother Solution | Replenisher |
|---|---|---|

-continued

| | (g) | (g) |
|---|---|---|
| (Color developer) | | |
| Diethylenetriaminepetaacetic acid | 2.0 | 2.2 |
| 1-Hydroxyethylidene-1,1-di-phosphonic acid | 3.3 | 3.3 |
| Sodium sulfite | 3.9 | 5.2 |
| Potassium carbonate | 37.5 | 39.0 |
| Potassium bromide | 1.4 | 0.5 |
| Potassium iodide | 1.3 mg | — |
| Hydroxylamine sulfate | 2.4 | 3.3 |
| 2-Methyl-4-[N-ethyl-N-βhydroxy-ethylamino]aniline sulfate | 4.5 | 6.0 |
| Water to make | 1.0 liter | 1.0 liter |
| pH | 10.05 | 10.15 |
| (Bleaching solution) | | |
| Iron (III) ammonium 1,3-propylene-diaminetetraacetate monohydrate | 144.0 | 206.0 |
| Ammonium bromide | 84.0 | 120.0 |
| Ammonium nitrate | 17.5 | 25.0 |
| Hydroxy acetic acid | 63.0 | 90.0 |
| Acetic acid (98%) | 54.2 | 80.0 |
| Water to make | 1.0 liter | 1.0 liter |
| pH | 3.80 | 3.60 |

Mother solution of bleach-fixing solution

A mixture of the above mother solution of bleaching solution and the following mother solution of fixing solution in a ratio of 15:85 was used.

| | Mother Solution (g) | Replenisher (g) |
|---|---|---|
| (Fixing solution) | | |
| Ammonium sulfite | 19.0 | 57.0 |
| Aqueous solution of ammonium thiosulfate (700 g/l) | 280 ml | 840 ml |
| Imidazole | 28.5 | 85.5 |
| Ethylenediaminetetraacetic acid | 12.5 | 37.5 |
| Water to make | 1.0 liter | 1.0 liter |
| pH | 7.40 | 7.45 |

Water washing solution

Mother solution and replenisher are the same

Tap water was treated by passage through hybrid-type column filled with an H-type strong acidic cation-exchange resin (Amberlite IR-120B, tradename, made by Rohm & Haas) and an OH-type strong alkaline anion-exchange resin (Amberlite IR-400, tradename, made by the same as the above) so as to make the concentrations of calcium ions and magnesium ions 3 mg/l or less. Then 20 mg/l of sodium dichloroisocyanurate and 150 mg of sodium sulfate were added. The pH of the solution was in a range of 6.5 to 7.5.

| (Stabilizing solution) (Mother solution and replenisher are the same) | (g) |
|---|---|
| Formalin (37%) | 1.2 ml |
| (av. degree of polymerization: 10) | 0.2 |
| Disodium ethylendiaminetetraacetate | 0.05 |
| Water to make | 1.0 liter |
| pH | 7.2 |

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide color photographic material having at least one red-sensitive silver halide emulsion layer, at least one green-sensitive silver halide emulsion layer, and at least one blue-sensitive silver halide emulsion layer on a support, which comprises, in at least one of said blue-sensitive silver halide emulsion layer, at least one coupler selected from an acylacetamide yellow dye-forming coupler represented by the following formula (I) and, in at least one of said red-sensitive silver halide emulsion layer, at least one coupler selected from the group consisting of cyan dye-forming couplers represented by the following formula (II) or (III):

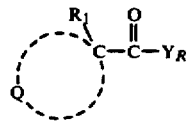

Formula (I)

wherein $R_1$ represents a monovalent group, Q represents a group of non-metallic atoms required to form together with the C a substituted or unsubstituted 3- to 5-membered cyclic hydrocarbon group or a substituted or unsubstituted 3- to 5-membered heterocyclic group having therein at least one heteroatom selected from a group consisting of N, O, S, and P, and $Y_R$ represents a residue remaining after removing the acyl group

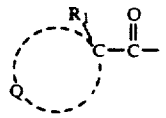

from the acylacetamide yellow dye-forming coupler represented by formula (I), provided that $R_1$ is not a hydrogen atom and does not bond to Q to form a ring,

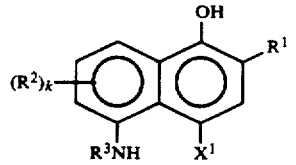

Formula (II)

wherein $R^1$ represents $—CONR^4R^5$, $—SO_2NR^4R^5$, $—NHCOR^4$, $—NHCOOR^6$, $—NHSO_2R^6$, $—NHCONR^4R^5$, or $—NHSO_2NR^4R^5$; $R^2$ represents a group capable of substitution on a naphthalene ring; k is an integer of 0 to 3; $R^3$ represents a substituent, $X^1$ represents a hydrogen atom or a group capable of being released upon a coupling reaction thereof with the oxidized product of an aromatic primary amine developing agent; $R^4$ and $R^5$, which may be the same or different, each independently represent a hydrogen atom, an alkyl group, an aryl group, or a heterocyclic group; $R^6$ represents an alkyl group, an aryl group, or a heterocyclic group; when k is 2 or more, the $R^2$ groups may be the same or different and may bond together to form a ring; and the compound may form a dimer or higher polymer formed by bonding through a divalent group or higher polyvalent group at $R^1$, $R^2$, $R^3$, or $X^1$, Formula (III)

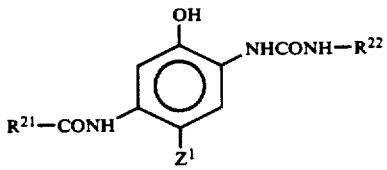

wherein $R^{21}$ represents an alkyl group, an aryl group, or a heterocyclic group, $R^{22}$ represents an aryl group, and $Z^1$ represents a hydrogen atom or a group capable of being released upon a coupling reaction thereof with the oxidized product of an aromatic primary amine developing agent.

2. The silver halide color photographic material as claimed in claim 1, wherein the red-sensitive silver halide emulsion layer contains the cyan dye-forming coupler represented by formula (II).

3. The silver halide color photographic material as claimed in claim 1, wherein the red-sensitive silver halide emulsion layer contains the cyan dye-forming coupler represented by formula (III).

4. The silver halide color photographic material as claimed in claim 1, wherein the acetylacetamide yellow dye-forming coupler is represented by the following formula (Y):

Formula (Y)

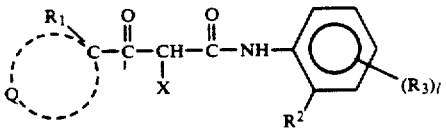

wherein $R_1$ represents a monovalent substituent other than hydrogen; Q represents a group of non-metallic atoms required to form together with the C a substituted or unsubstituted 3- to 5-membered cyclic hydrocarbon group or a substituted or unsubstituted 3- to 5-membered heterocyclic group having in the group at least one heteroatom selected from a group consisting of N, O, S, and P; $R_2$ represents a hydrogen atom, a halogen atom, an alkoxy group, an aryloxy group, an alkyl group, or an amino group, $R_3$ represents a group capable of substitution onto a benzene ring, X represents a group capable of being released upon a coupling reaction thereof with the oxidized product of an aromatic primary amine developing agent, l is an integer of 0 to 4, and when l is 2 or more, the $R_3$ groups may be the same or different.

5. The silver halide color photographic material as claimed in claim 1, wherein $R_1$ in formula (I) is selected from a group consisting of alkyl groups having a total C-number of 1 to 5.

6. The silver halide color photographic material as claimed in claim 1, wherein $R_1$ in formula (I) is a methyl group, an ethyl group, or an n-propyl group.

7. The silver halide color photographic material as claimed in claim 6, wherein $R_1$ in formula (I) is a methyl group.

8. The silver halide color photographic material as claimed in claim 1, wherein the ring formed by Q together with the C in formula (I) is a substituted or unsubstituted 3-, 4-, or 5-membered cyclic hydrocarbon group.

9. The silver halide color photographic material as claimed in claim 8, wherein the ring formed by Q together with the C in formula (I) is a substituted or unsubstituted 3-membered cyclic hydrocarbon group.

10. The silver halide color photographic material as claimed in claim 4, wherein X in formula (Y) represents a heterocyclic group bonded to the coupling active site through the nitrogen atom or an aryloxy group.

11. The silver halide color photographic material as claimed in claim 4, wherein $R_3$ in formula (Y) represents a halogen atom, an alkoxy group, an alkoxycarbonyl group, an aryloxycarbonyl group, a carbonamido group, a sulfonamido group, a carbamoyl group, or a sulfamoyl group.

12. The silver halide color photographic material claimed in claim 1, wherein the acylacetamide yellow dye-forming coupler represented by formula (I) is present in an amount of $1\times10^{-3}$ to 1 mol per mol of the silver halide in the yellow coupler containing layer.

13. The silver halide color photographic material as claimed in claim 1, wherein the acylacetamide yellow dye-forming coupler represented by formula (I) is contained in a blue-sensitive silver halide emulsion layer and the silver amount of which is 0.1 to 10 g/m$^2$ of the silver halide color photographic material.

14. The silver halide color photographic material as claimed in claim 1, wherein the amount of the cyan coupler represented by formula (II) or (III) to be added is $1\times10^{-3}$ mol to 1 mol, per mol of silver halide in the layer where the coupler is present 15. A method for forming a color image, comprising, subjecting the silver halide color photographic material as claimed in claim 1, after its imagewise exposure, to color development followed by desilvering.

16. The method for forming a color image as claimed in claim 15, wherein iron (III) ethylenediaminetetraacetate or iron (III) 1,3-diaminopropanetetraacetate is a bleaching agent for the desilvering step.

17. The silver halide color photographic material as claimed in claim 4, wherein $R_3$ in formula (Y) is selected from the group consisting of a halogen atom, an alkyl group having C-number of 1 to 30, an aryl group having C-number of 6 to 30, an alkoxy group having C-number of 1 to 30, an aryloxy group having C-number of 6 to 30, an alkoxycarbonyl group having C-number of 2 to 30, an aryloxycarbonyl group having C-number of 7 to 30, a carbonamido group having C-number of 1 to 30, a sulfonamide group having C-number of 1 to 30, a carbamoyl group having C-number of 1 to 30, a sulfamoyl group having C-number of 0 to 30, an alkylsulfonyl group having C-number of 1 to 30, an alkylsulfonyl group having a C-number of 6 to 30, a ureido group having C-number of 1 to 30, a sulfamoylamino group having C-number of 0 to 30, an alkoxycarbonylamino group having C-number of 2 to 30, an alkoxysulfonyl group having C-number of 1 to 30, a nitro group, a heterocyclic group having C-number of 1 to 30, a cyano group, an acyl group having C-number of 1 to 30, an acyloxy group having C-number of 2 to 30, an alkylsulfonyloxy group having C-number of 1 to 30, and an arylsulfonyloxy group having C-number of 6 to 30.

18. The silver halide color photographic material as claimed in claim 4, wherein X in formula (Y) is selected from the group consisting of succinimido, maleinimido, phthalimido, diglycolimido, pyrrole, pyrazole, imidazole, 1,2,4-triazole, tetrazole, indole, indazole, benzimidazole, benzotriazole, imidazolidin-2,4-dione, oxazolidine-2,4-dione, thiazolidine-2,4-dione, imidazolidine-2-one, oxazolidine-2-one, thiazolidine-2-one, benzimidazolidine-2-one, benzoxazolidine-2-one, benzothiazolidine-2-one, 2-pyrroline-5-one, 2-imidazolidine-5-one, indoline-2,3-dione, 2,6-dioxypurine, parabanic acid, 1,2,4-traizolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one.

19. The silver halide color photographic material as claimed in claim 4, wherein $R_2$ in formula (Y) represents a chlorine atom, a fluorine atom, an alkyl group having C-number of 1 to 6, an alkoxy group having C-number of 1 to 8, or an aryloxy group having C-number of 6 to 24.

20. The silver halide color photographic material as claimed in claim 4, wherein $R_3$ in formula (Y) represents a halogen atom, an alkoxy group, an alkoxycarbonyl group, an aryloxycarbonyl group, a carbonamido group, a sulfonamido group, a carbamoyl group, or a sulfamoyl group.

21. The silver halide color photographic material as claimed in claim 4, wherein X is a group represented by the following formula (Y-1), (Y-2) or (Y-3):

Formula (Y-1)

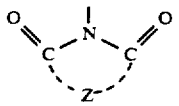

wherein Z represents —O—$CR_4(R_5)$—, —S—$CR_4(R_5)$—, —$NR_6$—$CR_4(R_5)$—, —$NR_6$—$NR_7$—, —$NR_6$—C(O)—, $CR_4(R_5)$—$CR_8(R_9)$— or —$CR_{10}$=$CR_{11}$—, wherein $R_4$, $R_5$, $R_8$, and $R_9$, same or different, each represent a hydrogen atom, an alkyl group, an aryl group, an alkoxy group, an aryloxy group, an alkylthio group, an arylthio group, an alkylsulfonyl group, an arylsulfonyl group, or an amino group; $R_6$ and $R_7$ each represent a hydrogen atom, an alkyl group, an aryl group, an alkylsulfonyl group, an arylsulfonyl group, or an alkoxycarbonyl group; $R_{10}$ and $R_{11}$ each represent a hydrogen atom, an alkyl group, or an aryl group, or $R_{10}$ and $R_{11}$ may bond together to form a benzene ring; and $R_4$ and $R_5$, $R_5$ and $R_6$, $R_6$ and $R_7$, or $R_4$ and $R_8$ may bond together to form a 3- to 8-membered heterocyclic or hydrocarbon ring, which may be substituted;

Formula (Y-2)

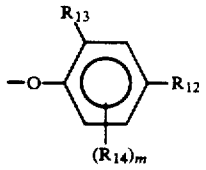

wherein at least one of $R_{12}$ and $R_{13}$ is selected from the group consisting of a halogen atom, a cyano group, a nitro group, trifluoromethyl, a carboxyl group, an alkoxycarbonyl group, a carbonamido group, a sulfonamido group, a carbamoyl group, a sulfamoyl group, an alkylsulfonyl group, an arylsulfonyl group, and an acyl group and the other may be a hydrogen atom, an alkyl group, or an alkoxy group; $R_{14}$ has the same meaning as that of $R_{12}$ or $R_{13}$, and m is an integer of 0 to 2;

Formula (Y-3)

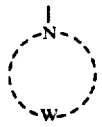

wherein W represents a group of non-metallic atoms required to form together with N a pyrrole ring, a pyrazole ring, an imidazole ring or a triazole ring.

22. The silver halide color photographic material as claimed in claim 4, wherein the ring formed by Q together with the C is selected from the group consisting of a cyclopropane ring, a cyclobutane ring, a cyclopentane ring, a cyclopropene ring, a cyclobutene ring, a cyclopentene ring, an oxetane ring, an oxolane ring, a 1,3-dioxolane ring, a thiethane ring, a thiolane ring, and a pyrrolidine ring.

23. The silver halide color photographic material as claimed in claim 4, wherein $R_1$ is a halogen atom, a cyano group, an unsubstituted or a substituted alkyl group, an unsubstituted or a substituted alkoxy group, an unsubstituted or a substituted aryl group, an unsubstituted or a substituted aryloxy group, cyclopentyl, cyclohexyl, allyl, 3-cyclohexenyl, oleyl, benzyl, trifluoromethyl, hydroxymethyl-methoxyethyl, ethoxycarbonylmethyl or phenoxyethyl, wherein the substituents are selected from the group consisting of a halogen atom, an alkyl group, an alkoxy group, a nitro group, an amino group, a carbonamido group, a sulfonamido group, an acyl group, and combinations thereof or the aryl group is substituted by a substituent selected from the group consisting of phenyl, 1-naphthyl, p-tolyl, o-tolyl, p-chlorophenyl, 4-methoxyphenyl, 8-quinolyl, 4-hexadecyloxyphenyl, pentafluorophenyl, p-hydroxyphenyl, p-cyanophenyl, 3-pentadecylphenyl, 2,4-di-t-pentylphenyl, p-methanesulfonamideophenyl, and 3,4-dichlorophenyl;

Q represents a group of non-metallic atoms which forms together with the carbon atom a substituted or unsubstituted 3 to 5 membered cyclic hydrocarbon ring having a total carbon number of 3 to 30, or a substituted or unsubstituted 3 to 5 member heterocyclic group having a total C-number of 2 to 30 and having in the group at least one heteroatom selected from the group consisting of N, O, S and P;

$R_2$ represents a halogen atom, a substituted or unsubstituted alkoxy group, a substituted or unsubstituted aryloxy group, a substituted or unsubstituted alkyl group, an amino group, cyclopentyl, cyclohexyl, allyl, 3-cyclohexenyl, oleyl, benzyl, trifluoromethyl, hydroxymethyl-methoxyethyl, ethoxycarbonylmethyl or phenoxyethyl; wherein the substituents are selected from the group consisting of a halogen atom, an alkyl group, an alkoxy group, an aryloxy group and combinations thereof;

$R_3$ is a halogen atom, an unsubstituted or substituted alkyl group, cyclopentyl, cyclohexyl, allyl, 3-cyclohexenyl, oleyl, benzyl, trifluoromethyl, hydroxymethylmethoxyethyl, ethoxycarbonylmethyl, phenoxyethyl, an unsubstituted or substituted aryl group, an unsubstituted or substituted alkoxy group, an unsubstituted or substituted aryloxy group, an unsubstituted or substituted alkoxycarbonyl group, an unsubstituted or substituted aryloxycarbonyl group, an unsubstituted or substituted carbonamido group, an unsubstituted or substituted sulfonamido group, an unsubstituted or substituted carbamoyl group, an unsubstituted or substituted sulfamoyl group, an unsubstituted or substituted alkylsulfonyl group, an unsubstituted or substituted arylsulfonyl group, an unsubstituted or substituted ureido group, an unsubstituted or substituted sulfamoylamino group, an unsubstituted or substituted alkoxycarbonylamino group, an unsubstituted or substituted alkoxysulfonyl group, a nitro group, an unsubstituted or substituted heterocyclic group, a cyano group, an unsubstituted or substituted acyl group, an unsubstituted or substituted acyloxy group, an unsubstituted or substituted alkylsulfonyloxy group, or an unsubstituted or substituted arylsulfonyloxy group, wherein the substituents are selected from the group consisting of a halogen atom, an alkyl group, an aryl group, a heterocyclic group, an alkoxy group, an aryloxy group, a heterocyclic oxy group, an alkylthio group, an arylthio group, a heterocyclic thio group, an alkylsulfonyl group, an arylsulfonyl group, an acyl group, a carbonamido group, a sulfonamido group, a carbamoyl group, a sulfamoyl group, an alkoxycarbonylamino group, a sulfamoylamino group, a ureido group, a cyano group, a nitro group, an acyloxy group, an alkoxycarbonyl group, an aryloxycarbonyl group, an alkylsulfonyloxy group, an arylsulfonyloxy group and combinations thereof;

X represents a hydrogen atom or a group capable of being released upon a coupling reaction thereof with an oxidized product of an aromatic primary amine developing agent; l is an integer of 0 to 4, and when l is 2 or more, the $R_3$ groups may be the same or different.

24. The silver halide color photographic material as claimed in claim 4, wherein $R_1$ is a halogen atom, a cyano group, an alkyl group having 1 to 30 carbon atoms, an alkoxy group having 1 to 30 carbon atoms, an aryl group having 6 to 30 carbon atoms, an aryloxy group having 6 to 30 carbon atoms, cyclopentyl, cyclohexyl, allyl, 3-cyclohexenyl, oleyl, benzyl, trifluoromethyl, hydroxymethymethoxyethyl, ethoxycarbonylmethyl or phenoxyethyl.

25. The silver halide color photographic material as claimed in claim 4, wherein the

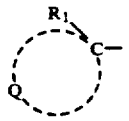

group formed by $R_1$ and Q with C is selected from the group consisting of:

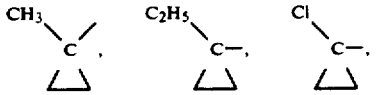

-continued

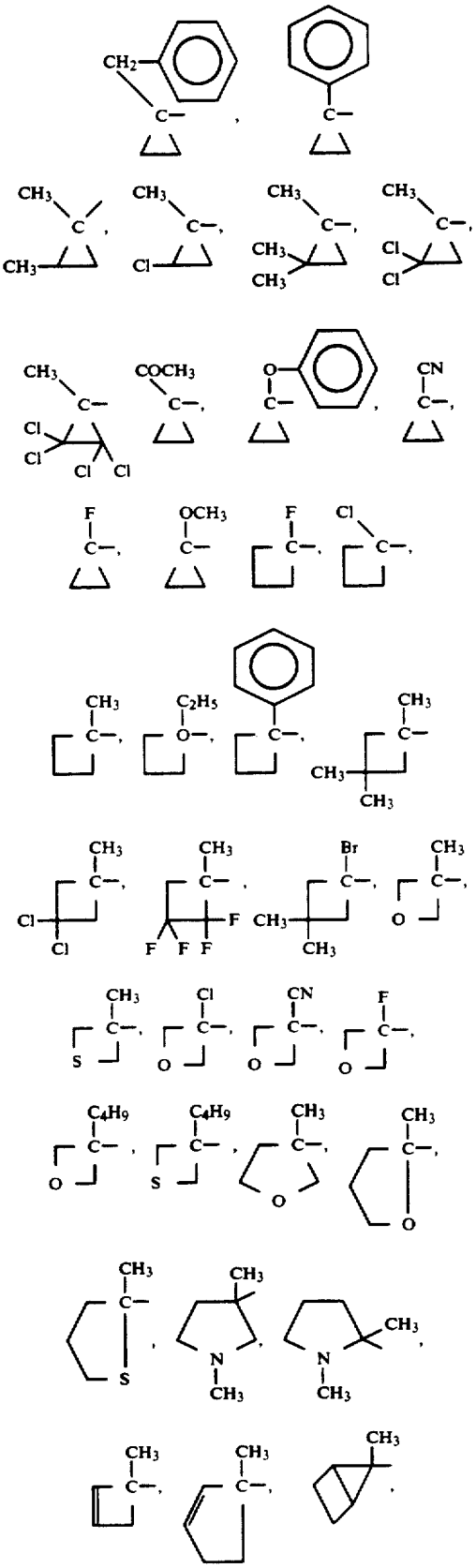

-continued

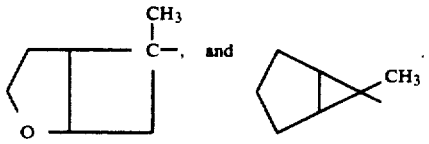

26. The silver halide color photographic material as claimed in claim 4, wherein X represents a 3 to 8 heteroyclic ring containing group that contains at least one heteroatom selected from the group consisting of O, N, S, P, Se and Te and is bonded to the coupling site through a nitrogen atom or an aryloxy group and contains from 2 to 36 carbon atoms and is capable of being released upon a coupling reaction thereof with an oxidizing product of an aromatic primary amine developing agent.

27. The silver halide color photographic material as claimed in claim 4, wherein X is selected from the group consisting of:

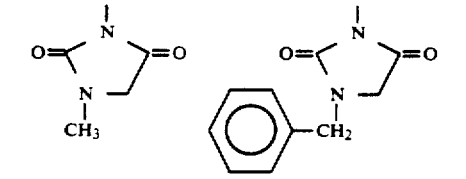

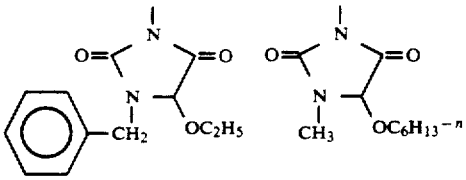

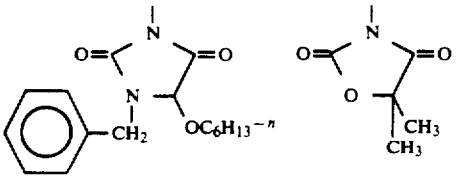

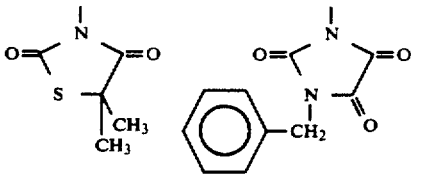

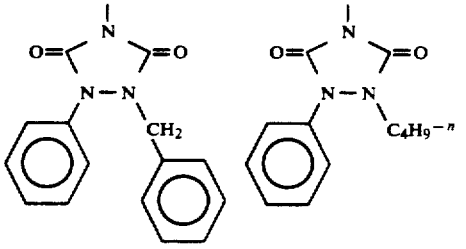

-continued

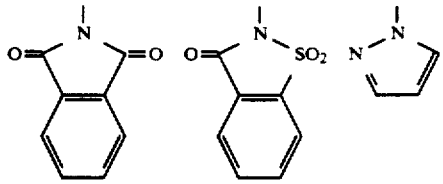

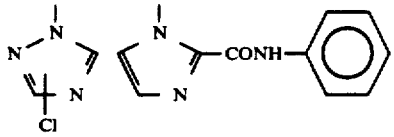

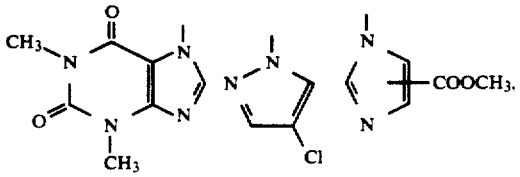

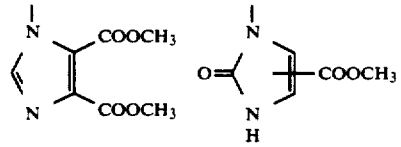

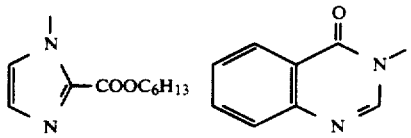

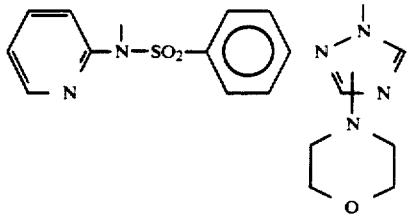

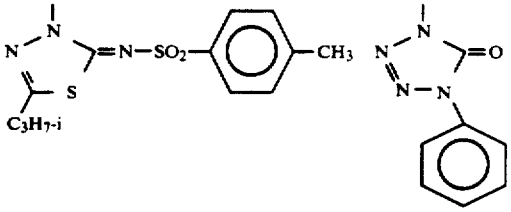

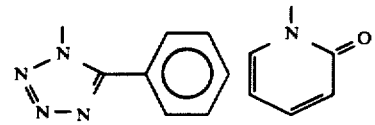

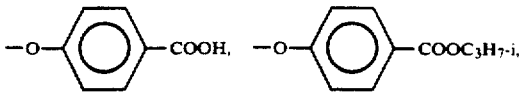

-continued
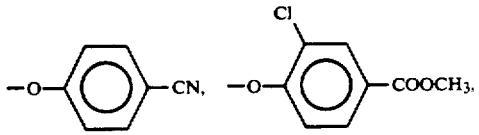
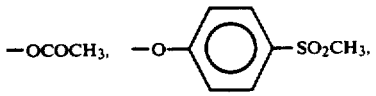
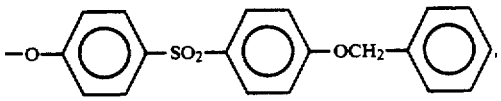
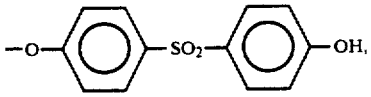
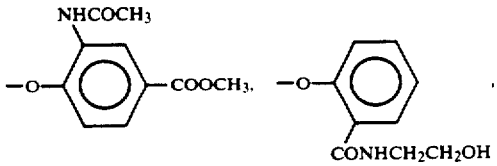
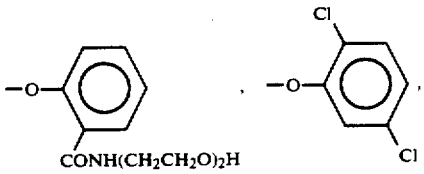
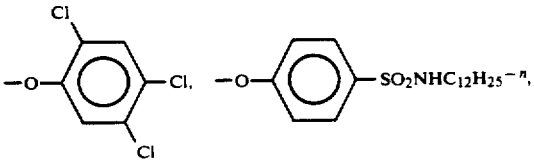
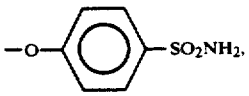
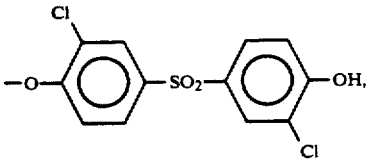
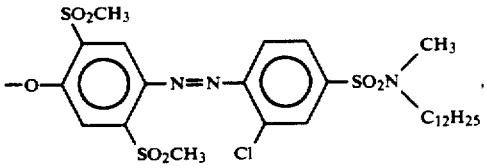
-continued
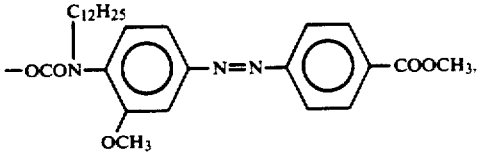
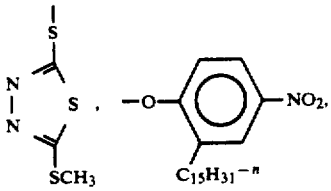
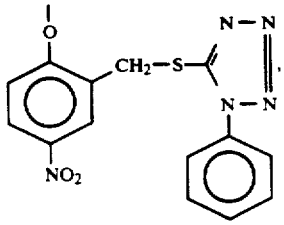
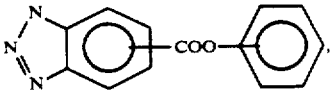
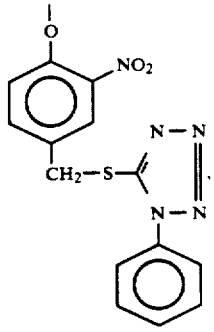
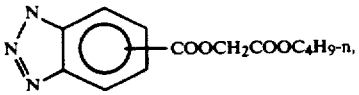
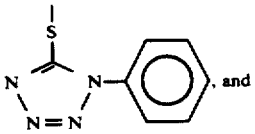 , and
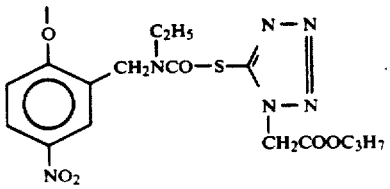

28. The silver halide color photographic material as claimed in claim 23, wherein the substituents are selected from the group consisting of a halogen atom, a hydroxyl group, a nitro group, a cyano group, a carboxyl group, a sulfo group, an alkyl group, an aryl group, an alkoxy group, an aryloxy group, an alkylthio group, an arylthio group, an alkylsulfonyl group, an arylsulfonyl group, an alkoxycarbonyl group, an aryloxycarbonyl group, an acyl group, an acyloxy group, an amino group, a carbonamido group, a sulfonamido group, a carbamoyl group, a sulfamoyl group, an ureido group, an alkoxycarbonylamino group, and a sulfamoylamino group.

29. The silver halide color photographic material as claimed in claim 4, wherein $R_2$ is selected from the group consisting of:

F, Cl, Br, I, $CH_3O$—, 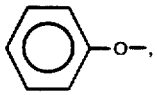

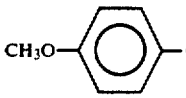 , $CH_3$—, $C_2H_5$—, i-$C_3H_7$—, t-$C_4H_9$—, $CH_3OCH_2CH_2O$—, $CF_3$—, $(CH_3)_2N$—,

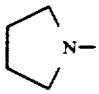
N— n-$C_4H_9O$—, n-$C_{14}H_{29}O$—, n-$C_{16}H_{33}O$—,

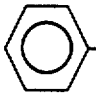
$CH_2O$—, and n-$C_{12}H_{25}O$—,

30. The silver halide color photographic material as claimed in claim 4, wherein $R_2$ represents a halogen atom, an alkoxy group that may be substituted and has a total of 1 to 30 carbon atoms, an aryloxy group that may be substituted and has a total of 6 to 30 carbon atoms, an alkyl group that may be substituted and has a total of 1 to 30 carbon atoms or an amino group that may be substituted and has a total of 0 to 30 carbon atoms, wherein the substituents of the alkoxy group, aryloxy group, alkyl group and amino group is selected from the group consisting of a halogen atom, an alkyl group, an alkoxy group and an aryloxy group.

31. The silver halide color photographic material as claimed in claim 4, wherein $R_3$ is selected from the group consisting of:

F, Cl, Br, I, $CH_3O$—, $C_2H_5O$—, n-$C_{12}H_{25}O$—, $CH_3$, t-$C_4H_9$—, —$COOCH_3$, $COOC_2H_5$, —$COOC_4H_9$-$^n$,

—$COOC_{12}H_{25}$-$^n$, —$OCH_2CH(C_6H_{13}$-$^n)C_8H_{17}$-$^n$ —$COOCH(CH_3)COOC_{12}H_{25}$-$^n$,

—$COOCH(C_4H_9$-$^n)COOC_{12}H_{29}$-$^n$, —COO— 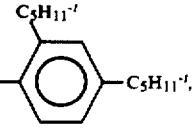 —$C_5H_{11}$-$^t$,

-continued

—$CONH(CH_2)_3O$— 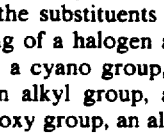 —$C_5H_{11}$-$^t$

—$SO_2NH(CH_2)_4O$— 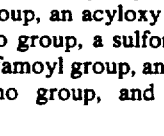 —$C_5H_{11}$-$^t$, —$SO_2N(CH_3)_2$,

—$SO_2NHCOC_2H_5$, —$SO_2NHC_{16}H_{33}$-$^n$, —$NHCOC_{13}H_{27}$-$^n$,

—$NHCOC_{15}H_{31}$-$^n$, —$NHCOC_{17}H_{35}$-$^n$ —$NHCOCH(C_6H_{13}$-$^n)$—$C_8H_{17}$-$^n$,

—$NHCOCH(CH_3)$—$CH_2CH_2CH(CH_3)CH_2C_4H_9$-$^t$
$CH(CH_3)CH_2C_4H_9$-$^t$

—$NHCOCH(CH_3)CH_2SO_2C_{16}H_{33}$-$^n$

—$NHCO(CH_2)_3O$— 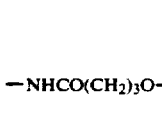 —$C_5H_{11}$-$^t$,

—$NHCOCH(C_2H_5)O$— 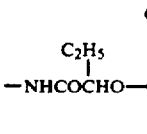 —$C_5H_{11}$-$^t$,

—$NHCOCH(C_3H_7$-$^t)SO_2C_{16}H_{33}$-$^n$, —$NHSO_2C_{12}H_{25}$-$^n$,

—$NHSO_2C_{16}H_{33}$-$^n$, —$NHSO_2$— 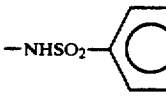 —$OC_{12}H_{25}$-$^n$,

—$NHSO_2$— 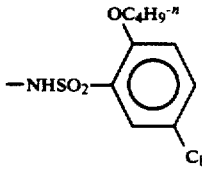 , —$SO_2NHCH_3$,

—$SO_2NH$— 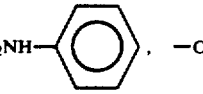 , —$OCOC_{11}H_{23}$-$^n$, —$OSO_2C_{12}H_{25}$-$^n$, and —$NHCOOC_{12}H_{25}$-$^n$, 32. The silver halide color photographic material as claimed in claim 4, wherein l is an integer of 1 or 2 and the position of the substitution of $R_3$ is the meta-position or para-position relative to

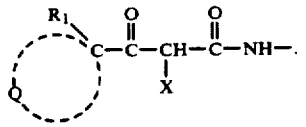

33. The silver halide color photographic material as claimed in claim 21, wherein the total number of carbon atoms of the heterocyclic group represented by formula (Y-1) is 2 to 30.

34. The silver halide color photographic material as claimed in claim 21, wherein the total number of carbon atoms of the heterocyclic group represented by formula (Y-2) is 6 to 30.

35. The silver halide color photographic material as claimed in claim 21, wherein the total number of carbon atoms of the heterocyclic group represented by formula (Y-3) is 2 to 30.

36. The silver halide color photographic material as claimed in claim 4, wherein X represents a substituted or unsubstituted heterocyclic group selected from succinimido, maleinimido, phthalimido, diglycolimido, pyrrole, pyrazole, imidazole, 1,2,4-triazole, tetrazole, indole, indazole, benzimidazole, benzotriazole, imidazolidine-2,4-dione, oxazolidine-2,4-dione, thiazolidine-2,4-dione imidazolidine-2-one, oxazolidine-2-one, thiazolidine-2-one, benzimidazoline-2-one, benzoxazolidine-2-one, benzothiazoline-2-one, 2-pyrroline-5-one, 2-imidazoline-5-one, indoline-2,3-dione, 2,6-dioxypurine, parabanic acid, 1,2,4-traizolidine-3,5-dione, 2-pyridone, 4-pyridone, 2-pyrimidone, 6-pyridazone-2-pyrazone, 2-amino-1,3,4-thiazolidine, and 2-imino-1,3,4-thiazolidine-4-one.

37. The silver halide color photographic material as claimed in claim 1, wherein $R_1$ in Formula (II) is selected from the group consisting of:

$-CONH(CH_2)_3O-A$ $-CONH(CH_2)_4O-A$ $-CONH(CH_2)_3OC_{12}H_{25}$-n $-CONH(CH_2)_3OC_{10}H_{21}$-n $-CONH(CH_2)_3OCH_2CH(C_2H_5)C_4H_9$-n $-CONHC_{16}H_{33}$-n $-CONHCH_2CH(CH_3)CH_2C_{12}H_{25}$-n $-CONH(CH_2CH_2O)_2C_{12}H_{25}$-n $-CONHCH_2CH_2OC_{12}H_{25}$-n

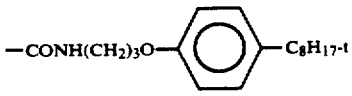

$-CONHCH_2CH(C_6H_{13})C_8H_{17}$-n

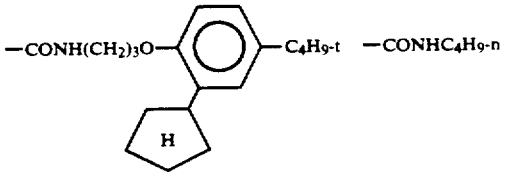

-continued

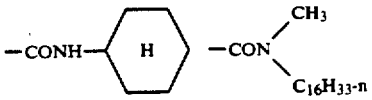

$-CONH(CH_2)_3OC_{14}H_{29}$-n $-CONH(CH_2)_3OC_{11}H_{23}$-n $-SO_2NH(CH_2)_3OC_{12}H_{25}$-n

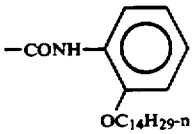

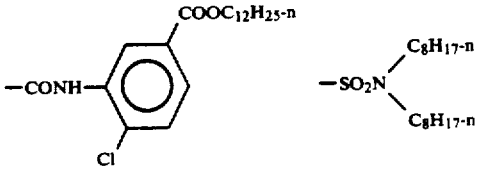

$-NHCO(CH_2)_3O-A$

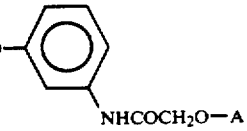

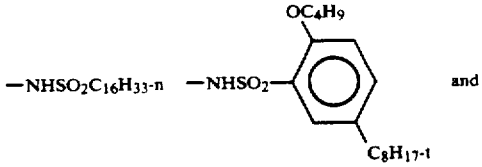

and $-NHCOOC_{12}H_{25}$-n.

38. The silver halide color photographic material as claimed in claim 1, wherein $R_2$ in Formula (II) is selected from the group consisting of:

$-F$ $-Cl$ $-CN$ $-CH_3$ $-CF_3$ $-C_4H_9$-t $-C_8H_{17}$-t $-NHCOCH_3$ $-NHSO_2CH_3$ $-NHCOOC_2H_5$

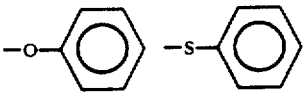

and $-OC_8H_{17}$-n.

39. The silver halide color photographic material as claimed in claim 1, wherein $R^3NH-$ in Formula (II) is selected from the group consisting of:

$-NHCOCH_3$ $-NHCOCF_3$

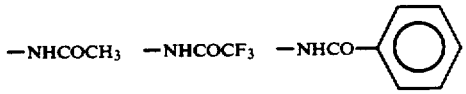

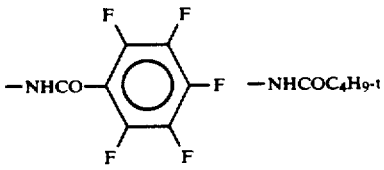

$-NHCOC_4H_9$-t

-continued

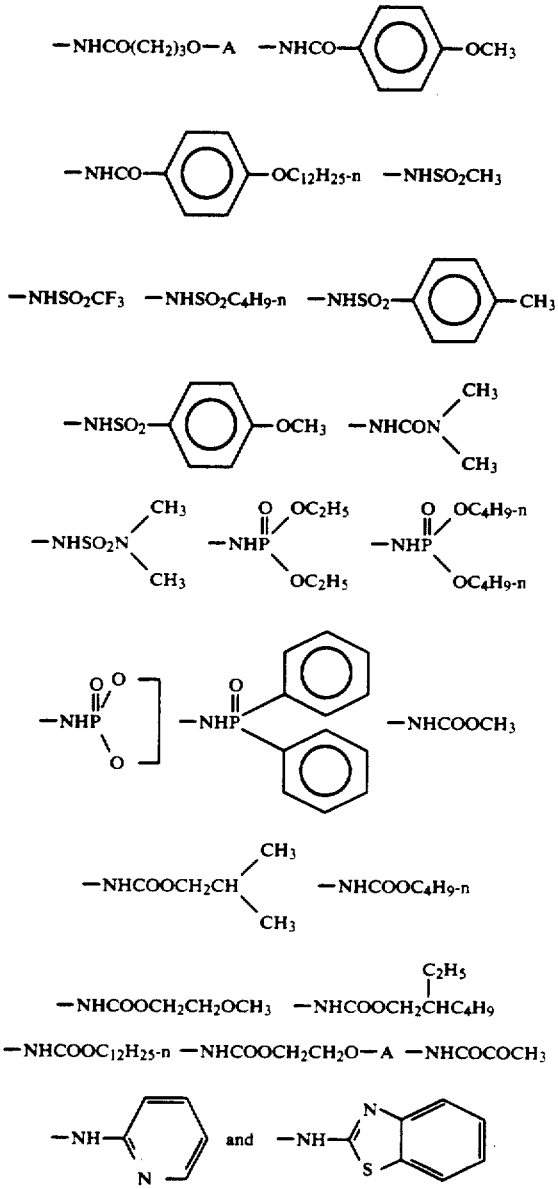

40. The silver halide color photographic material as claimed in claim 1, wherein $X^1$ in Formula (II) is selected from the group consisting of:

$-OC_2H_5$ $-OCH_2CH_2OH$ $-OCH_2CH_2SO_2CH_3$ $-O(CH_2CH_2O)_2H$ $-OCH_2COOH$ $-O(CH_2)_3COOH$ $-OCH_2COOC_2H_5$ $-OCH_2CONHCH_2CH_2OCH_3$ $-OCH_2CH_2SCH_2COOH$ $-OCH_2CH_2SCH(C_{12}H_{25}\text{-}n)COOH$ $-OCH_2CH_2OCH_3$ $-OCH_2CH_2NHSO_2CH_3$

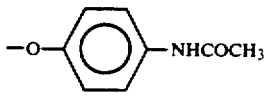

-continued

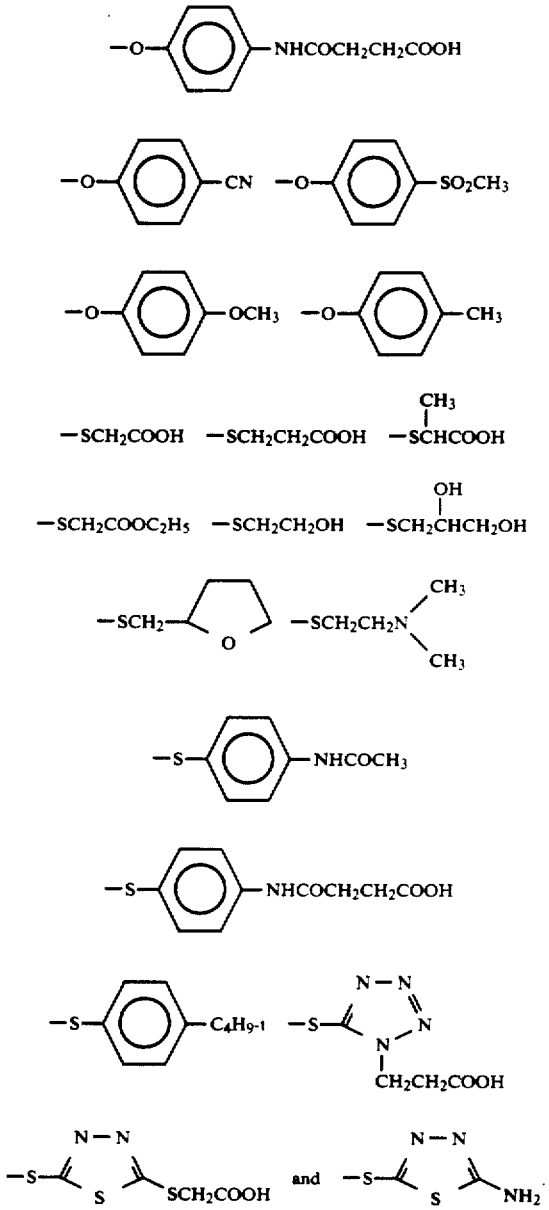

41. The silver halide color photographic material as claimed in claim 1, wherein $R^{21}$ in Formula (III) is selected from the group consisting of:

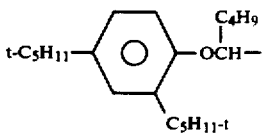

A

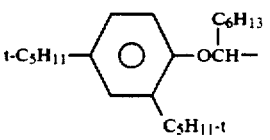

B

-continued
C
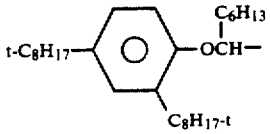
D
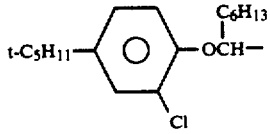
E
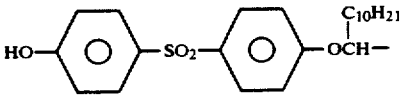
F
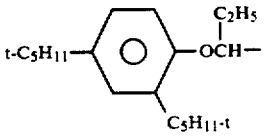
G
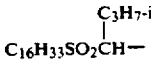
H
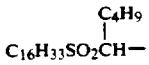
I
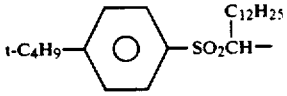
J
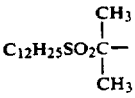
K
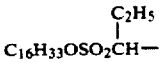
L
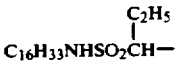
M
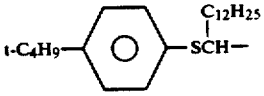
N
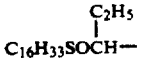
O
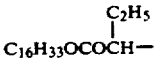
P
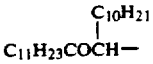
Q
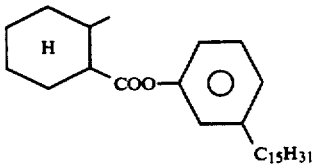
R
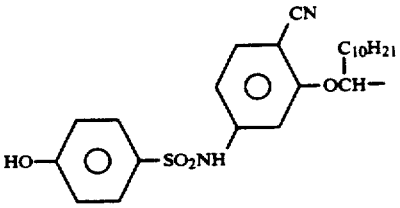
S
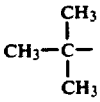
T
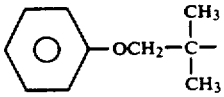
U
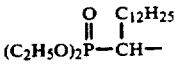
V
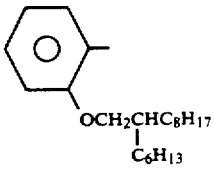
W
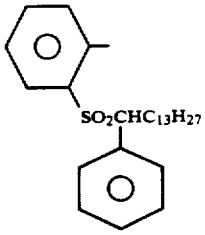
X
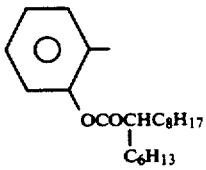
Y
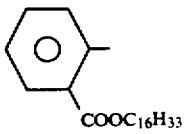

-continued
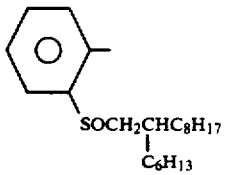
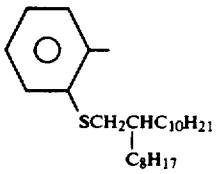
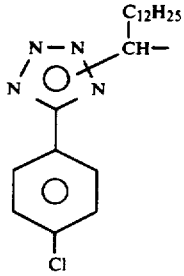
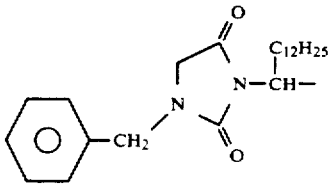
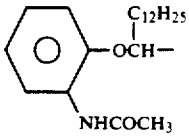
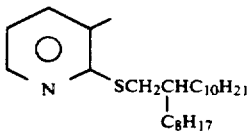
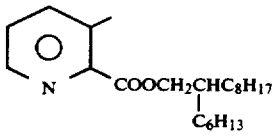
and
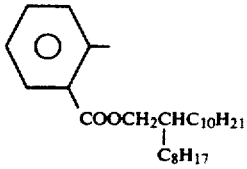
42. The silver halide color photographic material as claimed in claim 1, wherein $R^{22}$ in Formula (III) is selected from the group consisting of:
| Z | |
|---|---|
| a | 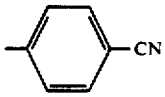  |
| b | 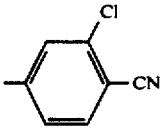  |
| c | 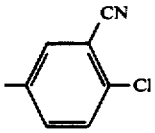  |
| d | 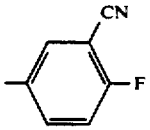  |
| e | 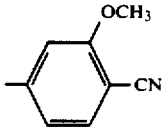  |
| f | 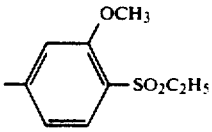  |
| g | 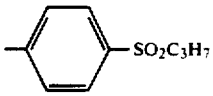  |
| | 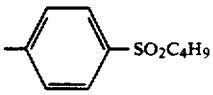  |
| | 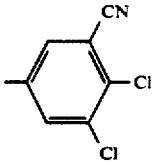  |
| | 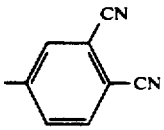  |
| | 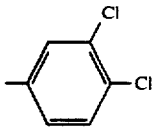  |

-continued
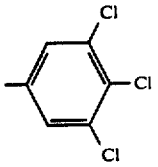
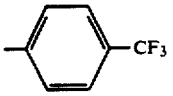
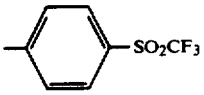
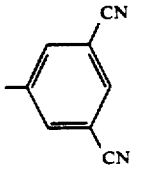
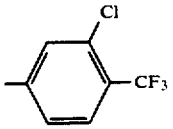
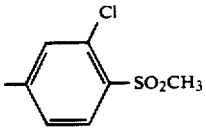
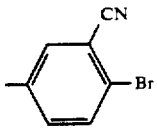
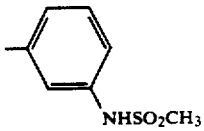
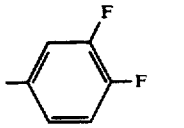
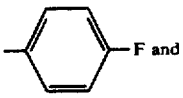
-continued
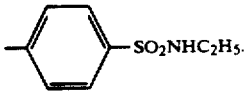
43. The silver halide color photographic material as claimed in claim 1, wherein $Z^1$ in Formula (III) is selected from the group consisting of:
H
F
Cl
$-OCOCH_3$
$-OSO_2CH_3$
$-OCOOC_2H_5$
$-OCONHC_2H_5$
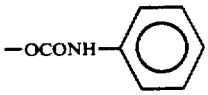
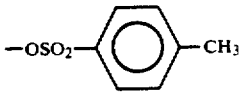
$-OCH_3$
$-OCH_2CH_2OCH_3$
$-OCH_2CH_2Cl$
$-OCH_2COOCH_3$
$-OCH_2COOH$
$-OCH(CH_3)COOH$
$-OCH_2CH_2SO_2CH_3$
$-OCH_2CONHCH_2CH_2OCH_3$
$-O-P(=O)(OC_2H_5)_2$
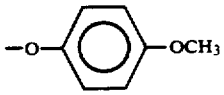
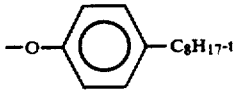
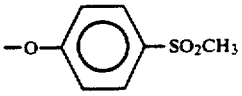

-continued
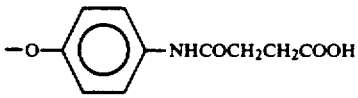
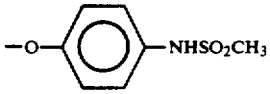
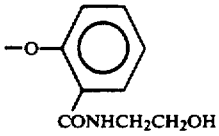
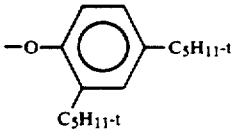
$-OCH_2COOCH_2CH_2OCH_3$
$-OCH_2COOCH(CH_3)C_2H_5$
$-SCH_2COOH$
$-SCH_2CH_2COOH$
-continued
$-SCH_2CH(OH)CH_2OH$
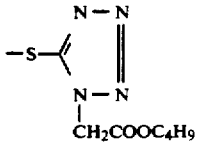
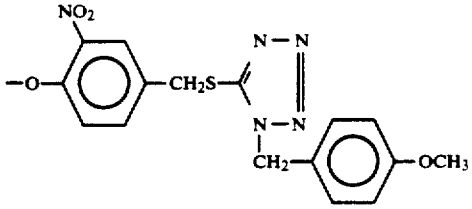
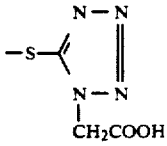
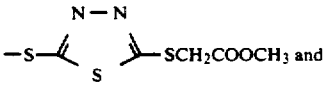
and
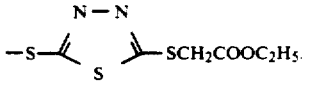
* * * * *